US006933957B2

(12) United States Patent
Omori et al.

(10) Patent No.: US 6,933,957 B2
(45) Date of Patent: Aug. 23, 2005

(54) PIXEL CLOCK GENERATION APPARATUS, PIXEL CLOCK GENERATION METHOD, AND IMAGE FORMING APPARATUS CAPABLE OF CORRECTING MAIN SCAN DOT POSITION SHIFT WITH A HIGH DEGREE OF ACCURACY

(75) Inventors: Atsufumi Omori, Kanagawa (JP); Masaaki Ishida, Kanagawa (JP); Yasuhiro Nihei, Kanagawa (JP); Dan Ozasa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/667,321

(22) Filed: Sep. 23, 2003

(65) Prior Publication Data

US 2004/0125199 A1 Jul. 1, 2004

(30) Foreign Application Priority Data

Sep. 24, 2002 (JP) ..... 2002-277742
Aug. 5, 2003 (JP) ..... 2003-286608

(51) Int. Cl.[7] ..... B41J 2/435
(52) U.S. Cl. ..... 347/249
(58) Field of Search ..... 347/234–237, 347/247–252; 327/2–3, 136, 141–149, 158; 358/474; 355/35; 359/198, 204, 494

(56) References Cited

U.S. PATENT DOCUMENTS 4,872,065 A * 10/1989 Isono et al. ..... 358/494
5,138,623 A 8/1992 Ema et al.
5,237,579 A 8/1993 Ema et al.
5,258,780 A 11/1993 Ema et al.
5,283,681 A * 2/1994 Hoshino et al. ..... 359/198
5,784,091 A 7/1998 Ema et al.
5,946,334 A 8/1999 Ema et al.
6,118,798 A 9/2000 Ema et al.
6,366,336 B1 * 4/2002 Kanno ..... 355/35
6,476,955 B1 * 11/2002 Yoshida ..... 359/204
6,498,617 B1 12/2002 Ishida et al.
2004/0125199 A1 7/2004 Omori et al.

FOREIGN PATENT DOCUMENTS

JP 11-167081 6/1999
JP 2001-228415 8/2001

OTHER PUBLICATIONS

U.S. Appl. No. 10/667,321, filed Sep. 23, 2003, Omori et al.
U.S. Appl. No. 10/981,677, filed Nov. 5, 2004, Miyatake et al.
U.S. Appl. No. 10/953,372, filed Sep. 30, 2004, Nihei et al.
U.S. Appl. No. 10/942,907, Sep. 17, 2004, Miyatake et al.
U.S. Appl. No. 10/942,073, filed Sep. 16, 2004, Ozasa et al.
U.S. Appl. No 08/253,322, filed Jun. 3, 1994.
U.S. Appl. No. 10/095,913, filed Mar. 13, 2002, Ema et al.
U.S. Appl. No. 10/183,748, filed Jun. 28, 2002, Nihei et al.
U.S. Appl. No. 10/214,559, filed Aug. 9, 1999, Ishida et al.
U.S. Appl. No. 10/259,769, filed Sep. 30, 2002, Omori et al.
U.S. Appl. No. 10/323,837, filed Dec. 20, 2002, Suzuki et al.
U.S. Appl. No. 10/409,143, filed Apr. 9, 2003, Ozasa et al.
U.S. Appl. No. 10/435,034, filed May 12, 2003, Nihei et al.
U.S. Appl. No. 10/667,321, filed Sep. 23, 2003, Omori et al.

* cited by examiner

*Primary Examiner*—Hai Pham
(74) *Attorney, Agent, or Firm*—Oblon, Spivak, McClelland, Maier & Neustadt, P.C.

(57) ABSTRACT

A pixel clock generation apparatus includes a detector detecting a time interval between two horizontal synchronization signals. A comparing part compares the time interval detected by the detector and a target value, and outputs the difference. A phase shift data generation part stores one or more lookup tables each storing a pattern of phase shift data for controlling a phase shift amount of a pixel clock, and reads and outputs the phase shift data from the lookup table based on the difference that is output from the comparing part. A high frequency clock generation part generates a high frequency clock. A pixel clock generation part generates the pixel clock whose phase is controlled in accordance with the phase shift data based on the high frequency clock.

46 Claims, 31 Drawing Sheets

PIXEL CLOCK GENERATION APPARATUS, PIXEL CLOCK GENERATION METHOD, AND IMAGE FORMING APPARATUS CAPABLE OF CORRECTING MAIN SCAN DOT POSITION SHIFT WITH A HIGH DEGREE OF ACCURACY

BACKGROUND OF THE INVENTION

1. Field of the Invention

The present invention generally relates to image forming apparatuses such as laser printers, digital copying apparatuses, and the like, and more specifically, to an apparatus and method for generating a pixel clock used in theses image forming apparatuses.

2. Description of the Related Art

FIG. 1 shows a general structure of an image forming apparatus, such as a laser printer, a digital copying apparatus, and the like.

In FIG. 1, a laser beam output from a semiconductor laser unit 3009 is scanned by a rotating polygon mirror 3003, forms an optical spot on a photoconductor 3001, which is a medium to be scanned, via a scan lens 3002, and forms an electrostatic latent image by exposing the photoconductor 3001. On this occasion, a photodetector 3004 detects the scan beam for each line. A phase locked loop 3006 receives a clock from a clock generation circuit 3005, generates a phase-locked image clock (pixel clock) for each line based on an output signal of the photodetector 3004, and supplies the image clock to an image processing unit 3007 and a laser drive circuit 3008.

In this manner, the laser drive circuit 3008 controls formation of the electrostatic latent image on the photoconductor 3001 by controlling the light emission time of the semiconductor laser unit 3009 in accordance with image data generated by the image processing unit 3007 and the image clock whose phase is set for each line.

In such an optical scanning system, variation in the distance from the rotational axis to a deflection (reflection) surface of a deflector, such as the polygon mirror 3003, generates irregularity in the scan speed of the optical spot (scan beam) that scans the surface to be scanned. The irregularity in the scan speed causes fluctuation in an image, which leads to degradation of image quality. When high image quality is required, it is necessary to correct irregularity in scanning (hereinafter referred to as "scan irregularity").

Further, in a multi-beam optical system that performs simultaneous scanning by using a plurality of light beams, if there is a difference among respective oscillation wavelengths of light emitting sources, an exposure position shift is generated in the case of an optical system in which chromatic aberration of a scan lens is not corrected. Accordingly, a difference is generated among the scan widths of the optical spots, corresponding to the respective light emitting sources, in scanning a surface to be scanned, which causes degradation in image quality. For this reason, it is necessary to perform correction of the scan widths.

Conventionally, regarding techniques of correcting scan irregularity and the like, as disclosed in Japanese Laid-Open Patent Applications No. 11-167081 and No. 2001-228415, for example, a method is known in which the optical spot position along a scanning line is controlled by basically varying the frequency of a pixel clock.

Also, a method is known in which scan speed is detected by counting a clock in a time period in which a scan beam passes two photodetectors provided at opposing ends of a photoconductor, and the rotational speed of a polygon mirror is controlled in accordance with the detected result.

FIG. 2 shows an image forming apparatus to which the conventional method is applied. The image forming apparatus includes: a photoconductor 3115; photodetectors 3117 and 3118 provided at opposing ends of the photodetector 3115; a scan speed detector 3111 detecting the scan speed by counting clocks between detection signals of the photodetectors 3117 and 3118, and outputting a correction signal; a polygon motor controller 3112 controlling the rotational speed of a drive motor (not shown) of a polygon mirror 3114 in accordance with the correction signal; a semiconductor laser 3121; a collimator lens 3122; a cylinder lens 3123; a fθ lens 3116; a toroidal lens 3120; and a mirror 3119.

In the conventional method (frequency modulation method) of varying the frequency of the pixel clock, however, the configuration of the pixel clock controller is generally complex, and the complexity is increased as the frequency modulation range is decreased. Therefore, there is a disadvantage in that realization of delicate control is not easy. In addition, there is another disadvantage in that irregularity in the scan speed is generated by rotational jitter of the deflector and by expansion and contraction of the scan lens due to temperature variation, even in a light beam deflected by the same deflection (reflection) surface. Further, there is a limit to control accuracy in the method of controlling the rotational motor of the deflector.

Incidentally, in an image forming apparatus, a shift occurs between an actual main scan dot position and an ideal main scan dot position. The following reasons can be cited for the shift, for example.

(1) The fθ characteristic of the scan lens is not sufficiently corrected.

(2) Process accuracy and mounting accuracy of optical components of the light scanning optical system are degraded.

(3) The fθ characteristic is degraded by variation in the focal distance in the scanning optical system, which is caused by deformation of optical components and variation in the refraction factor due to environmental change in the apparatus, such as change in temperature and humidity.

Especially, it is impossible to avoid a main scan dot position shift due to environmental change even if optical tuning and electrical correction are conducted at the time of shipping the apparatus. For example, even if there is no problem at the first printing, a problem can occur in that the hue of the first printing is different from that after a plurality of sheets of printing since the temperature in the apparatus is increased when printing out is performed successively.

SUMMARY OF THE INVENTION

It is a general object of the present invention to provide an improved and useful pixel clock generation apparatus, pixel clock generation method, and image forming apparatus in which one or more of the above-mentioned problems are eliminated.

It is another and more specific object of the present invention to correct a main scan dot position shift caused by environmental change with a high degree of accuracy in an image forming apparatus, and to provide a pixel clock generation apparatus and pixel clock generation method that are capable of performing such correction.

It is still another object of the present invention to provide a pixel clock generation apparatus and pixel clock generation method that are capable of easily and flexibly responding to a difference in characteristics of a scanning optical system of an image forming apparatus and correcting a main scan dot position shift with a high degree of accuracy.

In the present invention, characteristic values of the relationship between dot position shifts of actual image heights with respect to ideal image heights in a scanning optical system are determined in advance by preliminary examination, simulation, or the like. A lookup table is created based on the characteristic values. The present invention intends to correct a main scan dot position shift with a high degree of accuracy by reading, from the lookup table, phase shift data that correspond to time variation between horizontal synchronization signals, and controlling the phase of a pixel clock in accordance with the phase shift data.

In order to achieve the above-mentioned objects, according to one aspect of the present invention, there is provided a pixel clock generation apparatus that includes:

a detector detecting a time interval between two horizontal synchronization signals;

a comparing part comparing the time interval detected by said detector and a target value, and outputting a difference therebetween;

a phase shift data generation part having a lookup table storing a pattern of phase shift data for controlling a phase shift amount of a pixel clock, and reading and outputting the phase shift data from the lookup table based on the difference that is output from said comparing part;

a high frequency clock generation part generating a high frequency clock; and a pixel clock generation part generating the pixel clock whose phase is controlled in accordance with the phase shift data that are output from said phase shift data generating part based on the high frequency clock that is generated by said high frequency clock generating part.

Additionally, according to another aspect of the present invention, there is provided an image forming apparatus that includes:

a medium to be scanned;

a light beam source outputting one or more light beams;

a deflecting part deflecting the light beams output from the light beam source so that the deflected light beam scans the medium to be scanned and forms an image on the medium to be scanned;

the above-mentioned pixel clock generation apparatus generating a pixel clock; and a horizontal synchronization detector detecting scan timings at which the light beam scans two or more specific horizontal scan positions, so as to generate two or more horizontal synchronization signals supplied to the pixel clock generation apparatus, wherein the light beam source is driven in synchronization with the pixel clock generated by the pixel clock generation apparatus.

In addition, according to another aspect of the present invention, there is provided a pixel clock generation apparatus that includes:

a detector detecting a time interval between each two adjacent horizontal synchronization signals among three or more of the horizontal synchronization signals;

a comparing part comparing each time interval detected by said detector with a target value and outputting each difference therebetween;

a phase shift data generation part having at least one lookup table storing a pattern of phase shift data for controlling a phase shift amount of a pixel clock, and reading and outputting the phase shift data from the lookup table based on each difference that is output from said comparing part;

a high frequency clock generation part generating a high frequency clock; and a pixel clock generation part generating a pixel clock whose phase is controlled in accordance with the phase shift data that are output from said phase shift data generating part based on the high frequency clock that is generated by said high frequency clock generating part.

Also, according to another aspect of the present invention, there is provided an image forming apparatus that includes:

a medium to be scanned;

a light beam source outputting one or more light beams;

a deflecting part deflecting the light beams output from said light beam source so that the deflected light beam scans said medium to be scanned and forms an image on said medium to be scanned;

the above-mentioned pixel clock generation apparatus generating a pixel clock; and a horizontal synchronization detector detecting scan timings at which the light beam scans two or more specific horizontal scan positions, so as to generate two or more horizontal synchronization signals supplied to said pixel clock generation apparatus, wherein said light beam source is driven in synchronization with the pixel clock generated by said pixel clock generation apparatus.

Additionally, according to another aspect of the present invention, there is provided a pixel clock generation method that includes the steps of:

detecting a time interval between two horizontal synchronization signals;

reading phase shift data from a lookup table based on a difference between the detected time interval and a target value; and controlling phase of a pixel clock in accordance with the phase shift data.

Also, according to another aspect of the present invention, there is provided a pixel clock generation method, including the steps of:

detecting a time interval between each two adjacent horizontal synchronization signals among three or more of the horizontal synchronization signals;

reading phase shift data from a lookup table based on each difference between the detected time interval and a target value; and controlling phase of a pixel clock in accordance with the phase shift data.

In addition, according to another aspect of the present invention, there is provided a tandem-type image forming apparatus that includes:

a plurality of color stations corresponding to respective colors, each including a light beam source for image writing, the pixel clock generation apparatus as mentioned above, and a horizontal synchronization detector for generating two or more horizontal synchronization signals supplied to the pixel clock generation apparatus as mentioned above, wherein, in each of the color stations, said light beam source for image writing is driven in synchronization with the pixel clock generated by the pixel clock generation apparatus corresponding to the color station.

According to the present invention, it is possible to correct main scan dot position shift caused by, for example, environmental variation and characteristics of the scanning optical system of the image forming apparatus with a high degree of accuracy. Hence, it is possible to form an image of high quality. It is also easy to respond to a difference in characteristics of the scanning optical system of an image forming apparatus by changing the lookup table. Further, it is unnecessary to make the frequency of the high frequency clock for generating the pixel clock PCLK extremely high as compared to the frequency of the pixel clock PCLK. This is a great advantage for realizing the pixel clock generation apparatus technically and in terms of costs.

Other objects, features and advantages of the present invention will become more apparent from the following detailed description when read in conjunction with the following drawings.

DETAILED DESCRIPTION OF THE PREFERRED EMBODIMENTS

A description will now be given of preferred embodiments of the present invention, with reference to the drawings.

<<Basic Structure of Pixel Clock Generation Apparatus>>

A description will be given of the basic structure of a pixel clock generation apparatus of the present invention. The pixel clock generation apparatus outputs a pixel clock PCLK that determines pixel timing of an image forming apparatus. As is described further below, the pixel clock generation apparatus receives two or more horizontal synchronization signals sync 1~n (n≧1) that are generated by detecting a scan beam of the image forming apparatus by a photodetector.

Figure 1:
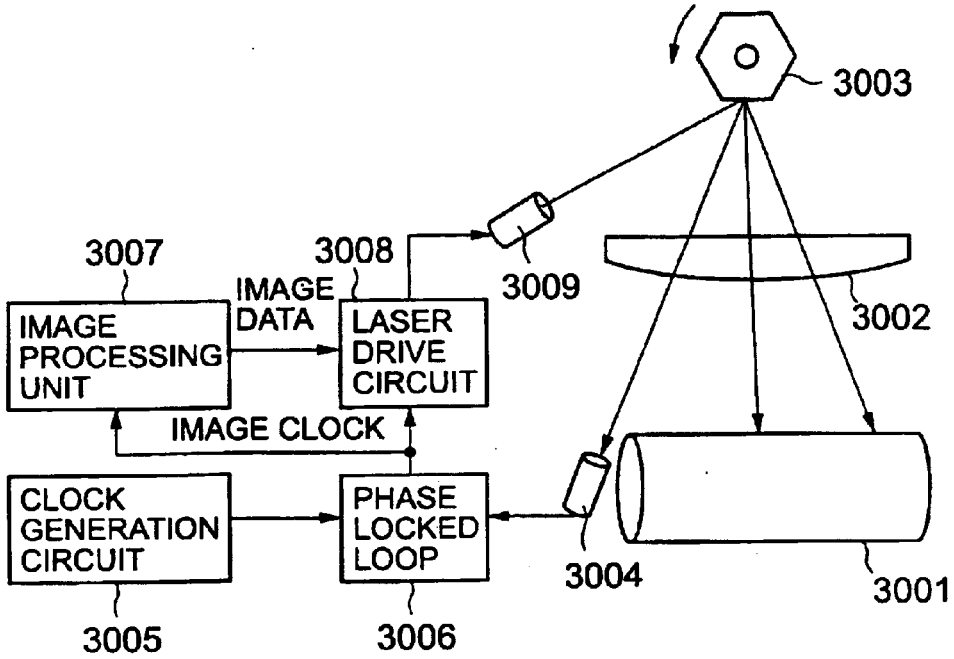
FIG. 1 PRIOR ART
FIG. 1 is a schematic diagram of a conventional image forming apparatus.
Figure 2:
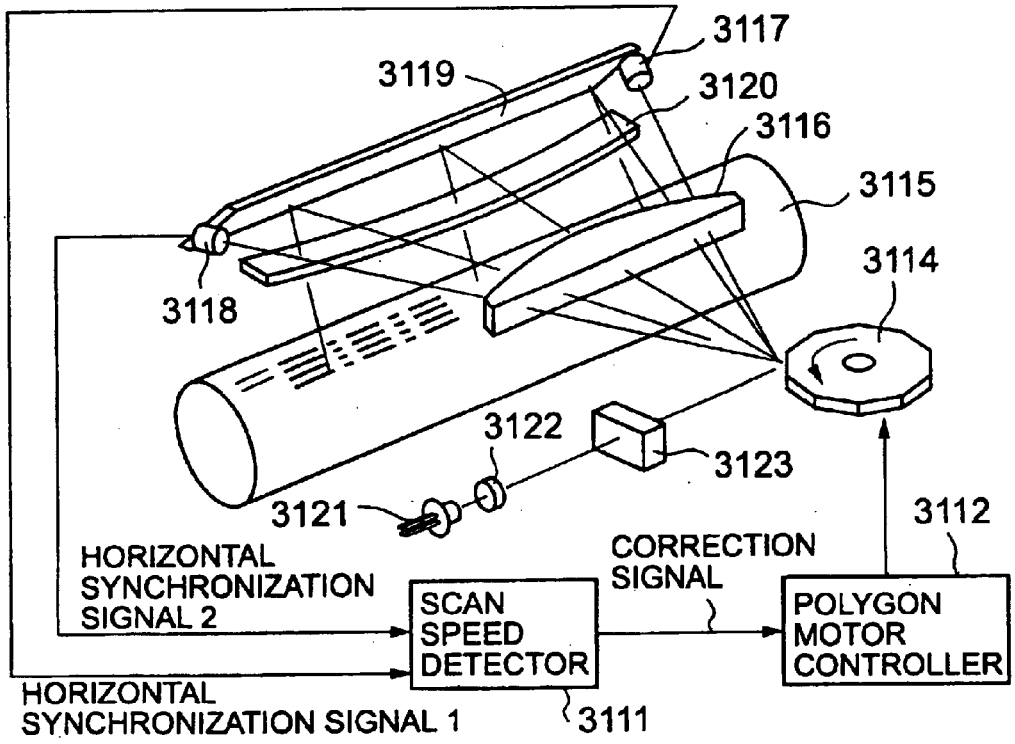
FIG. 2 PRIOR ART
FIG. 2 is another schematic diagram of a conventional image forming apparatus.
Figure 3:
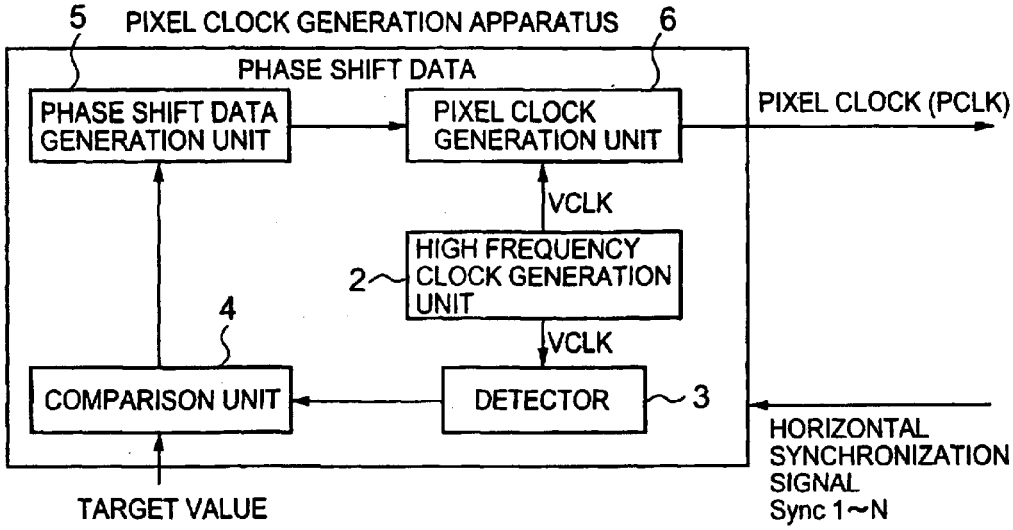
FIG. 3 is a block diagram of a pixel clock generation apparatus of the present invention.

As shown in FIG. 3, the pixel clock generation apparatus includes a high frequency clock generation unit 2, a detector (detection circuit) 3, a comparison unit 4, a phase shift data generation unit 5, and a pixel clock generation unit 6.

The high frequency clock generation unit 2 is means for generating a high frequency clock VCLK, which serves as the reference of the pixel clock PCLK.

The detector 3 is means for detecting the time interval between two horizontal synchronization signals. The detector 3 counts the high frequency clocks VCLK that are generated between two horizontal synchronization signals, and outputs the count value.

The comparison unit 4 compares the time interval (the count value of the high frequency clock VCLK) detected by the detector 3 and a predetermined target value (specifically, a time interval represented by a count value of the high frequency clock VCLK), and outputs the difference (a shift amount of horizontal scan time or speed) therebetween.

The phase shift data generation unit 5 is means for generating phase shift data for controlling a phase shift amount of the pixel clock so as to correct the difference (the shift amount of horizontal scan time or speed) that is obtained by the comparison unit 4. As is described further below, the phase shift data generation unit 5 incorporates one or more lookup tables (LUT) storing patterns of phase shift data. The phase shift data generation unit 5 reads phase shift data from the LUT and outputs them.

The pixel clock generation unit 6 is means for generating the pixel clock PCLK whose phase is controlled in accordance with the phase shift data based on the high frequency clock VCLK.

Figure 4:
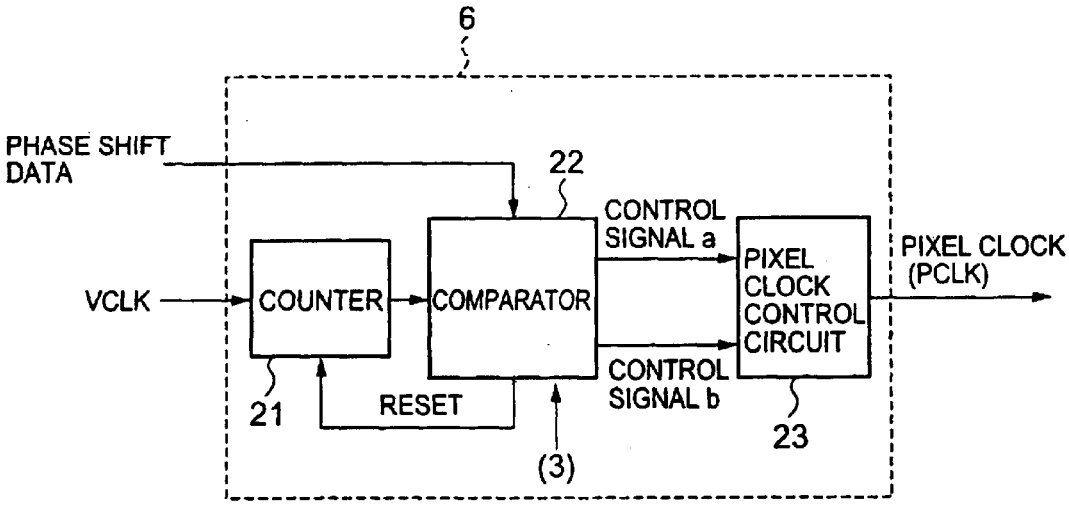
FIG. 4 is a block diagram of a pixel clock generation unit of the pixel clock generation apparatus of the present invention.

FIG. 4 shows an example of the internal configuration of the pixel clock generation unit 6. In FIG. 4, the pixel clock generation unit 6 includes a counter 21, a comparator 22, and a pixel clock control circuit 23.

The counter 21 is operated at the rise of the high frequency clock VCLK and counts the clock. The comparator 22 compares the count value of the counter 21, a predetermined value (for example, 3), and phase shift data (data instructing a phase shift amount for determining the transition timing of the pixel clock PCLK) supplied from the phase shift data generation unit 5 (refer to FIG. 3), and outputs controls signals "a" and "b" based on the comparison result. The pixel clock control circuit 23 controls the transition timing of the pixel clock PCLK based on the control signals "a" and "b".

Figure 5:
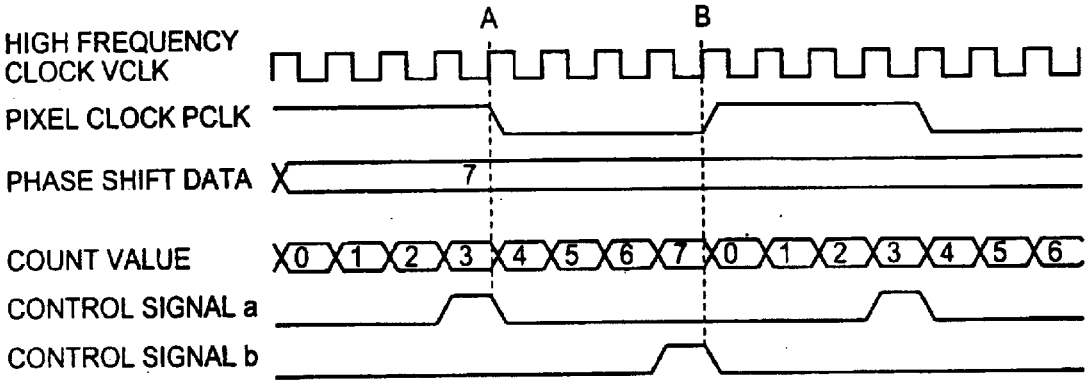
FIG. 5 is a timing chart for explaining an operation of the pixel clock generation unit.
Figure 6:
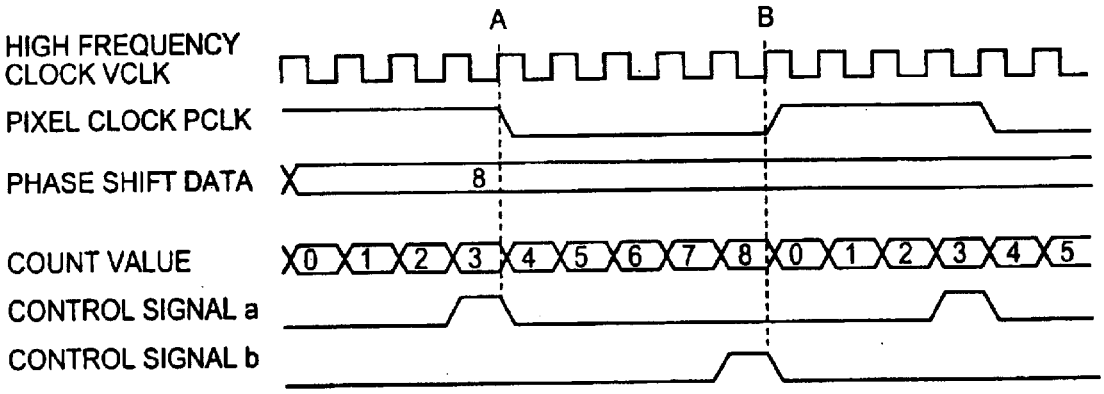
FIG. 6 is another timing chart for explaining an operation of the pixel clock generation unit.
Figure 7:
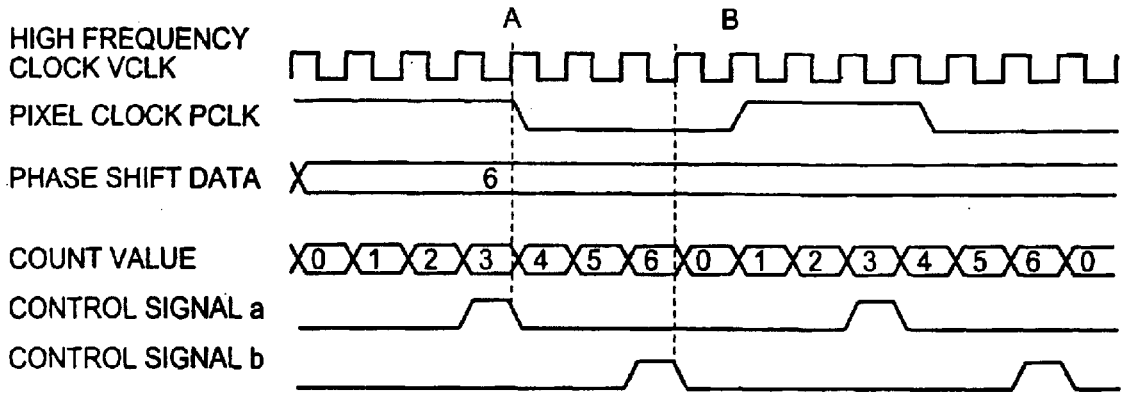
FIG. 7 is still another timing chart for explaining an operation of the pixel clock generation unit.

Referring to timing diagrams of FIGS. 5 through 6, a description will be given of the operation of the pixel clock generation unit 6. Here, it is assumed that the frequency of the pixel clock PCLK is ⅛ of that of the high frequency clock VCLK, and the duty ratio is 50% at standard. FIG. 5 shows generation of the standard pixel clock PCLK having the duty ratio of 50% and having a frequency corresponding to ⅛ the frequency of the high frequency clock VCLK. FIG. 6 shows generation of the pixel clock PCLK whose phase is delayed for only ⅛ clock with respect to the ⅛ frequency of the high frequency clock VCLK. FIG. 7 shows generation of the pixel clock PCLK whose phase is advanced for only ⅛ clock with respect to the ⅛ frequency of the high frequency clock VCLK.

First, a description will be given of FIG. 5. Here, the value "7" is given as the phase shift data. In addition, it is assumed that the predetermined value of the comparator 22 is "3". The counter 21 is operated at the rise of the high frequency clock VCLK and performs counting.

The comparator 22 outputs the control signal "a" when the value of the counter 21 becomes the predetermined value "3". Since the control signal "a" becomes "H", the pixel clock control circuit 23 changes the pixel clock PCLK from "H (high)" to "L (low)" at the rise of the high frequency clock VCLK, which is indicated by A in FIG. 5, after the control signal "a" becomes "H".

Next, the comparator 22 compares the given phase data value with the count value, and outputs the control signal "b" when they match. In FIG. 5, when the value of the counter 21 becomes "7", the comparator 22 outputs the control signal "b". The pixel clock control circuit 23 makes a transition of the pixel clock PCLK from "L" to "H" at the rise of the high frequency clock VCLK, which is indicated by B in FIG. 5. On this occasion, simultaneously, the comparator 22 resets the counter 21, and resumes counting from 0.

In this manner, as shown in FIG. 5, the pixel clock PCLK having the duty ratio of 50% and corresponding to 8 high frequency clocks VCLK is generated. It should be noted that the duty ratio of the pixel clock PCLK is varied if the predetermined value of the comparator 22 is varied.

Next, a description will be given of FIG. 6. Here, the value "8" is given as the phase shift data. The counter 21 counts the high frequency clocks VCLK.

The comparator 22 outputs the control signal "a" when the value of the counter 21 becomes "3". Since the control signal "a" becomes "H", the pixel clock control circuit 23 makes a transition of the pixel clock PCLK from "H" to "L" at the rise of the high frequency clock VCLK, which is indicated by A in FIG. 6.

Next, the comparator 22 outputs the control signal "b" when the value of the counter 21 matches the given phase shift data value ("8", in this case). Since the control signal "b" becomes "H", the pixel clock control circuit 23 makes a transition of the pixel clock PCLK from "L" to "H" at the rise of the high frequency clock VCLK, which is indicated by B in FIG. 6. Simultaneously, the comparator 22 resets the counter 21 and resumes counting from 0.

In this manner, as shown in FIG. 6, the pixel clock PCLK, whose phase is delayed for only ⅛ clock with respect to the ⅛ frequency of the high frequency clock VCLK, is generated.

Next, a description will be given of FIG. 7. Here, the value "6" is given as the phase shift data. The counter 21 counts the high frequency clocks VCLK.

The comparator 22 outputs the control signal "a" when the value of the counter 21 becomes "3". Since the control signal "a" becomes "H", the pixel clock control circuit 23 makes a transition of the pixel clock PCLK from "H" to "L" at the rise of the high frequency clock VCLK; which is indicated by A in FIG. 7.

Next, the comparator 22 outputs the control signal "b" when the value of the counter 21 matches the given phase shift data value ("6", in this case). Since the control signal "b" becomes "H", the pixel clock control circuit 23 makes a transition of the pixel clock PCLK from "L" to "H" at the rise of the high frequency clock VCLK, which is indicated by B in FIG. 7. Simultaneously, the comparator 22 resets the counter 21 and resumes counting from 0.

In this manner, as shown in FIG. 7, the pixel clock PCLK, whose phase is advanced for only ⅛ clock with respect to the ⅛ frequency of the high frequency clock VCLK, is generated.

Figure 8:
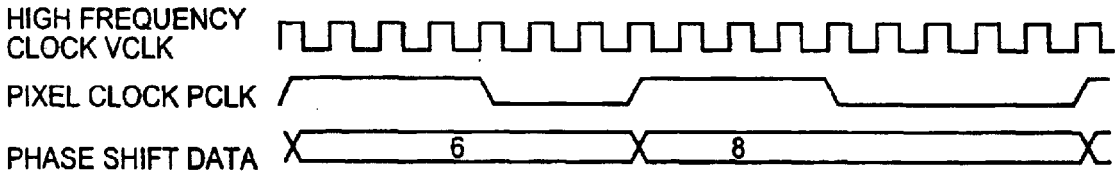
FIG. 8 is a timing chart showing the relationships among a high frequency clock, a pixel clock, and phase shift data.

FIG. 8 shows the timing relationships among the high frequency clock VCLK, the phase shift data, and the pixel clock PCLK.

Figure 9:
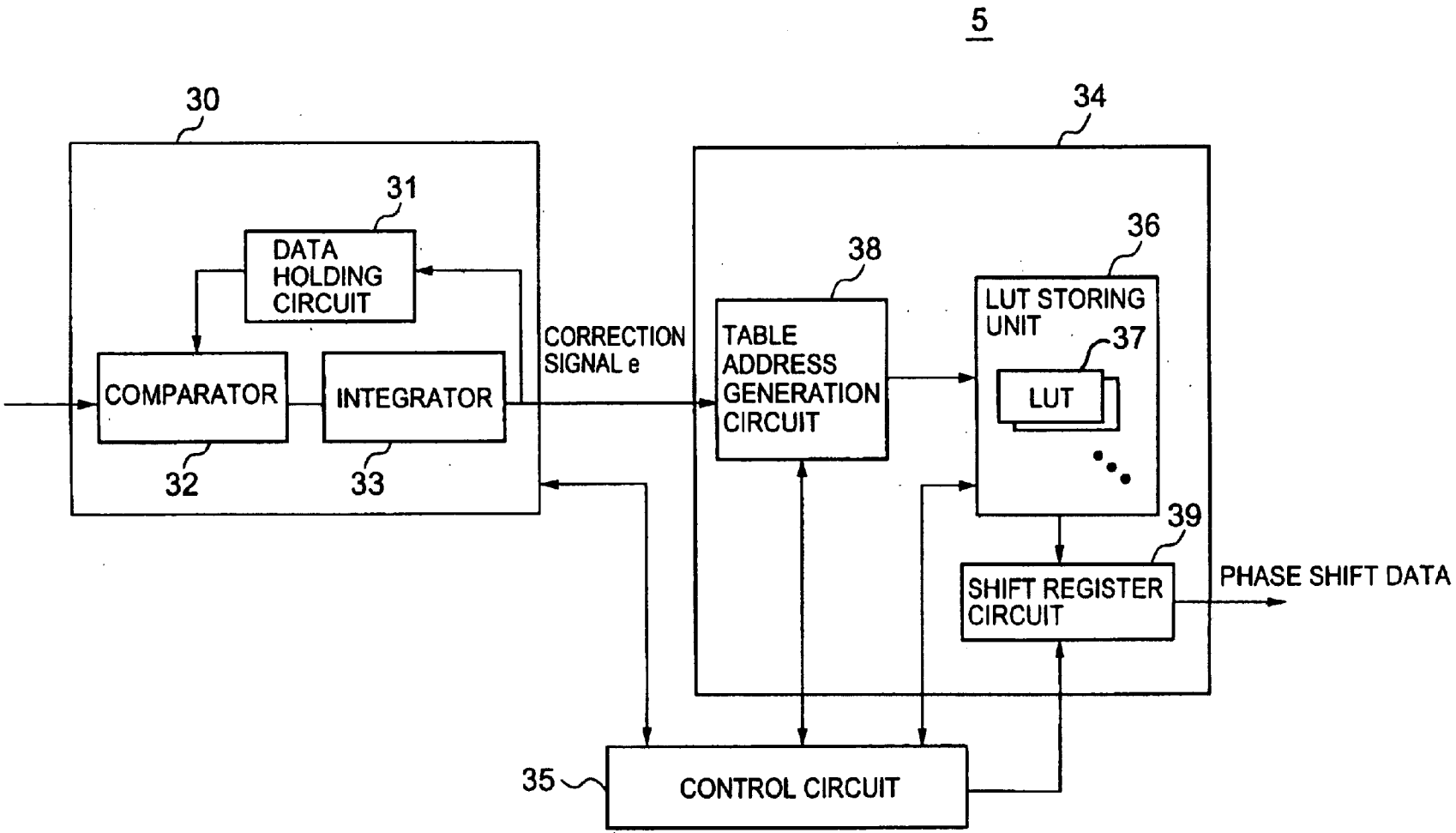
FIG. 9 is a block diagram of a phase shift data generation unit.

FIG. 9 shows an example of the internal configuration of the phase shift data generation unit 5. In FIG. 9, the phase shift data generation unit 5 includes a correction circuit 30, a data generation circuit 34, and a control circuit 35.

In the present invention, as is described further below, there are cases where a comparison result of the comparison unit 4 at each scan line during a recording term of each page in the image forming apparatus is used, and where a comparison result of the comparison unit 4 at a single scan line or several scan lines during a blank term between pages is used.

The correction circuit 30 is means for generating a correction signal "e" that is obtained by averaging the comparison result of the comparison unit 4 of this time and that of the previous time. More specifically, the correction circuit 30 includes a data holding circuit 31, a comparator 32, and an integrator 33. The comparator 32 compares the comparison result of the comparison unit 4 with the correction signal "e" held in the data holding circuit 31, and outputs a deviation signal. The integrator 33 outputs the correction signal "e" that is obtained by integration with the deviation signal. The integrated correction signal "e" is held in the data holding circuit 31, and is compared with the comparison result of the next time by the comparator 32. With such a configuration of the correction circuit 30, it becomes possible to stably generate phase shift data that correspond to changes over time and temperature variation in a scanning system of the image forming apparatus.

The data generation circuit 34 includes: a LUT storing unit 36 for storing one or more lookup tables (LUT) 37 storing phase shift data patterns; a table address generation circuit 38 generating an address for reading out the phase shift data pattern that is stored in any of the LUTs 37; and a shift register circuit 39 for outputting phase shift data in turn in synchronization with the pixel clock PCLK.

The control circuit 35 performs selection of the LUT 37 to be read, and controls the operation of the table address generation circuit 38, the shift register circuit 39 and the correction circuit 30. The control circuit 35 receives the pixel clock PCLK and the horizontal synchronization signal that are necessary for the operation, though the illustration thereof is omitted. In addition, it is also possible to omit the shift register circuit 39 or replace the shift register circuit 39 by a simple latch circuit, depending on the data structure of the LUTs 37 stored in the LUT storing unit 36.

Incidentally, as mentioned above, the following reasons can be cited for generation of a main scan dot position shift in the image forming apparatus.

(1) The fθ characteristic of the scan lens is not sufficiently corrected.

(2) Process accuracy and mounting accuracy of optical components of the light scanning optical system are degraded.

(3) The fθ characteristic is degraded by variation in the focal distance in the scanning optical system, which is caused by deformation of optical components and variation in refraction factors due to environmental change in the apparatus, such as change in temperature and humidity.

Especially, it is impossible to avoid a main scan dot position shift due to environmental change even if optical tuning and electrical correction are conducted at the time of shipping of the apparatus. For example, even if there is no problem at the first printing, a problem can occur in that the hue of the first printing is different from that after a plurality of sheets of printing since the temperature in the apparatus is increased when printing out is performed successively.

Consequently, in the present invention, characteristic values of the relationship between dot position shifts of actual image heights with respect to ideal image heights in a scanning optical system are determined in advance by preliminary examination, simulation, or the like. A lookup table is created based on the characteristic values. The present invention intends to correct main scan dot position shift with a high degree of accuracy by reading, from the lookup table, phase shift data that correspond to time variation between horizontal synchronization signals, and controlling the phase of a pixel clock in accordance with the phase shift data. In addition, the present invention intends to make it possible to correct a main scan dot position shift with a high degree of accuracy through easily and flexibly responding to a difference in characteristics of a scanning optical system of an image forming apparatus by only changing the lookup table.

Figure 10:
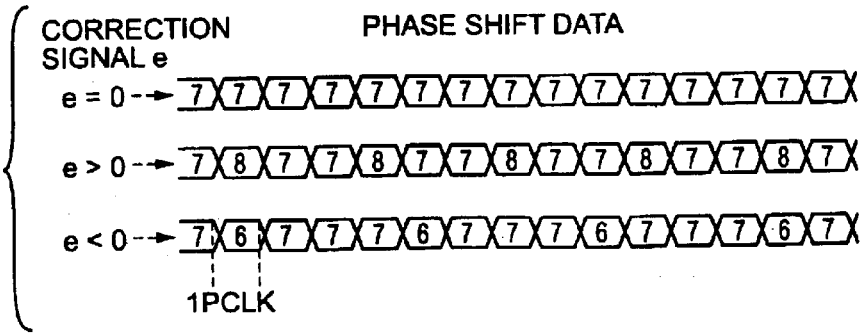
FIG. 10 is a schematic diagram showing examples of phase shift data patterns.

Next, referring to FIG. 10, a description will be given of examples of the phase shift data patterns generated by the data generation circuit 34. Here, it is assumed that the frequency of the pixel clock PCLK is ⅛ of that of the high frequency clock VCLK. When the value of the correction signal "e" supplied to the data generation circuit 34 is "0", phase shift data of "7" are generated in the intervals of all pixel clocks PCLK of one line. When the value of the correction signal "e" is positive, phase shift data of "8" are generated in each of "e" pixel clock PCLK intervals that are spaced substantially equally in one line, and phase shift data of "7" are generated in the other pixel clock PCLK intervals. When the value of the correction signal "e" is negative, phase shift data of "6" are generated in each of "e" pixel clock PCLK intervals that are spaced substantially equally in one line, and phase shift data of "7" are generated in the other pixel clock PCLK intervals. In the LUT 37, the patterns of phase shift data as shown in the above-described examples are stored in addresses that are associated with the values of the correction signal "e".

In a case where the scanning optical system of the image forming apparatus, using the pixel clock generation apparatus, possesses an ideal linearity characteristic, if phase control of the pixel clock PCLK is performed in accordance with the phase shift data, pixel clocks whose phase are shifted are dispersed substantially equally. Hence, it is possible to correct variation in the scan width of each line while reducing the influence on an image.

However, since an actual linearity characteristic of the scanning optical system is different from the ideal characteristic, as described further below, there is provided a LUT 37 of phase shift data patterns prepared in consideration of the linearity characteristic of the scanning optical system. Additionally, in a case where a polygon mirror having a plurality of reflection surfaces is used as the deflector, in order to correct variation in each of the reflection surfaces with a high degree of accuracy, a LUT 37 of phase data patterns is provided for each of the respective reflection surfaces, and the LUT 37 to be used is selected in accordance with switching of the reflection surfaces.

In the pixel clock generation apparatus of the present invention, various modes may be utilized regarding phase shift control of the pixel clock PCLK. A detailed description thereof will be given later.

A description will now be given of various embodiments of the pixel clock generation apparatus of the present invention and the image forming apparatus of the present invention using the same.

(Embodiment 1)

Figure 11:
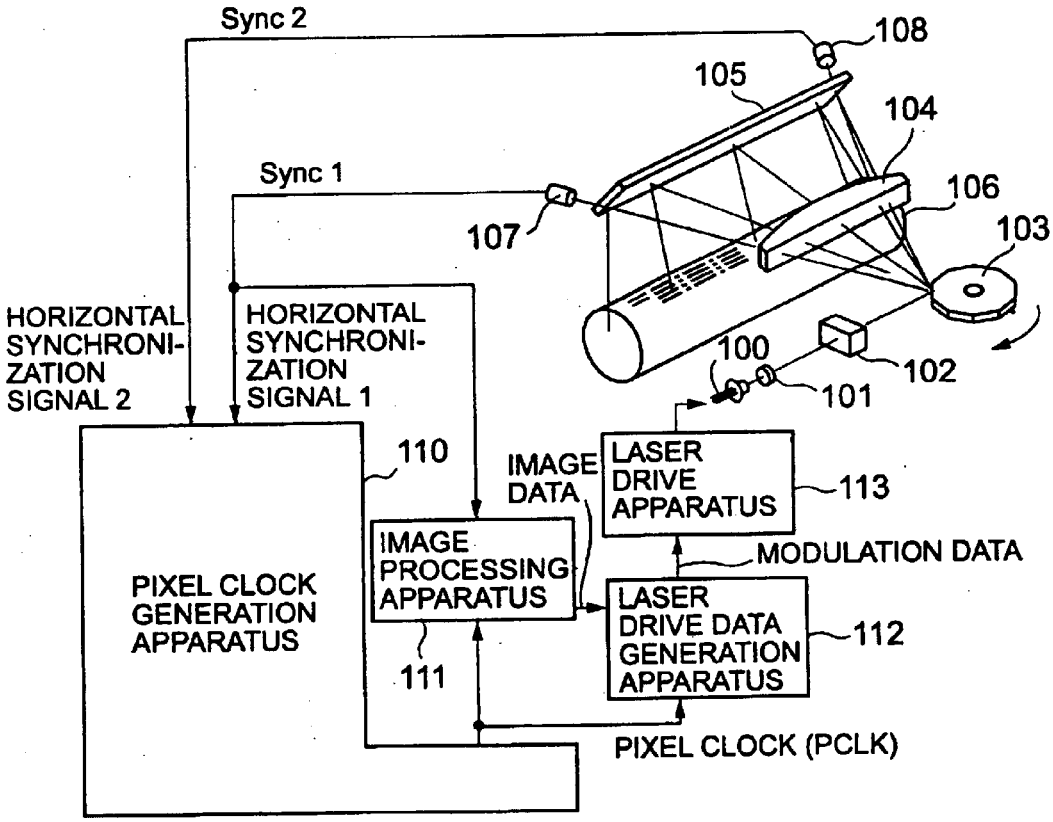
FIG. 11 is a schematic diagram of an image forming apparatus according to Embodiment 1 of the present invention.

FIG. 11 is a schematic diagram of an image forming apparatus according to Embodiment 1 of the present invention. The image forming apparatus applies an electrophotography method. A laser light beam output from a semiconductor laser 100 is incident on a polygon mirror 103 as the deflector via a collimator lens 101 and a cylinder lens 102. The laser light beam deflected by the polygon mirror 103 passes through a fθ lens 104, which is a scan lens, and is reflected (partially transmitted) by a half mirror 105. Then, the laser light beam forms a light beam spot on the surface (surface to be scanned) of a photoconductor 106, which is a medium to be scanned, and forms an image (electrostatic latent image).

A photodetector (optical detection means) A 107 and a photodetector B 108 for generating the horizontal synchronization signals 1 and 2, respectively, are arranged at opposing ends of a surface to be detected. The surface to be detected possesses temporal correlation with the surface to be scanned and is scanned by the laser light beam that is transmitted through the half mirror 105.

In other words, horizontal synchronization detection means in this embodiment is configured such that a part of the laser light beam deflected by the polygon mirror 103 is separated by the half mirror 105, and the laser light beams thus separated are received by the photodetectors 107 and 108 that are arranged at the positions corresponding to two specific horizontal scan positions.

In addition, the image forming apparatus according to this embodiment further includes means commonly used in image forming apparatuses of this kind. For example, charging means for charging the surface of the photoconductor 106, developing means for developing an electrostatic latent image to a toner image, transfer means for transferring the developed toner image onto a paper or an intermediate transfer medium, and cleaning means for eliminating and collecting residual toner on the photoconductor 106. However, illustration of these means is omitted for avoiding complication.

The image forming apparatus shown in FIG. 11 further includes a pixel clock generation apparatus 110 according to the present invention as mentioned above, an image processing apparatus 111, a laser drive data generation apparatus 112, and a laser driving apparatus 113. Detection signals of the photodetectors A 107 and B 108 are input to the pixel clock generation apparatus 110 as the horizontal synchronization signals 1 and 2 (sync 1 and sync 2). In addition, the horizontal synchronization signal 1 is also input to the image processing apparatus 111 as a line synchronization signal. Further, instead of directly using the detection signals of the respective photodetectors as the horizontal synchronization signals, the inversion signals thereof may be used as the horizontal synchronization signals (refer to FIG. 12).

The pixel clock PCLK generated by the pixel clock generation apparatus 110 is input to the image processing apparatus 111 and the laser drive data generation apparatus 112. The image processing apparatus 111 generates image data of each line in synchronization with the line synchronization signal (horizontal synchronization signal 1), and outputs it in timing with the pixel clock PCLK. The laser drive data generation apparatus 112 outputs laser drive data (modulation data) corresponding to the image data in timing with the pixel clock PCLK. The laser driving apparatus 113 drives (modulates) the semiconductor laser 100 in accordance with the laser drive data.

Figure 12:
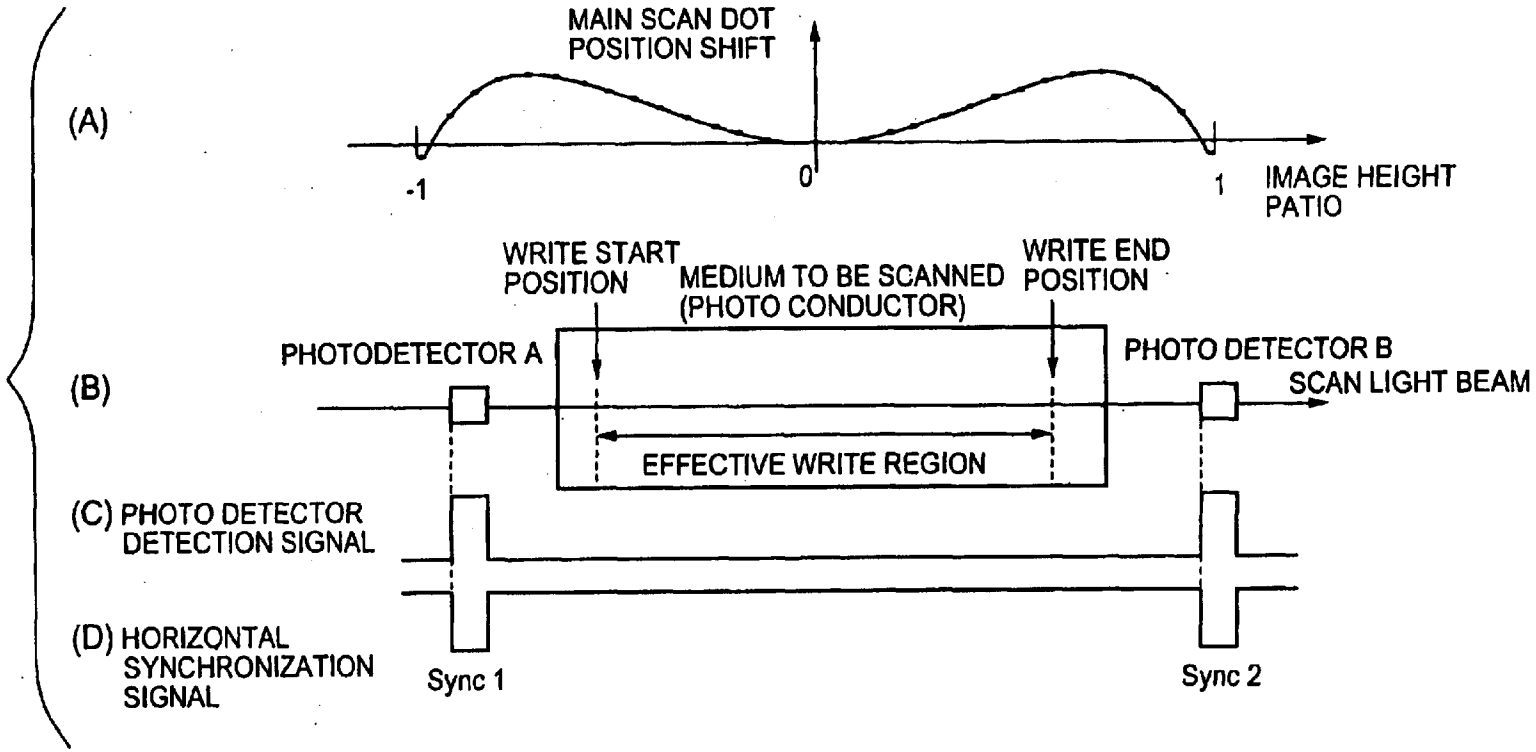
FIG. 12 is a data diagram for explaining main scan dot position and correction thereof.

FIG. 12 is a schematic diagram for explanation. FIG. 12-(A) represents the linearity characteristic of the scanning optical system. In FIG. 12-(A), the vertical axis represents the dot position shift in the main scan direction, and the horizontal axis represents the image height ratio. FIG. 12-(B) represents the relationship between an effective write region and the photodetectors A and B. FIG. 12-(C) represents the detection signals of the photodetectors A and B as one signal. FIG. 12-(D) represents horizontal synchronization signals 1 and 2 (sync 1 and sync 2). However, here, the signals are represented as one signal obtained by inverting the detection signals of the photodetectors A and B.

If the rotational speed of the polygon mirror 103 is varied by temperature change, changes over time, variation in power supply voltage, and the like, the time interval between the horizontal synchronization signals 1 and 2 is varied. In the pixel clock generation apparatus 110 of the present invention, a LUT 37 that records time intervals between the horizontal synchronization signals 1 and 2, and phase shift data patterns corresponding to shift amounts with respect to target values is recorded in the LUT storing unit 36 of the phase shift data generation unit 5 (refer to FIG. 9). Hence, the phase of the pixel clock PCLK is suitably controlled even if the time interval between the horizontal synchronization signals 1 and 2 is varied. Accordingly, the scan width and the dot position shift in the main scan direction are corrected with a high degree of accuracy. In addition, when it is necessary to provide a phase shift data pattern for each of the reflection surfaces, due to variation in process accuracy of the reflection surfaces of the polygon mirror, by storing LUTs 37 corresponding to the respective reflection surfaces in the LUT storing unit 36 and switching the LUT 37 to be used in accordance with switching of the reflection surfaces, the scan width and the dot position shift in the main scan direction are corrected with a high degree of accuracy in lines scanned by any of the reflection surfaces.

There is a case where variation in the scan speed due to rise in temperature or the like is not negligible during recording of one page. It is obvious that such variation within one page can be corrected with a high degree of accuracy by operating the detector 3 and comparator 4 of the pixel clock generation apparatus for every line.

Figure 13A:
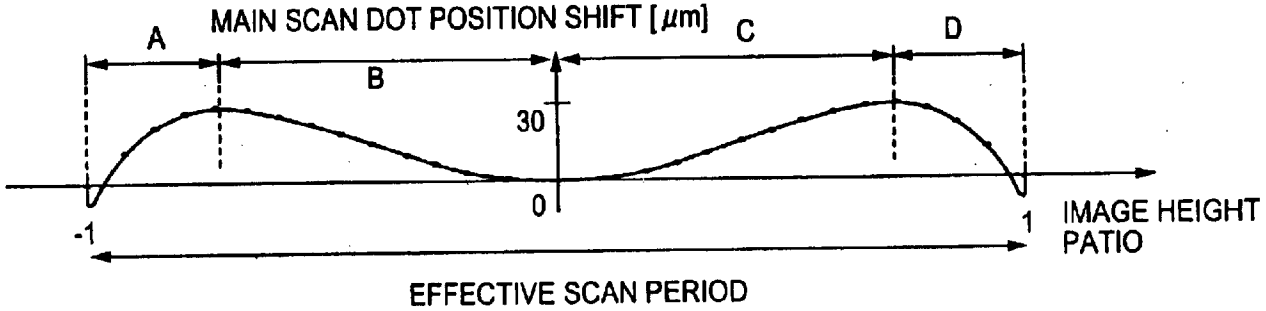
FIGS. 13A and 13B are schematic diagrams for explaining the linearity characteristic of a scanning optical system in relationship to phase shift data patterns.
Figure 13B:
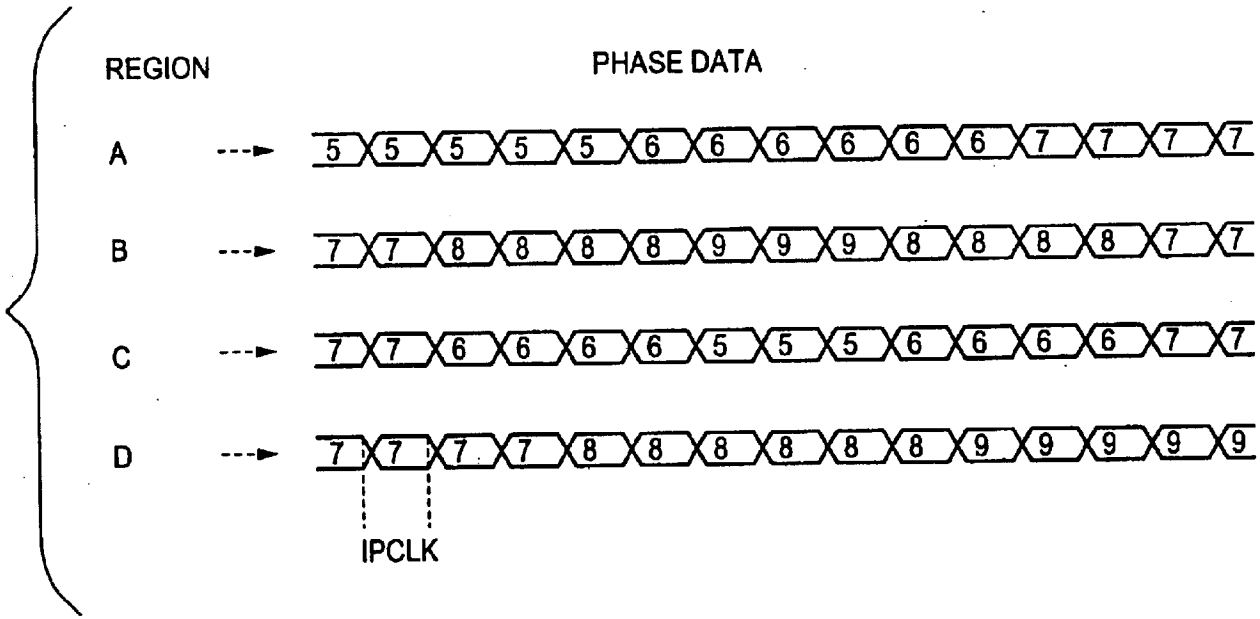

Referring to FIGS. 13A and 13B, a description will be given of the linearity characteristic and the phase shift data pattern. FIG. 13A shows an example of the linearity characteristic of the scanning optical system. FIG. 13B shows examples of the phase shift data patterns corresponding to respective regions A, B, C and D of the linearity characteristic.

In a region where the inclination of the linearity curve is positive, such as the region A and the region C, the interval between dots in the main scan direction becomes wider than that in the ideal case. Thus, phase shift data of "5" and "6"

are supplied to advance the phase of the pixel clock PCLK. The phase shift data of "5" are supplied to a part where the inclination of the linearity curve is great. In a region where the inclination of the linearity curve is negative, such as the region B and the region D, the interval between dots becomes narrower than that in the ideal case. Thus, phase shift data of "9" and "8" are supplied to delay the phase of the pixel clock PCLK. The phase shift data of "9" is supplied to a part where the inclination of the linearity curve is great. Further, in a part where the inclination of the linearity curve is 0, there is no variation in the dot interval. Hence, "7" is supplied as phase shift data.

By providing in advance such a LUT 37 for generating the phase shift data that correspond to the linearity characteristic, the phase shift amount of the pixel clock PCLK in the entire one line is made to be equal to the value of the correction signal "e" that is supplied to the data generation circuit 34 shown in FIG. 9. In other words, when the correction signal "e" is 0, the phase shift data are generated such that the total value of the phase shift data for one line becomes equal to "7×Np" where Np represents the number of pixels in one line. In addition, when the value of the correction signal "e" is positive, the phase shift data are generated such that the total value of the phase shift data in one line becomes equal to "7×Np+e". Further, when the value of the correction signal "e" is negative, the phase shift data are generated such that the total value of the phase shift data in one line becomes equal to "7×Np−|e|". In this manner, it is possible to make the interval between pixels uniform by making the scan width of each line identical and correcting the main scan dot position shift caused by the linearity characteristic of the scanning optical system.

Figure 14:
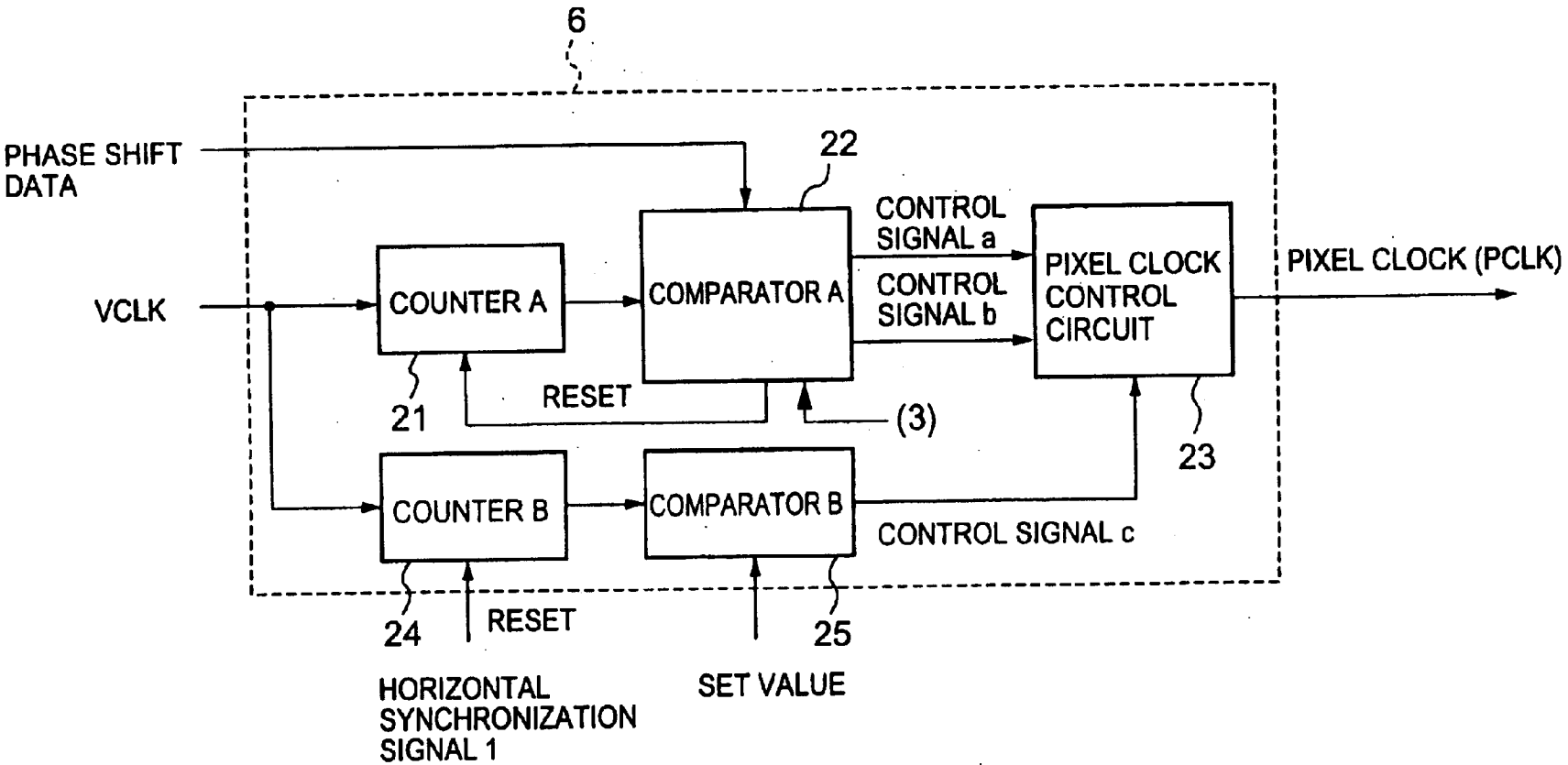
FIG. 14 is a block diagram of a pixel clock generation unit.

Additionally, in order to precisely align the image write start positions of respective lines, as shown in FIG. 14, it is preferable that a counter B 24 and a comparator B 25 be added to the pixel clock generation unit 6. The counter B 24 is operated at the rise of the high frequency clock VCLK and counts the clock. The counter B 24 is reset and resumes counting when the horizontal synchronization signal 1 is input thereto. The comparator B 25 compares the value of the counter B 24 with a set value, and makes a control signal "c" effective when the count value becomes equal to or greater than the set value. The pixel clock control circuit 23 controls write timing of the pixel clock PCLK in accordance with the control signal "c". Accordingly, it is possible to align the image write start positions of the respective lines by determining the set value for the comparator B 25 in accordance with the temporal interval between the horizontal synchronization signal 1 and the image write start position.

Figure 15:
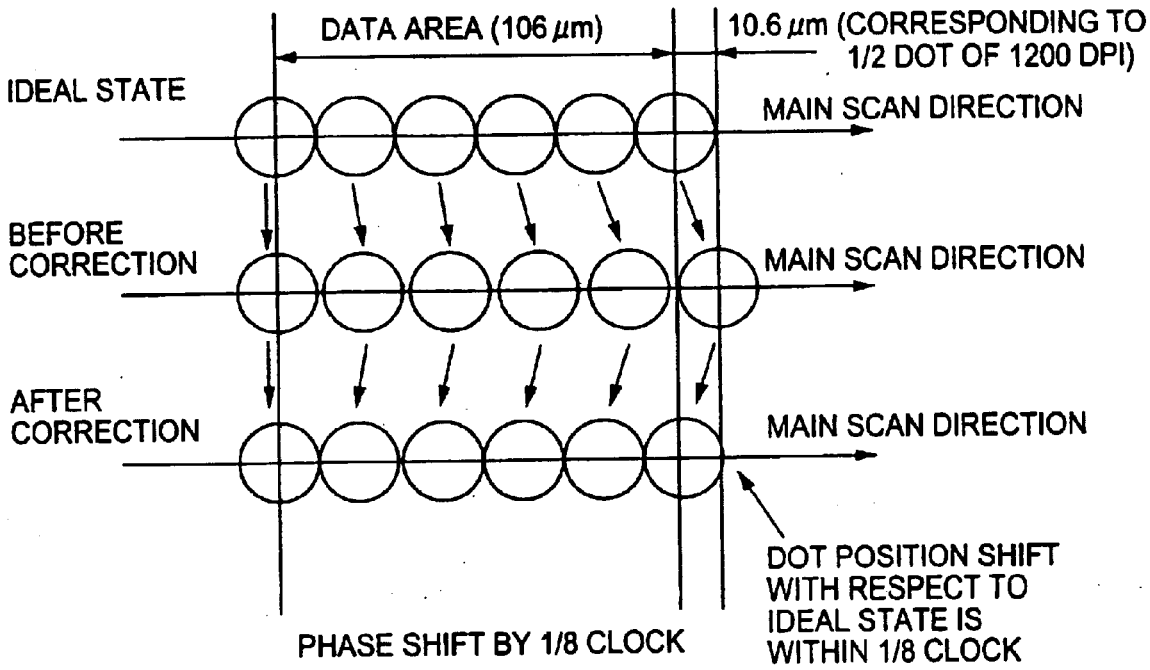
FIG. 15 is a schematic diagram for explaining correction of main scan dot position shift by performing phase shift of the pixel clock.

Referring to FIG. 15, a detailed description will be given of correction of the main scan dot position by phase shift of the pixel clock PCLK.

"Ideal state" in FIG. 15 shows dot positions in the ideal state where variation in the scan speed and exposure shift are not generated at all. Here, 1200 dpi and a dot diameter of approximately 21.2 μm are represented.

"Before correction" in FIG. 15 is a state where the position of the first dot matches, but a dot position shift occurs due to variation in the scan speed and exposure shift. In the sixth dot, a position shift of 10.6 μm, which corresponds to a ½ dot of 1200 dpi, occurs with respect to the ideal state. The time required for writing one dot in this state corresponds to one pixel clock=1 PCLK. Thus, when the resolution of the phase shift of the pixel clock PCLK is ⅛ PCLK, it is the same thing as stating that the dot position can be corrected to the accuracy of ⅛ dot.

"After correction" in FIG. 15 shows dot positions in the case where, when the resolution of the phase shift is a ⅛ dot, i.e., ⅛ PCLK, phase shift of −⅛ PCLK is performed four times within the data region from the state of "before correction" in which the dot position shift of a ½ dot occurs from the ideal state. In theory, the dot position of the sixth dot can be shifted for −⅛ PCLK×4=−½ PCLK, and it is possible to correct the dot position with the accuracy of ⅛ PCLK.

In this manner, in the pixel clock generation apparatus, it is possible to shift the phase of the pixel clock PCLK by a fraction of one dot for each pulse and to shift the main scan position of each pixel in the units of ± "a fraction of one dot". Therefore, in principle, in the case of ±⅛ dot shift, it is possible to adjust the correction amount of linearity from 0% to 12.5%. Also, in the case of 1200 dpi writing, the main scan position shift within the effective write region is reduced to 2.6 μm (21.2 μm/8).

The frequency of the high frequency clock VCLK required for realizing such correction of the main scan dot position shift with a high degree of accuracy may be eight times the fundamental frequency of the pixel clock PCLK. If a high frequency clock having such a frequency is used, it is not so difficult to realize the pixel clock generation apparatus. This is also one of the effects of the present invention.

(Embodiment 2)

Figure 16:
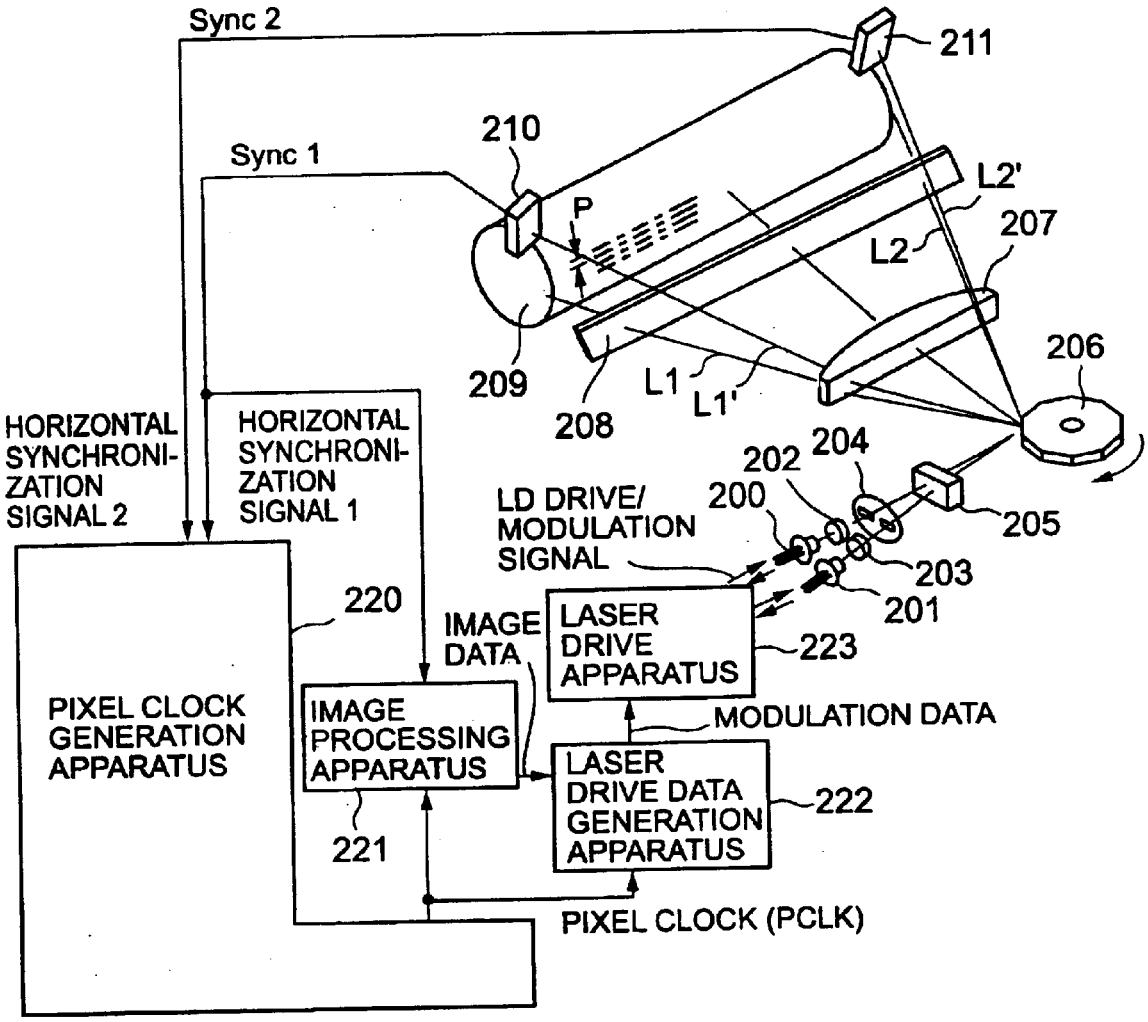
FIG. 16 is a schematic diagram of an image forming apparatus according to Embodiment 2 of the present invention.

FIG. 16 is a schematic diagram of an image forming apparatus according to Embodiment 2 of the present invention. The image forming apparatus further includes a semiconductor laser 201 as a light beam source for reference for horizontal synchronization detection, in addition to the semiconductor laser 200 as the light beam source for image writing.

A laser light beam output from the semiconductor laser 200 for image writing is incident on a polygon mirror 206 via a collimator lens 202, a slit of an aperture 204, and a cylinder lens 205. The laser light beam deflected by the polygon mirror 206 forms a light beam spot on the surface (surface to be scanned) of a photoconductor 209 via a fθ lens 207 and a transparent member 208, and forms an electrostatic latent image.

The laser light beam output from the semiconductor laser 201 as the light beam source for reference is incident on the polygon mirror 206 via a collimator lens 203, a slit of the aperture 204, and the cylinder lens 205. The laser light beam of the semiconductor laser 201 for reference and the laser light beam of the semiconductor laser 200 for image writing are incident on an identical reflection surface. The laser light beam for reference and the laser light beam for image writing are incident on an identical position with respect to the main scan direction. With respect to the sub-scan direction, however, the light beams are incident on positions with a certain interval. As a result, the laser light beam for reference that is deflected by the polygon mirror 206 passes through the f θ lens 207 and the transparent member 208, but is not incident on the photoconductor 209. Accordingly, it is possible to make the semiconductor laser 201, serving as the light beam source for reference, emit light independently from image data.

Surfaces to be detected, which are separated from the photoconductor 209 and are at the positions equivalent to the surface to be scanned of the photoconductor 209 that is scanned by the laser light beam for image writing, are scanned by the laser light beam for reference. The horizontal synchronization signals 1 and 2 (sync 1 and sync 2) are obtained by detecting the laser light beam for reference by photodetectors 210 and 211 that are arranged above the surfaces to be detected.

In other words, the horizontal synchronization detection means in this embodiment are configured such that the laser light beam for reference deflected by the polygon mirror 206 is received by the photodetectors 210 and 211 that are arranged at the positions corresponding to two specific horizontal scan positions.

The positional relationships are determined such that light path lengths L1' and L2' to the photodetectors 210 and 211, respectively, of the laser light beam that is output from the semiconductor laser 201 for reference and light path lengths L1 and L2 to the respective corresponding positions on the photoconductor 209 of the output laser light beam of the semiconductor laser 200 become substantially identical. Accordingly, it is possible to obtain the horizontal synchronization signals without influence of difference in the light path lengths.

The image forming apparatus shown in FIG. 16 further includes a pixel clock generation apparatus 220 according to present invention, an image processing apparatus 221, a laser drive data generation apparatus 222, and a laser drive apparatus 223. These apparatuses are the same as those corresponding apparatuses in Embodiment 1 (refer to FIG. 11). It should be noted that the laser drive apparatus 223 drives the semiconductor laser 200 for image writing based on image data, and further drives the semiconductor laser 201 for reference for horizontal synchronization detection.

With the image forming apparatus of this embodiment, it is possible to perform real-time control that measures a time interval between the horizontal synchronization signals at each line within each page to be recorded, and reflects a shift from a target value thereof on the phase control of the pixel clock PCLK. According to such control, even if the influence of temperature rise or the like within the page is not negligible, it is possible to correct the scan width and dot position shift of each line in the page with a high degree of accuracy.

In addition, similar real-time control can also be performed in Embodiment 1. However, in order to perform such control, it is necessary to provide a sufficient distance between the horizontal synchronization detection positions and image write start/end positions. In this embodiment, the distance can be reduced. The linearity of the scanning optical system is increasingly degraded as the distance from the effective write region of an image is increased. Hence, generally, it is advantageous for improving the accuracy of phase control of the pixel clock PCLK that the horizontal synchronization detection positions and the image write start/end positions can be made close to each other.

Further, the image forming apparatus according to this embodiment further includes means commonly used in image forming apparatuses of this kind. For example, charging means for charging the surface of the photoconductor 209, developing means for developing an electrostatic latent image to a toner image, transfer means for transferring the developed toner image onto a paper or an intermediate transfer medium, and cleaning means for eliminating and collecting residual toner on the photoconductor 209. However, illustration of these means is omitted.

(Embodiment 3)

Figure 17:
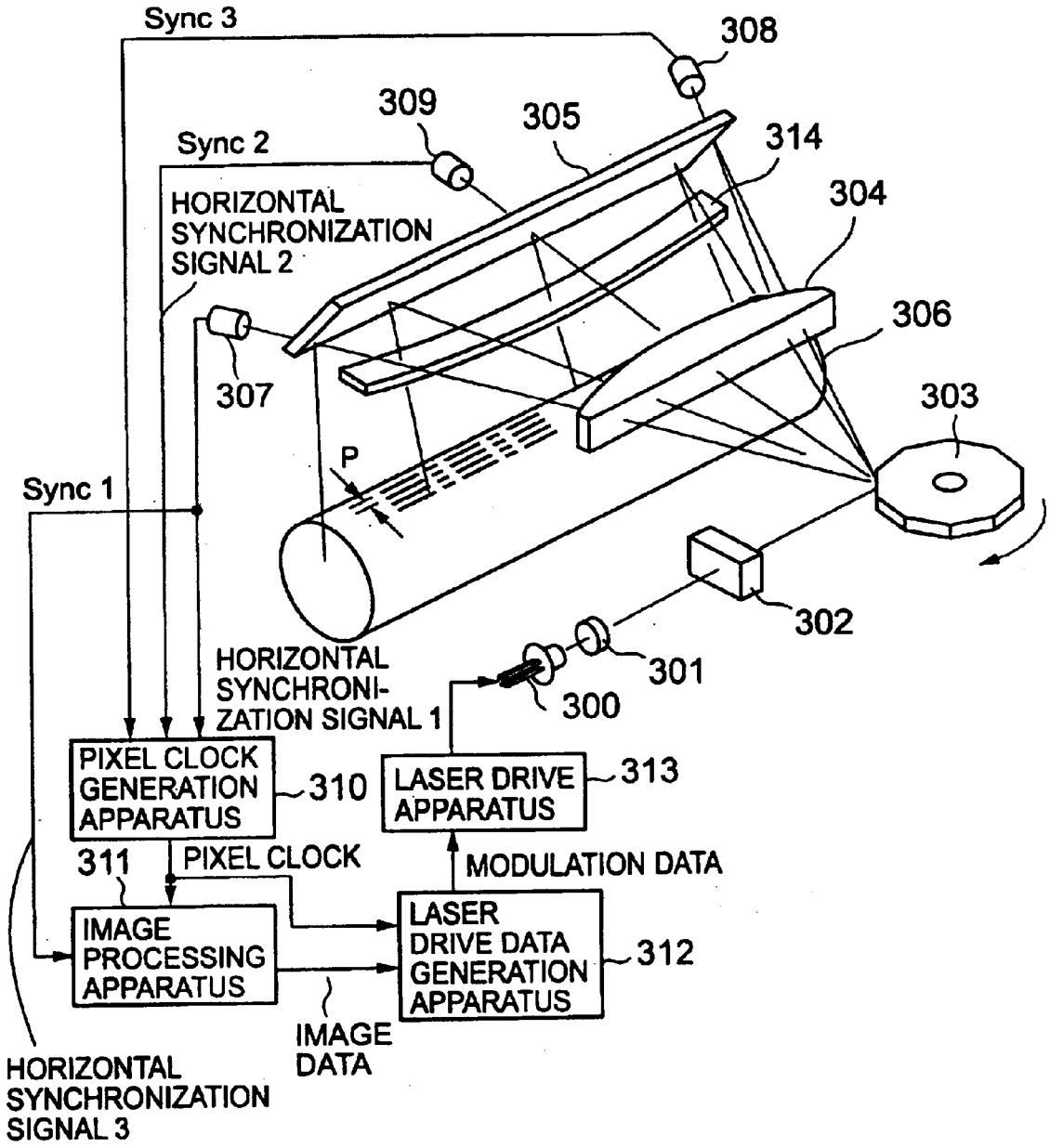
FIG. 17 is a schematic diagram of an image forming apparatus according to Embodiment 3 of the present invention.

FIG. 17 is a schematic diagram of an image forming apparatus according to Embodiment 3 of the present invention. In the image forming apparatus, a laser light beam output from a semiconductor laser 300 is incident on a polygon mirror 303 via a collimator lens 301 and a cylinder lens 302. The laser light beam deflected by the polygon mirror 303 passes through a fθ lens 304, is reflected by (partially transmitted through) a half mirror 305, forms a light beam spot on the surface (surface to be scanned) of a photoconductor 306, which is a medium to be scanned, via a toroidal lens 314, and forms an image (electrostatic latent image).

Photodetectors A 307, B 308, and C 309 for horizontal synchronization detection are arranged at the opposing ends and center of a surface to be detected, which is scanned by the laser light beam transmitted through the half mirror 5. That is, the horizontal synchronization detection means of this embodiment are configured such that the laser light beams separated by the half mirror 305 are received by the three photodetectors 307, 308, and 309 that are arranged at the positions corresponding to three specific horizontal scan positions.

The image forming apparatus shown in FIG. 17 further includes a pixel clock generation apparatus 310 according to the present invention, an image processing apparatus 311, a laser drive data generation apparatus 312, and a laser drive apparatus 313. These apparatuses are the same as those corresponding apparatuses in Embodiment 1. The operation of the pixel clock generation apparatus 310 is partially different from the operation of the pixel clock generation apparatus 110 in Embodiment 1. However, a description thereof will be given later.

Detection signals of the photodetectors A 307, C 309 and B 308 are input to the pixel clock generation apparatus 310 as horizontal synchronization signals 1, 2, and 3 (sync 1, sync 2, and sync 3), respectively. The horizontal synchronization signal 1 is input also to the image processing apparatus 311 as a line synchronization signal. In addition, instead of directly using the detection signals of the respective photodetectors as the horizontal synchronization signals, the inversion signals thereof may be used as the horizontal synchronization signals.

Further, the image forming apparatus according to this embodiment further includes means commonly used in image forming apparatuses of this kind. For example, charging means for charging the surface of the photoconductor 306, developing means for developing an electrostatic latent image to a toner image, transfer means for transferring the developed toner image onto a paper or an intermediate transfer medium, and cleaning means for eliminating and collecting residual toner on the photoconductor 306. However, illustration of these means is omitted.

Figure 18:
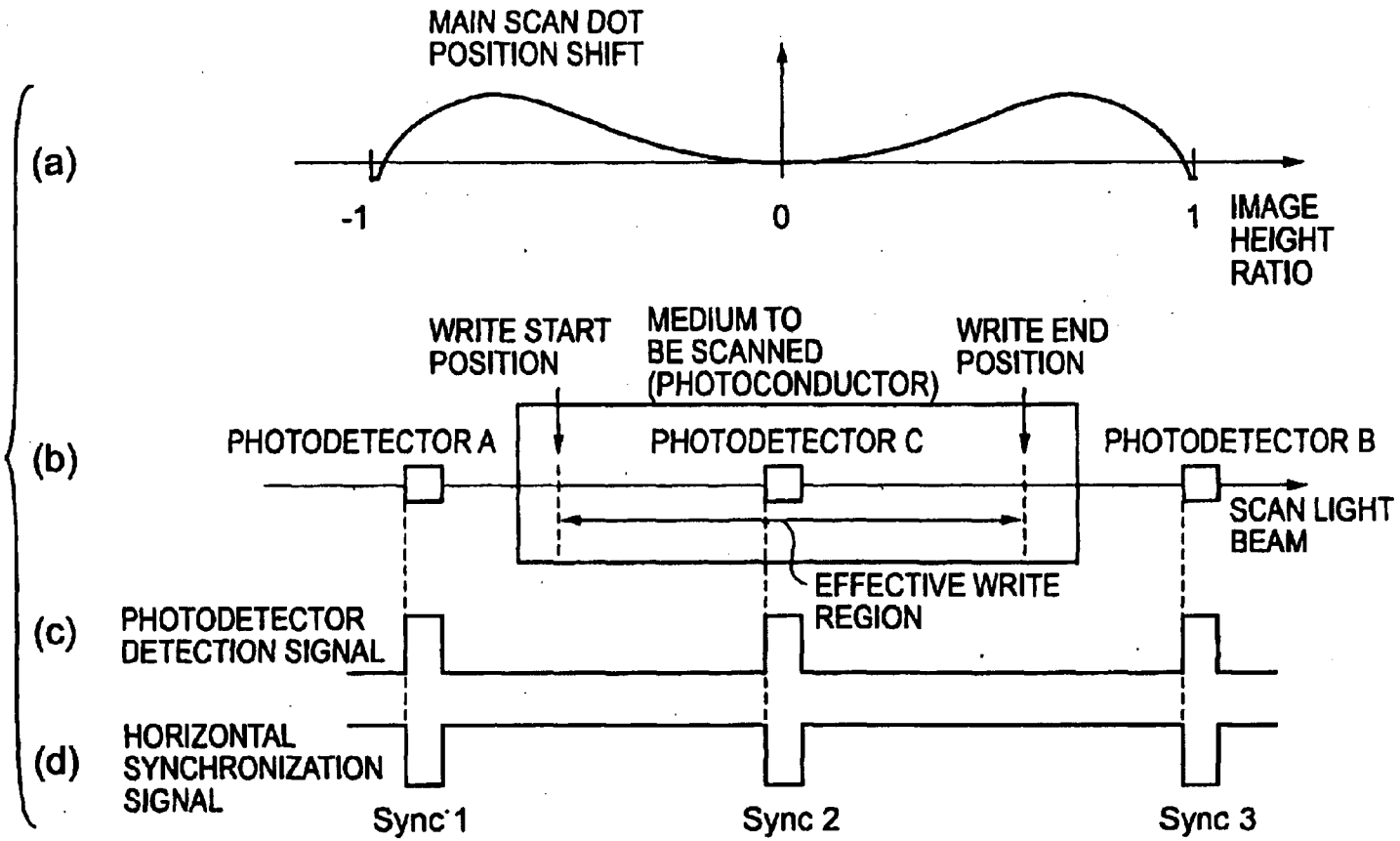
FIG. 18 is a schematic diagram for explaining main scan dot position shift and correction thereof.

FIG. 18 is a schematic diagram for explanation. FIG. 18-(A) shows the linearity characteristic of the scanning optical system. In FIG. 18-(A), the vertical axis represents the dot position shift in the main scan direction, and the horizontal axis represents the image height ratio. FIG. 18-(B) shows the relationship among the effective write region and the photodetectors 1, 2 and 3. FIG. 18-(C) shows the detection signals of the photodetectors A, B and C as one signal. FIG. 18-(D) shows the horizontal synchronization signals 1, 2 and 3 (sync 1, sync 2 and sync 3) as one signal obtained by inverting the detection signals of the photodetectors A, B and C.

The detector 3 (refer to FIG. 3) of the pixel clock generation apparatus 310 detects the time interval between the horizontal synchronization signals 1 and 2 and that between the horizontal synchronization signals 2 and 3, and outputs the two time intervals (high frequency clock count values). The comparison unit 4 (refer to FIG. 3) of the pixel clock generation apparatus compares each of the time intervals with a predetermined target value, and outputs the difference between them. Such measurement of the time interval between the horizontal synchronization signals and detection of the difference with respect to the target value are conducted in a period in which the image forming apparatus does not perform image recording. For example, in a blank part between pages. The reason for this is, as is obvious from FIG. 18, that the laser light beam that is incident on the photodetector C is modulated by image data during an image recording period, and the accuracy of the timing of the detection signal is not guaranteed. The horizontal synchronization signals 1 and 3 are generated also in the image recording term.

In the phase shift data generation unit 5 (refer to FIG. 9) of the pixel clock generation apparatus 310, the correction circuit 30 generates two correction signals e1 and e2. The correction signal e1 corresponds to the time difference between the horizontal synchronization signals 1 and 2. The correction signal e2 corresponds to the time difference between the horizontal synchronization signals 2 and 3. The LUT storing unit 36 of the data generation circuit 34 stores a LUT 37 of phase shift data patterns applied to the interval between the horizontal synchronization signals 1 and 2 (the first half of a line) and a LUT 37 of phase shift data patterns applied to the interval between the horizontal synchronization signals 2 and 3 (the latter half of the line). In the first half of each line, the control circuit 35 causes the table address generation circuit 38 to generate a table address corresponding to the correction signal e1. Also, the control circuit 35 selects a LUT 37 to be applied to the first half of the line. The control circuit 35 counts the pixel clock PCLK by an internal counter from the time when the horizontal synchronization signal 1 is generated. Based on the count value, when the control circuit 35 determines that the scan dot position reaches the intermediate position (the position corresponding to the timing of the horizontal synchronization signal 2) of the effective write region, the control circuit 35 causes the table address generation circuit 38 to generate a table address corresponding to the correction signal e2. Also, the control circuit 35 selects a LUT 37 to be applied to the latter half of the line.

The linearity characteristic of the scanning optical system in the first half of the line and that in the latter half of the line are not necessarily symmetric. In addition, the same holds true to variation in the scan speed. Accordingly, as mentioned above, the difference between the scan time of the first half and that of the latter part is measured, and, based on the measurement, phase control of the pixel clock PCLK is performed in accordance with the phase shift data patterns corresponding to the first and latter halves of the line. Thereby, it is possible to correct the scan width and dot position with a high degree of accuracy.

(Embodiment 4)

Figure 19:
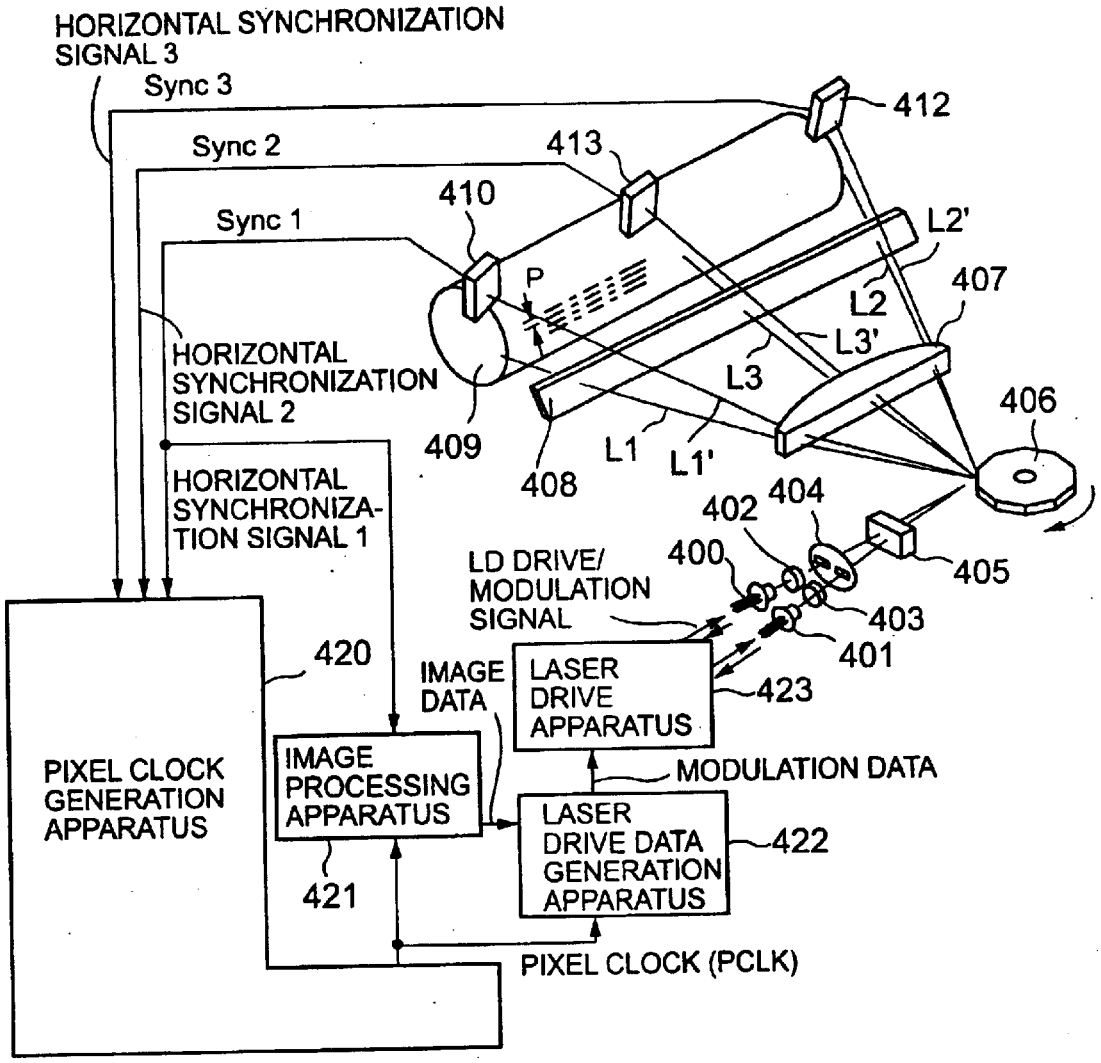
FIG. 19 is a schematic diagram of an image forming apparatus according to Embodiment 4 of the present invention.

FIG. 19 is a schematic diagram of an image forming apparatus according to Embodiment 4 of the present invention. The image forming apparatus includes a semiconductor laser 401 that serves as a light beam source for reference for horizontal synchronization detection, in addition to a semiconductor laser 400 that serves as a light beam source for image writing.

A laser light beam output from the semiconductor laser 400 for image writing is incident on a polygon mirror 406 via a collimator lens 402, a slit of an aperture 404, and a cylinder lens 405. The laser light beam deflected by the polygon mirror 406 forms a light beam spot on the surface (surface to be scanned) of a photoconductor 409 via a fθ lens 407 and a transparent member 408, and forms an electrostatic latent image.

The laser light beam output from the semiconductor laser 401 as the light beam source for reference is incident on the polygon mirror 406 via a collimator lens 403, a slit of the aperture 404, and the cylinder lens 405. The laser light beam of the semiconductor laser 401 for reference and the laser light beam of the semiconductor laser 400 for image writing are incident on the same reflection surface of the polygon mirror 406. The laser light beam for reference and the laser light beam for image writing are incident on an identical position with respect to the main scan direction. With respect to the sub-scan direction, however, the light beams are incident on positions with a certain interval. As a result, the laser light beam for reference that is deflected by the polygon mirror 406 passes through the fθ lens 407 and the transparent member 408, but is not incident on the photoconductor 409. Accordingly, it is possible to make the semiconductor laser 401, serving as the light beam source for reference, emit light independently from image data.

Surfaces to be detected, which are separated from the photoconductor 409 and are at the positions equivalent to the surface to be scanned of the photoconductor 409 that is scanned by the laser light beam for image writing, are scanned by the laser light beam for reference. The horizontal synchronization signals 1, 2 and 3 (sync 1, sync 2, and sync 3) are obtained by detecting the laser light beam for reference by photodetectors 410, 412 and 413 that are arranged above the surfaces to be detected. In other words, the horizontal synchronization detection means in this embodiment are configured such that the laser light beam for reference deflected by the polygon mirror 406 is received by the three photodetectors 410, 412 and 413 that are arranged at the positions corresponding to three specific horizontal scan positions.

The positional relationships are determined such that light path lengths L1', L2' and L3' to the photodetectors 410, 412 and 413, respectively, of the laser light beams that are output from the semiconductor laser 401 for reference and light path lengths L1, L2 and L3 to the respective corresponding positions on the photoconductor 409 of the output laser light beam of the semiconductor laser 400 for writing become substantially identical. Accordingly, it is possible to obtain the horizontal synchronization signals without influence of difference in the light path lengths.

The image forming apparatus shown in FIG. 19 further includes a pixel clock generation apparatus 420 according to present invention, an image processing apparatus 421, a laser drive data generation apparatus 422, and a laser drive apparatus 423. These apparatuses are the same as those corresponding apparatuses in Embodiment 3 (refer to FIG. 17). However, it should be noted that the laser drive apparatus 423 drives the semiconductor laser 400 for image writing based on image data, and further drives the semiconductor laser 401 for reference.

The pixel clock generation apparatus 420 can perform the operation identical to that of the pixel clock generation apparatus 310 in Embodiment 3. In this embodiment, however, it is possible to generate the three horizontal synchronization signals 1, 2 and 3 in each line in an image recording term. Hence, the pixel clock generation apparatus 420 can perform real-time control in which the time interval between the horizontal synchronization signals 1 and 2 and that between the horizontal synchronization signals 2 and 3 are measured in each line of the image recording term, and shifts from the target values are reflected in phase control of the pixel clock PCLK in the next line.

Referring to FIG. 9, a detailed description will be given of the real-time control. The correction circuit 30 generates the correction signals e1 and e2. The correction signal e1 corresponds to the difference between the target value and the time interval between the horizontal synchronization signals 1 and 2. The correction signal e2 corresponds to the difference between the target value and the time interval between the horizontal synchronization signals 2 and 3. In the data generation circuit 34, in the first half of each line, a table address corresponding to the correction signal e1 is generated by the table address generation circuit 38, and a corresponding LUT 37 is selected by the control circuit 35. In the latter half of each line, a table address corresponding to the correction signal e2 is generated by the table address generation circuit 38, and a corresponding LUT 37 is selected by the control circuit 35. According to such control, even if the influence of temperature rise or the like within a page is not negligible, it is possible to correct the scan width of and dot position shift in each line of a page with a higher degree of accuracy.

Further, the image forming apparatus according to this embodiment further includes means commonly used in image forming apparatuses of this kind. For example, charging means for charging the surface of the photoconductor 409, developing means for developing an electrostatic latent image to a toner image, transfer means for transferring the developed toner image onto a paper or an intermediate transfer medium, and cleaning means for eliminating and collecting residual toner on the photoconductor 409. However, these means are not shown in FIG. 19.

<<Various Modes of Phase Shift Control of Pixel Clock>>

A description will now be given of various modes relating to phase shift control of the pixel clock PCLK. Here, a description will be given of phase shift control of the pixel clock PCLK, assuming that two horizontal synchronization signals are detected as in the Embodiments 1 and 2. However, obviously, similar pixel clock phase shift control may be applied to cases where three (or 4 or more) horizontal synchronization signals are detected as in Embodiments 3 and 4.

With the pixel clock generation apparatus of the present invention, it is possible to perform phase shift control of the pixel clock PCLK by defining a plurality of consecutive pixel clocks as a data area, dividing the effective scan period into a plurality of data areas, and setting phase shift data to each of the data areas. The division may be performed equally or unequally.

Figure 20:
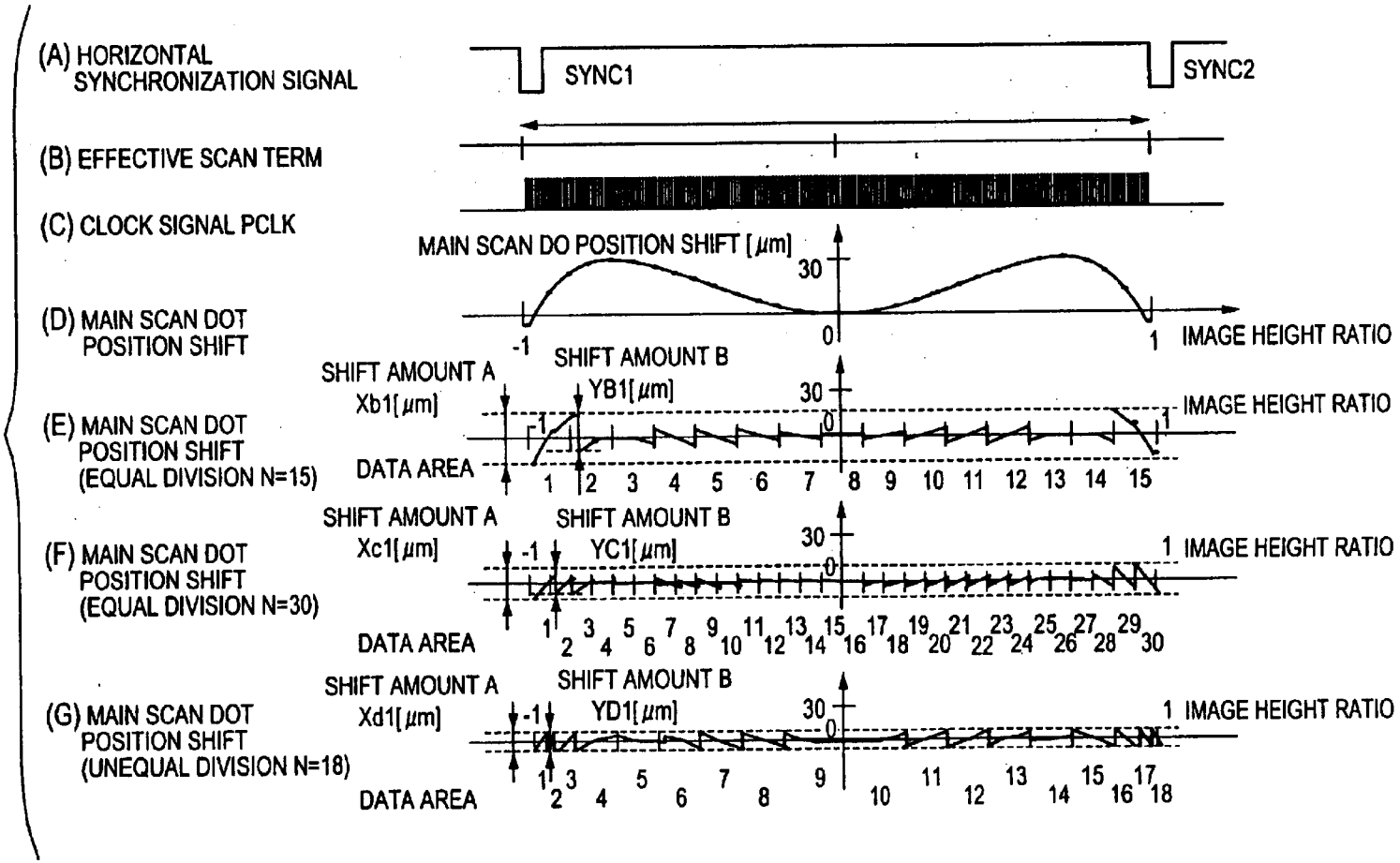
FIG. 20 is a schematic diagram for explaining division of a data area and correction of main scan dot position shift by shift control of the pixel clock performed on each data area.

FIG. 20 in an explanatory diagram of phase shift control of such a pixel clock. FIG. 20-(A) indicates the horizontal synchronization signals 1 and 2 (sync 1 and sync 2). FIG. 20-(B) indicates the effective scan period between the horizontal synchronization signals. FIG. 20-(C) indicates the pixel clock PCLK. FIG. 20-(D) indicates a linearity curve of the scanning optical system. In FIG. 20-(D), the vertical axis represents the main scan dot position shift, and the horizontal axis represents the image height ratio. In the horizontal axis, the image height ratio in the center of the effective scan period is defined as 0, and those at the positions where the horizontal synchronization signals 1 and 2 are generated are defined as 1 and −1, respectively.

FIG. 20-(E), (F) and (G) indicate the main scan dot position shift in the cases where phase shift control of the pixel clock PCLK is performed on each data area such that the effective scan period is divided into N data areas and the amount of the main scan dot position shift becomes 0 at the center of each of the data areas. In FIG. 20-(E), (F) and (G), the numbers of the horizontal axis represent data area numbers, "shift amount A" represents an amount of main scan dot position shift, and "shift amount B" represents a shift amount between data areas. FIG. 20-(E) indicates the case of equal division of N=15, FIG. 20-(F) indicates the case of equal division of N=30, and the FIG. 20-(G) indicates the case of unequal division N=18, where N represents the number of division.

In FIG. 20-(E) through FIG. 20-(G), when it is assumed that X represents the amplitude of the main scan dot position shift after phase shift of the pixel clock PCLK, and Y represents the amount of the dot position shift between the data areas, then X represents the absolute value of the dot position shift on a scan line. The smaller the value is, the better the correction is made. Regarding the amount Y of the dot position shift between the data areas, when the value is large, the dot position between the data areas becomes either dense or sparse. Thus, it can be said that better correction is made by making the value of Y as small as possible.

According to such a method of controlling phase shift of the pixel clock PCLK by division using the data areas, it is enough if a LUT 37 that stores phase shift data for each data area is provided in the LUT storing unit 36 (refer to FIG. 9) of the data generation unit 5 of the pixel clock generation apparatus. Hence, it is possible to significantly reduce the size (data amount) of the LUT 37, compared with the case where phase shift data are provided for each pixel clock without performing the division.

Figure 21:
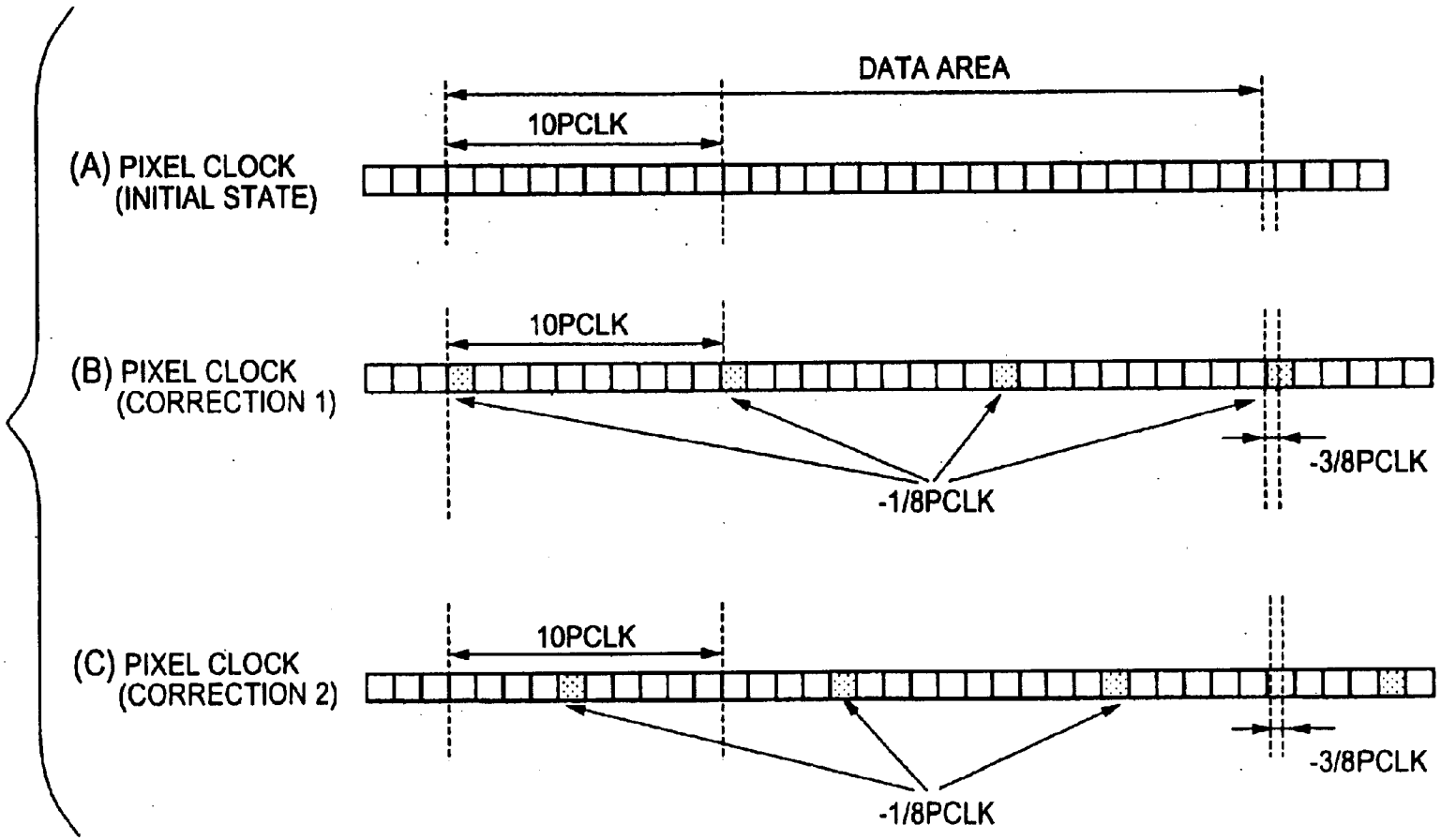
FIG. 21 is a schematic diagram for explaining pixel clock phase shift in the data area.

FIG. 21 shows examples of phase shift of the pixel clock PCLK in a data area. FIG. 21 shows the case of performing dot position correction for −⅜ PCLK by performing phase shift on three pixel clocks in the data area, where 30 clocks (30 PCLK) form one data area and phase shift resolution of the pixel clock PCLK is +⅛ PCLK.

FIG. 21-(A) indicates a pixel clock sequence in the case where no phase shift is performed. FIG. 21-(B) indicates a pixel clock sequence in the case where dot position correction is made by performing phase shift for −⅛ PCLK in every 10 clocks from the first clock of the data area. FIG. 21-(C) indicates a pixel clock sequence in the case where phase shift for −⅛ PCLK is performed in every 10 clocks from the fifth clock of the data area when counted from the first clock. In FIG. 21-(B) and FIG. 21-(C), the clocks that are subjected to the phase shift are solid (filled in).

When the phase shift methods of FIG. 20-(B) and FIG. 20-(C) are applied to consecutive lines, there is a possibility that vertical stripes, corresponding to dot positions subjected to phase shift, may appear on the image. In order to reduce such vertical stripes, it is effective to switch phase shift methods for each line. Such switching of phase shift methods can be realized as follows, for example. That is, LUTs 37 storing phase shift data patterns and corresponding to respective methods are stored in the LUT storing unit 36 (refer to FIG. 9), and the LUT 37 to be used for each line is switched by the control circuit 35. Alternatively, the phase shift control method can be switched for each line by storing phase shift data patterns corresponding to respective methods in an identical LUT 37, and changing, by the control circuit 35, for each line the value of the top bit(s) of the table address that is generated by the table address generation circuit 38. Further, it is also possible to switch the phase shift method of the pixel clock PCLK for each line by reading an identical shift data pattern from the LUT storing unit 36, and controlling, by the control circuit 35, the output method of phase shift data from the shift register circuit 39.

Figure 22:
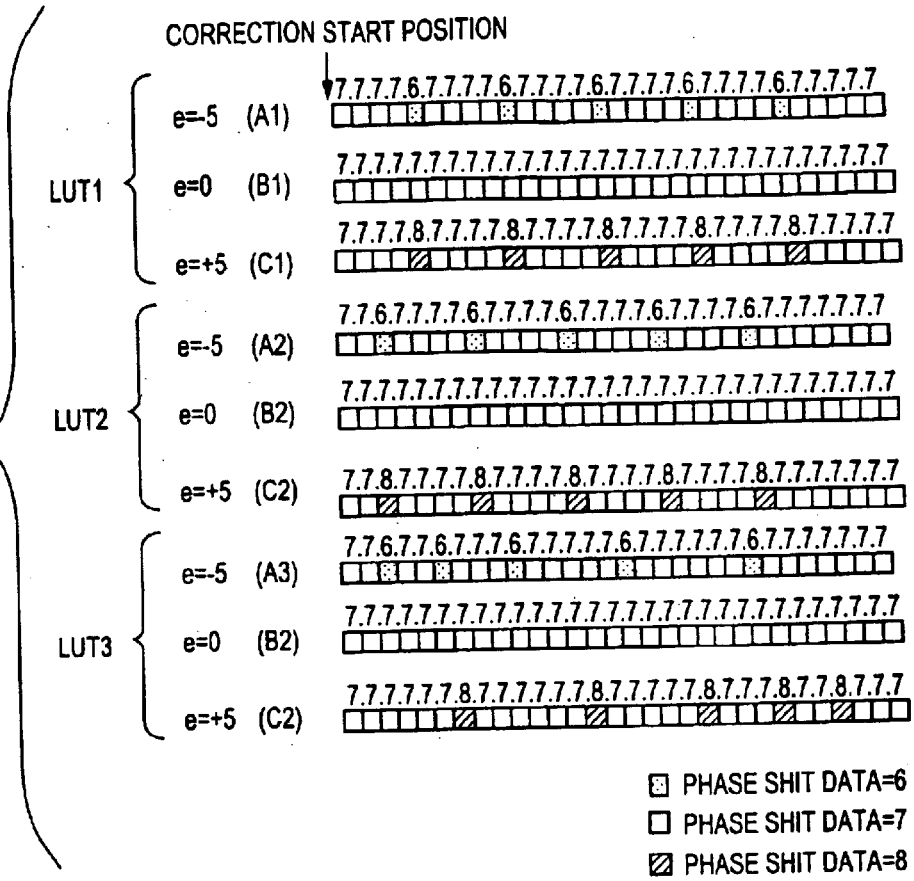
FIG. 22 is a data diagram for explaining a lookup table.

FIG. 22 shows examples of LUTs applied to phase shift control of the pixel clock PCLK in each data area, assuming that 30 clocks form one data area. LUT 1, LUT 2 and LUT3 shown in FIG. 22 each stores phase shift data patterns corresponding to the values −5, 0 and +5 of the correction signal e (refer to FIG. 9). The values of phase shift data are defined as follows: the value of the phase shift data for shifting (gaining) the phase of the pixel clock PCLK for −1/16 is "6", that for not varying the phase of the pixel clock PCLK is "7", and that for shifting (delaying) the phase of the pixel clock PCLK is "8".

In each of the LUTs (LUT 1, LUT 2, and LUT3), the phase shift data pattern that corresponds to the correction signal=−5 includes phase shift data for performing phase shift for −1/16 at five points in the 30 clocks. The phase shift data pattern that corresponds to the correction signal e=0 are formed by only phase data without phase shift. The phase shift data pattern that corresponds to the correction signal e=+5 includes phase shift data for performing phase shift for +1/16 at five points in the 30 clocks. As shown in FIG. 22, depending on the LUT to be used for generating the phase shift data, even if the value of the correction signal e is identical, the clock positions subjected to phase shift are different.

When the scanning optical system possesses the linearity characteristic as shown in FIGS. 13A and 13B, if phase shift data are generated by using the LUT 1 for the region A, the LUT 2 for the region D, and the LUT 3 for the region B, for example, then, it is possible to perform correction of main scan dot position shift with a high degree of accuracy by performing phase shift control of the pixel clock PCLK that is suitable for the dot position shift characteristic in each of the regions.

Figure 23:
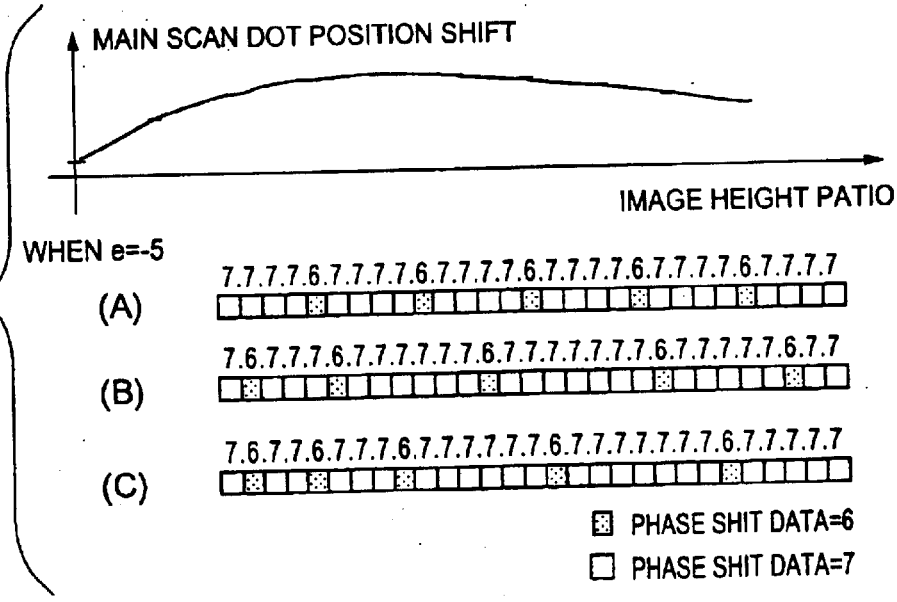
FIG. 23 is a schematic diagram for explaining phase shift data patterns.

As mentioned above, the clock positions subjected to phase shift can be set with unequal intervals as well as an equal interval. FIG. 23 shows examples of phase shift data patterns for such phase shift control, together with the characteristic of main scan dot position shift. Each of the examples is a pattern for 30 clocks corresponding to the correction signal e=−5.

FIG. 23-(A) indicates a phase shift data pattern where clocks subjected to phase shift are set with an equal interval. FIG. 23-(B) indicates a phase shift data pattern where clocks subjected to phase shift are set with unequal intervals. FIG. 23-(C) indicates a phase shift data pattern where the interval between clocks subjected to phase shift depends on image height.

When phase shift control of the pixel clock PCLK is performed in accordance with the phase shift data pattern as indicated by FIG. 23-(A), it is possible to avoid occurrence of visual unevenness in an image due to concentration of clocks whose phases are shifted. In other words, it can be also said that deviation in dot position shift correction within a control zone is reduced.

However, in a case where phase shift of the pixel clock PCLK is performed with a constant interval, when consecutive dot shifts of 0.5 mm–1 mm is conspicuous, if the interval between the conspicuous dot shifts and that between the phase shifts of the pixel clock PCLK are close, then an image having conspicuous vertical lines or the like tends to be produced. If phase shift of the pixel clock PCLK is performed with unequal intervals in accordance with the phase shift data pattern as indicated by FIG. 23-(B), it is possible to avoid occurrence of such a periodic scan variation.

The phase shift data pattern indicated by FIG. 23-(C) is set such that the interval between clocks subjected to phase shift is narrow at image heights having great variation in the amount of main scan dot position shift, and that at image heights having small variation in the amount of main scan dot position is wide. If phase control of the pixel clock PCLK is performed in accordance with such a phase shift data pattern, it is possible to reasonably realize correction of main scan dot position shift with a high degree of accuracy in any image heights.

When phase control of the pixel clock PCLK is performed in accordance with the phase shift data pattern where clocks subjected to phase shift are set with an equal interval, as indicated by FIG. 23-(A), the pixel clock generation apparatus of the present invention can easily correspond to variation of image writing resolution.

For example, an interval N between clocks subjected to phase shift in a given resolution can be calculated as:

$$N=M\times N0$$

where the resolution of 1200 dpi is set as a standard (standard resolution), N0 represents the interval between clocks subjected to phase shift in the standard resolution, and M represents the magnification of the given resolution with respect to the standard resolution.

More specifically, when N0=12 and phase shift can be performed on the cycle of the pixel clock PCLK by ±1/8 PCLK, then, N can be calculated as shown below.

When resolution is 1200 dpi: M=1.0
→N=1.0×12=12

When resolution is 600 dpi: M=0.5
→N=0.5×12=6

When resolution is 400 dpi: M=0.33
→N=0.33×12=4

In this manner, by varying the interval between clocks subjected to phase shift in accordance with resolution, it is possible to perform dot position correction at a constant rate with respect to an image region irrespective of resolution.

The interval between clocks subjected to phase shift can be changed in the above-mentioned manner by, for example, the following method. That is, in the data generation unit 5 (refer to FIG. 9), only a LUT 37 for the standard resolution (or LUTs 37 for several resolutions) is prepared in the LUT storing unit 36, and phase shift data subjected to thinning are output from the shift register circuit 39. The thinning is performed so that a phase shift data pattern generated by using the LUT 37 for the standard resolution (or one of the LUTs 37 for several resolutions, which LUT 37 is for a resolution that is close to a target resolution) has a clock interval obtained by the above-mentioned calculation. It is also possible to prepare a LUT 37 having phase shift data patterns for various resolutions, which phase shift data patterns have clock intervals obtained by the above-mentioned calculation, and to select and use a LUT 37 for a target resolution. In this case, however, the size of the LUT 37 is increased.

Figure 24:
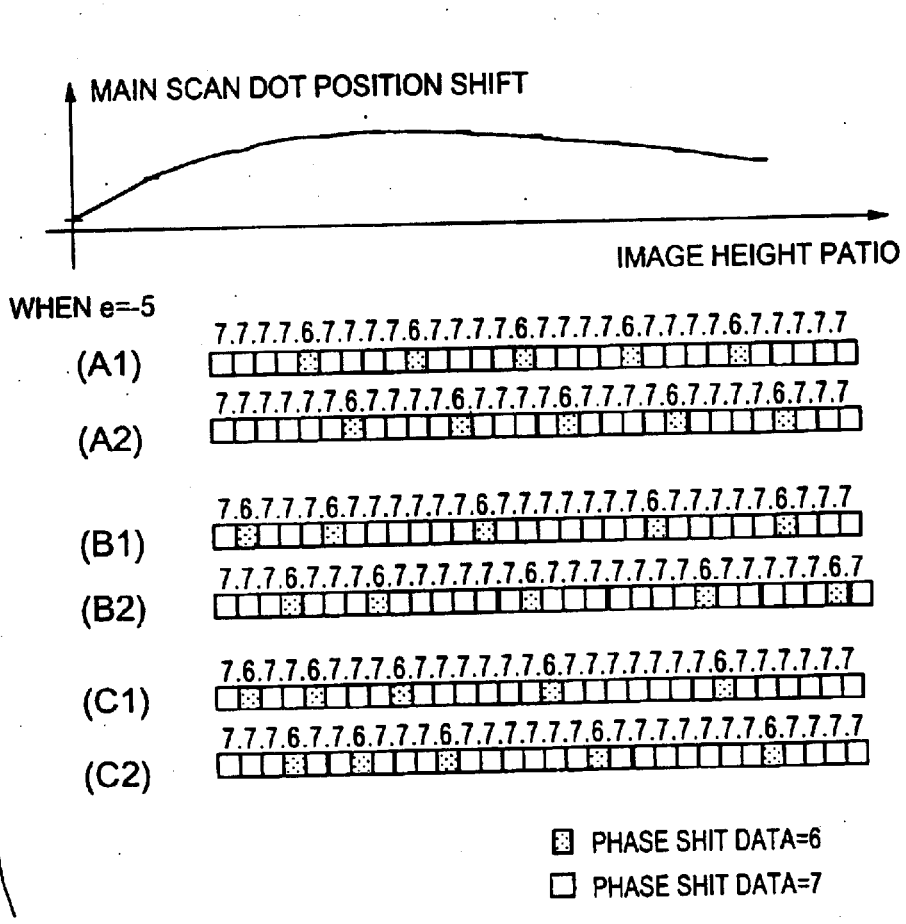
FIG. 24 is another schematic diagram for explaining phase shift data patterns.

It is also possible to prepare two or more kinds of phase shift data patterns corresponding to an identical correction signal=−5, for example, and selectively use them. FIG. 24 shows such an example.

In FIG. 24, the phase shift data patterns indicated by (A1), (B1), and (C1) are identical to those indicated by (A), (B) and (C) in FIG. 23. The phase shift data-pattern indicated by (A2), (B2), and (C2) and those indicated by (A1), (B1), and (C1) are of the same kind. However, the positions of clocks subjected to phase shift are different. Here, the phase shift data that gain the phase of the pixel clock PCLK for −1/16 PCLK are defined as "6", and the phase shift data that does not vary the phase of the pixel clock PCLK are defined as "7".

If lines continue to which lines an identical phase shift data pattern is applied, there is possibility that vertical lines corresponding to the positions of clocks subjected to phase shift may appear in the image. In order to avoid such a problem, for example, it is effective to prepare a LUT 37 storing the phase shift data pattern indicated by FIG. 24-

(A1) and a LUT 37 storing the phase shift data pattern indicated by FIG. 24-(A2), and to use these LUTs 37 by switching them for each line or several lines when lines having the correction signal e=−5 continue.

Figure 25:
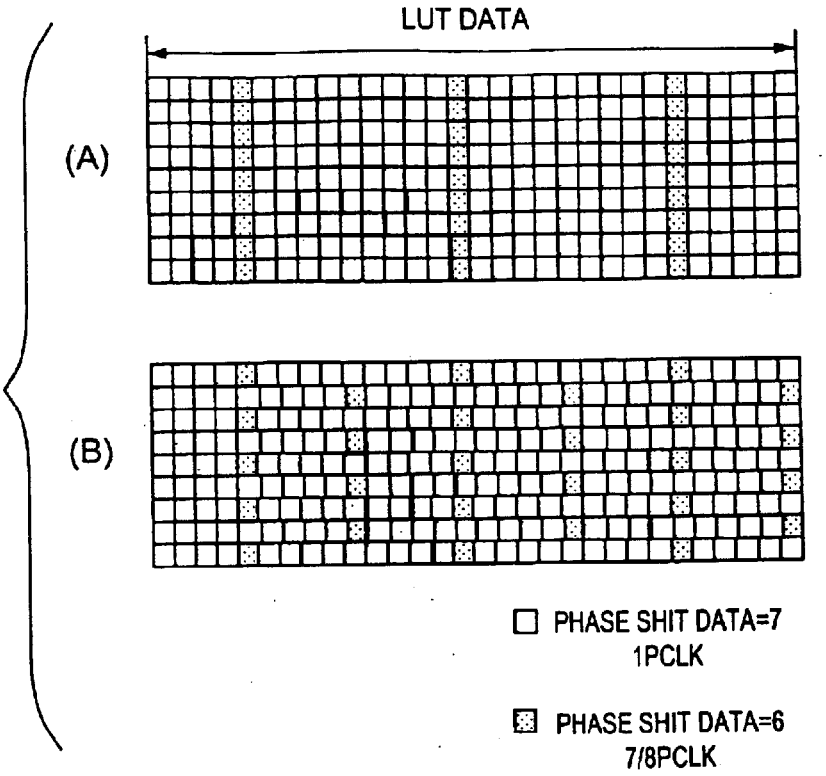
FIG. 25 is a schematic diagram for explaining a disadvantage caused by applying an identical phase shift data pattern to consecutive lines and switching of phase shift data patterns for eliminating such disadvantage.

Referring to FIG. 25, a description will be given of another example of switching phase shift data patterns. In FIG. 25, each of (A) and (B) indicates a phase shift data pattern (for 30 clocks) applied to a case where there are consecutive lines having the correction signal e=−3.

As indicated by FIG. 25-(A), when an identical phase shift data pattern is applied to consecutive lines, there is a possibility that vertical line-like noise, corresponding to the positions of clocks subjected to phase shift, may become conspicuous in the image. In order to make such vertical line-like noise inconspicuous, as indicated by FIG. 25-(B), it is effective to apply a first phase shift data pattern to one line and, in the next line, apply a second phase shift data pattern that performs phase shift on a clock in the middle position in the interval of clocks subjected to phase shift in the first phase shift data pattern. This can be achieved by preparing a LUT 37 of the first phase shift data pattern and that of the second phase shift data pattern, and using each of the LUTs 37 by switching them for each line.

Figure 26:
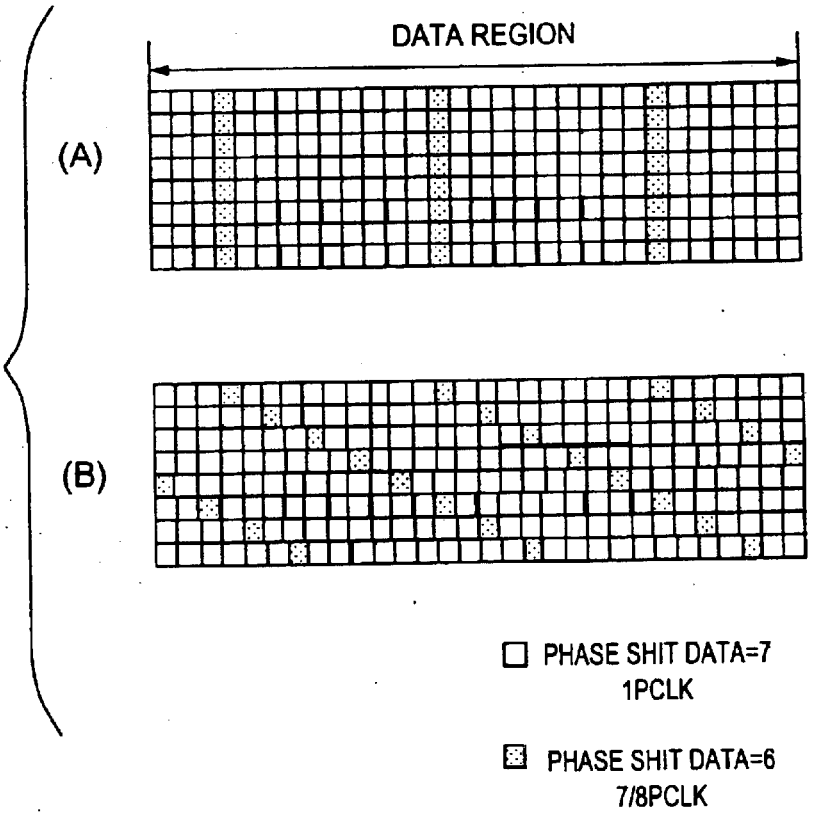
FIG. 26 is another schematic diagram for explaining a disadvantage caused by applying an identical phase shift data pattern to consecutive lines and switching of phase shift data patterns for eliminating such disadvantage.

Referring to FIG. 26, a description will be given of another example of switching phase shift data patterns. In FIG. 26, each of (A) and (B) indicates a phase shift data pattern (for 30 clocks) applied to a case where there are consecutive lines having the correction signal e=−3.

As indicated by FIG. 26-(A), when an identical phase shift data pattern is applied to consecutive lines, as mentioned above, there is a possibility that vertical line-like noise, corresponding to the positions of clocks subjected to phase shift, may become conspicuous in the image.

Referring to FIG. 26-(B), the phase shift data pattern to be applied is sequentially shifted in each line for clocks of a multiple number of N (in this case, 2). In this manner, the positions of clocks subjected to phase shift are sequentially shifted, and occurrence of vertical line-like noise as indicated by FIG. 26-(A) is prevented. This can be achieved by preparing a plurality of kinds of LUTs 37 and selecting one of them for each line. However, instead of switching the LUTs 37, it is also possible to achieve the above-mentioned method by shift control in the shift register circuit 39 (refer to FIG. 9).

It is an area in a line where an image is actually recorded that requires reduction of the above-mentioned influence of phase shift performed on the identical positions of clocks. In the other areas, there is no particular disadvantage even if an identical phase shift data pattern is used repeatedly in consecutive lines.

Figure 27:
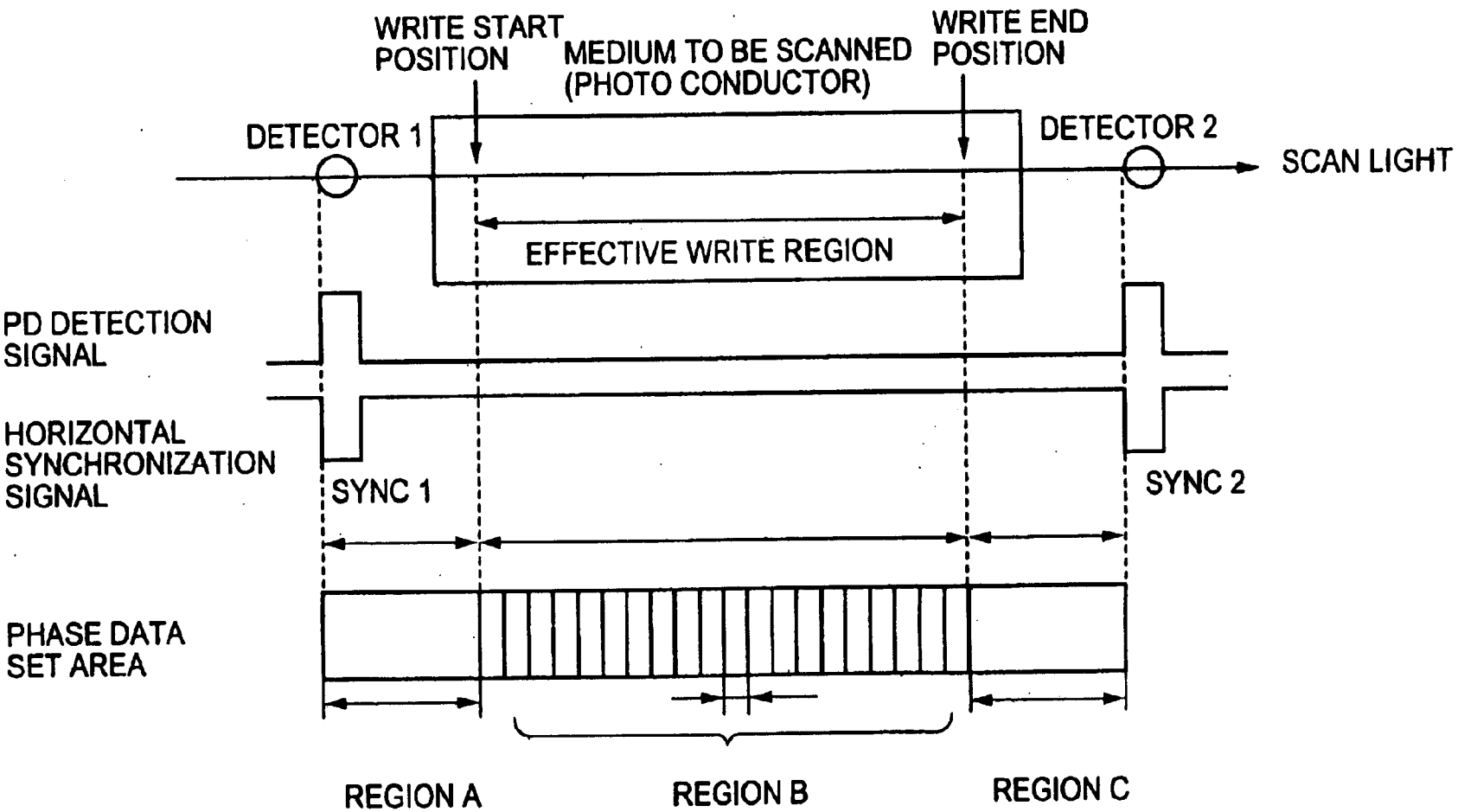
FIG. 27 is a schematic diagram for explaining phase shift control of the pixel clock in an effective scan region of a scan line and in the other region.

Referring to FIG. 27, a description will be given of an exemplary embodiment of phase shift control of the pixel clock PCLK that takes the above-mentioned fact into account.

As shown in FIG. 27, the interval of 2000 clocks from generation of the horizontal synchronization signal 1 (sync 1) on the scan start side is defined as a region A. The 2000-clock interval before generation of the horizontal synchronization signal 2 (sync 2) on the scan end side is defined as a region C. The interval between the clock position next to the region A and the clock position immediately before the region C is defined as an effective scan region B where an image is actually recorded.

The control circuit 35 of the phase shift data generation unit 5 (refer to FIG. 9) of the pixel clock generation apparatus starts counting the pixel clock PCLK from the generation of the horizontal synchronization signal sync 1. The control circuit 35 monitors which one of the regions A, B and C is being scanned. The control circuit 35 does not select a LUT 37 for switching phase shift data pattern during the scan period of the region A. During the scan period of the effective scan region B, the control circuit 35 performs selection control of a LUT 37 for switching phase shift data patterns for each line as mentioned above. When scanning of the effective scan region B ends, in the period in which the region C is scanned, as in the region A, selecting of a LUT 37 for switching phase shift data patterns is not performed.

In this manner, when the switching of phase shift data patterns is performed only in the region B that has direct influence on quality of the image so as to control occurrence of vertical lines or the like, and the switching is not performed in the regions A and C that has no direct influence on the quality of the image, it is possible to reduce the number of required LUTs 37 and the total size thereof.

Further, it is also possible to configure the data generation circuit 34 (refer to FIG. 9) to include two shift register circuits that correspond to the shift register circuit 39 and an adding circuit (synthesizing circuit) on the output side of the register circuits, though illustration thereof is omitted. In this case, first and second phase shift data patterns are read out from first and second LUTs 37, respectively, and are stored in the respective shift register circuits. Then, the two phase shift data that are output from the two shift register circuits are added (synthesized) by the adding circuit (synthesizing circuit), thereby obtaining the final phase shift data. The present invention includes a pixel clock generation apparatus having such a configuration. With such a configuration, it is possible to assume a phase shift data pattern that is applied to all lines and corrects scan variation caused by the characteristic of the scanning optical system to be the first phase shift data pattern, and to assume a phase shift data pattern for correcting variation in each line such as rotational variation of the polygon mirror to be the second phase shift data pattern, for example.

Figure 28:
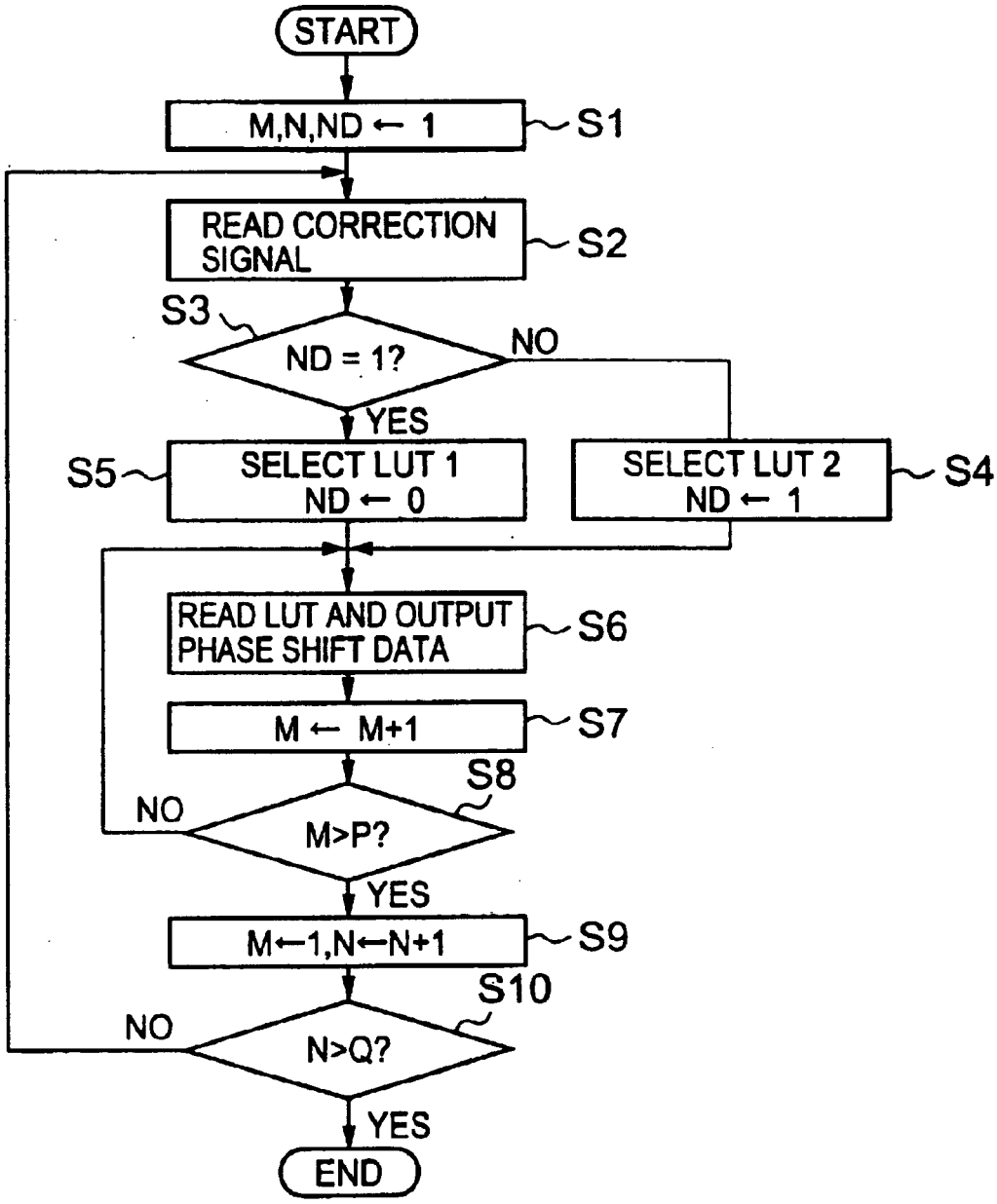
FIG. 28 is a flow chart showing an exemplary embodiment of control flow by a control circuit of the phase shift data generation unit.
Figure 29:
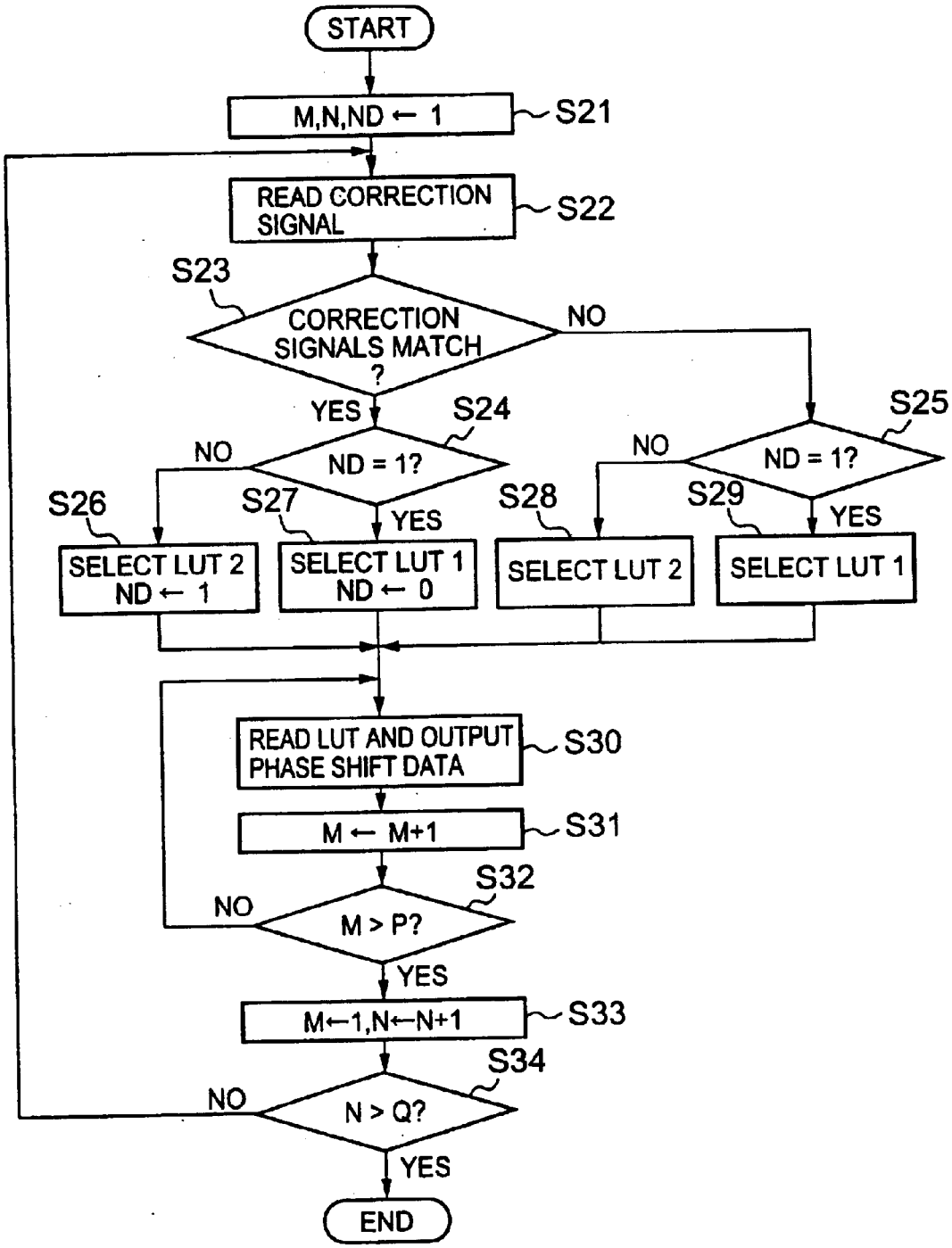
FIG. 29 is another flow chart showing an exemplary embodiment of control flow by a control circuit of the phase shift data generation unit.
Figure 30:
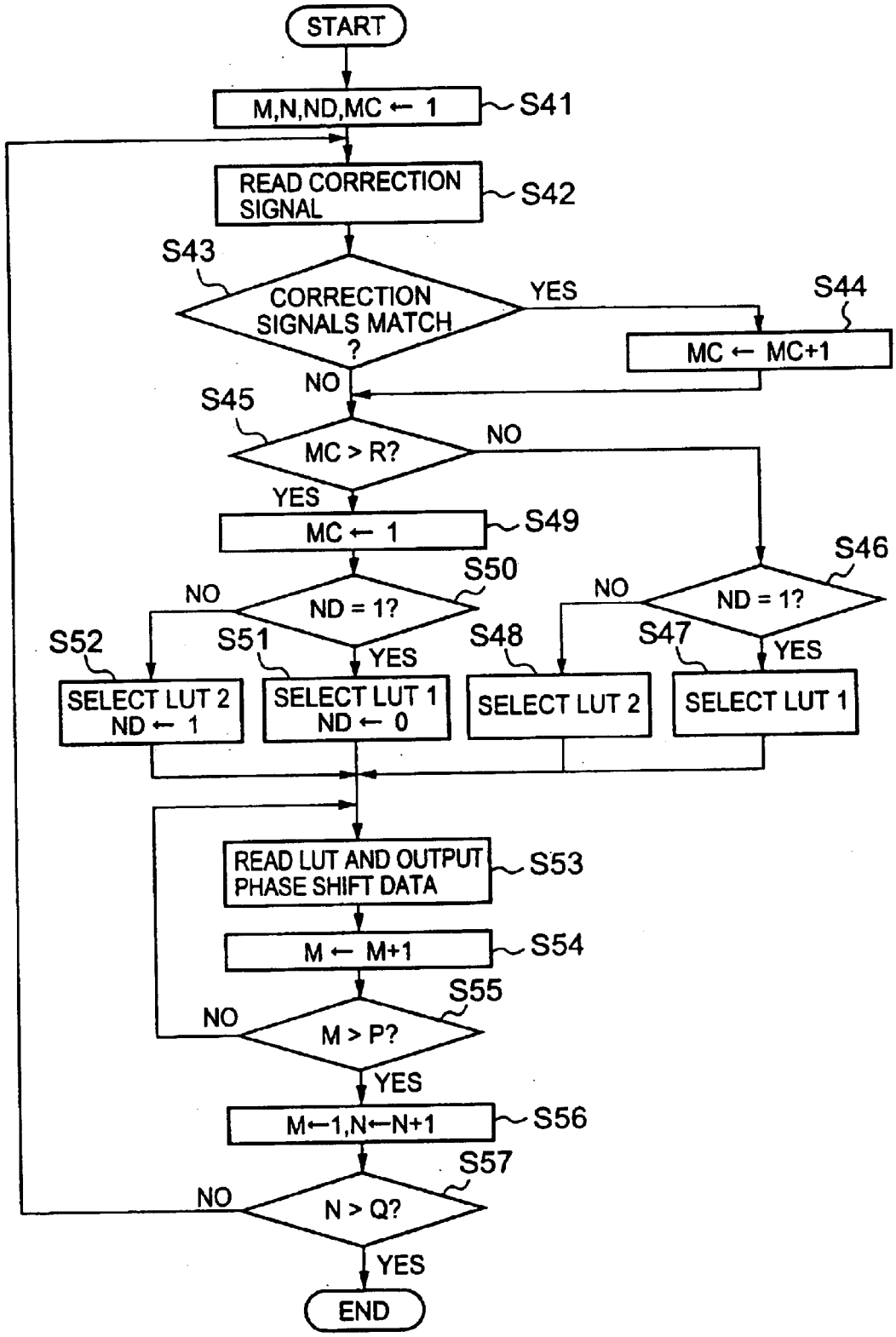
FIG. 30 is yet another flow chart showing an exemplary embodiment of control flow by a control circuit of the phase shift data generation unit.

Referring to FIGS. 28 through 30, a description will be given of exemplary embodiments of control flow of the control circuit 35 (refer to FIG. 9) in a case where switching of phase shift data patterns as mentioned above is performed for each line or several lines. It is assumed that real-time control is performed in which the difference between the target value and the time interval between the horizontal synchronization signals 1 and 2 is detected in each line, and the detected difference is reflected in pixel clock phase shift control in the next line. For simplicity of explanation, it is also assumed that each scan line is divided into uniform data areas each having a constant (the same) length.

FIG. 28 shows an exemplary embodiment of the control flow in a case where the LUT 1 and the LUT 2 are selectively applied to each line.

First, in step S1, prior to image recording of a first page, the control circuit 35 performs initial setting of counters M and N and a flag ND that are used for control.

Steps S2 through S8 are control processes relating to one scan line.

In step S2, the table address generation circuit 38 receives, from the correction circuit 30, a correction signal e corresponding to a line. In step S3, the flag ND is checked. That is, whether the flag ND=1 is determined. When the flag ND=1 (YES in step S3), a selection signal of the LUT 1 is supplied to the LUT storing unit 36, and simultaneously, the flag ND is set to 0 in step S5. In step S6, a table address is generated in the table address generation circuit 38, a phase shift data pattern is read out from the selected LUT, and phase shift data are output from the shift register circuit 39 in synchronization with the pixel clock PCLK. In step S7, the value of the counter M is incremented by 1. In step S8, the value of the counter M is compared with a predetermined value P (whether M>P is determined), thereby determining whether a process for one line ends. When the process of the line is not finished (NO in step S8), then steps S6 through S8 are repeated. That is, the counter M counts the number of data areas-each formed by a constant number of consecutive pixel clocks.

When the value of the counter M exceeds the predetermined number P (YES in step S8), it is determined that the process for one line is finished. In this case, the value of the counter M is set to 1, and the value of the counter N is incremented by 1 in step S9. Then, in step S10, the value of the counter N is compared with a predetermined value Q (whether N>Q is determined), thereby determining whether the process for one page is finished. When the process of the page is not finished (NO in step S10), the process returns to step S2. When the process of the page is finished (writing is finished) (YES in step S10), the process ends.

When the flag ND is determined to be 0 in step S3 (NO in step S3), then in step S4, a selection signal of the LUT 2 is supplied to the storing unit 36, and the flag ND is set to 1. Accordingly, the phase shift data pattern stored in the LUT 2 is applied to the line in process. Since the flag ND is set to 1, the phase shift data pattern of the LUT 1 is applied again in the next line.

Additional description will be given of step S6. Each of the lookup tables LUT 1 and LUT 2 stores phase shift data pattern sequences corresponding to respective data areas M (1, 2, . . . , P) of a line. In step S6, lower bits of a table address generated by the table address generation circuit 38 are set in accordance with the number (=the value of the counter M) of a data area. Accordingly, a phase shift data pattern corresponding to a data area is output.

FIG. 29 shows another exemplary embodiment of the control flow in a case where the two LUTs, the LUT 1 and the LUT 2, are applied alternately when there are consecutive lines having an identical correction signal e.

First, in step S21, prior to image recording of a first page, the control circuit 35 performs initial setting of the counters M and N and the flag ND that are used for control.

Steps S22 through S32 are control processes relating to one scan line.

In step S22, the table address generation circuit 38 receives, from the correction circuit 30, a correction signal e corresponding to a line in process. In step S23, it is determined whether the value of the received correction signal e matches the value of a correction signal e that is received in the immediately preceding line. They never match in a first line of a page. When the values of the correction signals e do not match (NO in step S23), the value of the flag ND is checked (whether ND=1 is determined) in step S25. When the value of the flag ND=0 (NO in step S25), the selection signal of the LUT 2 is supplied to the LUT storing unit 36 in step S28. When the value of the flag ND=1 (YES in step S25), the selection signal of the LUT 1 is supplied to the LUT storing unit 36 in step S29. That is, the LUT 1 or the LUT 2 is successively applied to consecutive lines having correction signals e of different values.

When the value of the correction signal e of the line in process and that of the immediately preceding line match (YES in step S23), the value of the flag ND is checked (whether the flag ND=1 is determined) in step S24. When the flag ND=1 (YES in step S24), the selection signal of the LUT 1 is output and the value of the flag ND is set to 0 in step S27. When the decision result in step S24 is NO (NO in step S24), the selection signal of the LUT 2 is output and the value of the flag ND is set to 1 in step S26. That is, when there are consecutive lines having correction signals e of an identical value, the LUT 1 and the LUT 2 are selected alternatively for each line.

In step S30, a table address is generated in the table address generation circuit 38, a phase shift data pattern is read out from the selected LUT, and phase shift data are output from the shift register circuit 39 in synchronization with the pixel clock PCLK. In step S31, the value of the counter M is incremented by 1. In step S32, the value of the counter M is compared with the predetermined value P (whether M>P is determined), thereby determining whether a process for one line ends. When the process of the line is not finished (NO in step S32), then steps S30 through S32 are repeated.

When the value of the counter M exceeds the predetermined number P (YES in step S32), it is determined that the process for one line is finished. In this case, the value of the counter M is set to 1, and the value of the counter N is incremented by 1 in step S33. Then, in step S34, the value of the counter N is compared with the predetermined value Q (whether N>Q is determined), thereby determining whether the process for one page is finished. When the process for the page is not finished (NO in step S34), the process returns to step S22. When the process for the page is finished (writing is finished)(YES in step S34), the process ends.

In step S24, when it is determined that the value of the flag ND is 0 (NO in step S24), the selection signal of the LUT 2 is supplied to the storing unit 36 and the value of the flag ND is set to 1 in step S26. Accordingly, phase shift data patterns stored in the LUT 2 are applied to the line in process. Since the value of the flag ND is set to 1, in the next line, phase shift data patterns of the LUT 1 are applied thereto again.

With the above-mentioned control, when there are consecutive scan lines that output an identical phase shift data pattern, by switching the lookup tables (the LUT 1 and the LUT 2, for example), it is possible to avoid undesirable effects caused by outputting an identical phase shift data pattern with respect to consecutive scan lines, for example, a problem that vertical lines appear at the positions of pixel clocks subjected to phase shift or in boundaries between the data areas.

Additional description will be given of step S30. Each of the lookup tables LUT 1 and LUT 2 stores phase shift data pattern sequences corresponding to respective data areas M (1, 2, . . . , P) of a line. In step S30, lower bits of a table address generated by the table address generation circuit 38 are set in accordance with the number (=the value of the counter M) of a data area. Accordingly, a phase shift data pattern corresponding to a data area is output.

FIG. 30 shows another exemplary embodiment of the control flow in a case where LUTs to be applied are switched when there are a predetermined number of consecutive lines having correction signals e of an identical value.

First, in step S41, prior to image recording of a first page, the control circuit 35 performs initial setting of the counters M and N, a counter MC, and the flag ND that are used for control.

Steps S42 through S55 are control processes relating to one scan line.

In step S42, the table address generation circuit 38 receives, from the correction circuit 30, a correction signal e corresponding to a line in process. In step S43, it is determined whether the value of the received correction signal e matches the value of a correction signal e that is received in the immediately preceding line. They never match in a first line of a page. When the values of the correction signals e match (YES in step S43), the value of the counter MC is incremented by 1 in step S44.

In step S45, whether the value of the counter MC exceeds a predetermined value R (whether MC>R) is determined. When the value of the counter MC does not exceed the predetermined value R (NO in step S45), the value of the flag ND is checked (whether ND=1 is determined) in step S46. When the value of the flag ND=1 (YES in step S46), the selection signal of the LUT 1 is supplied to the LUT storing unit 36 in step S47. When the value of the flag ND=0 (NO in step S46), the selection signal of the LUT 2 is supplied to the LUT storing unit 36 in step S48.

When the value of the counter MC exceeds the predetermined value R (YES in step S45), the value of the counter MC is set to 1 in step S49. In step S50, the value of the flag ND is checked (whether ND=1 is determined). When the value of the flag ND is 1 (YES in step S50), the selection signal of the LUT 1 is output and the value of the flag ND is set to 0 in step S51. When the value of the flag ND is 0 (NO in step S50), the selection signal of the LUT 2 is output and the value of the flag ND is set to 1 in step S52.

In step S53, a table address is generated in the table address generation circuit 38, a phase shift data pattern is read out from the selected LUT, and phase shift data are output from the shift register circuit 39 in synchronization with the pixel clock PCLK. In step S54, the value of the counter M is incremented by 1. In step S55, the value of the counter M is compared with the predetermined value P (whether M>P is determined), thereby determining whether the process for one line ends. When the process of the line is not finished (NO in step S55), then steps S53 through S55 are repeated.

In this manner, when scanning for each line ends and the value of the counter M exceeds the predetermined number P (YES in step S55), the value of the counter M is set to 1, and the value of the counter N is incremented by 1 in step S56. Then, in step S57, the value of the counter N is compared with the predetermined value Q (whether N>Q is determined), thereby determining whether the process for one page is finished. When the process for the page is not finished (NO in step S57), the process returns to step S42. When the process for the page is finished (writing is finished)(YES in step S57), the process ends.

Additional description will be given of step S53. Each of the lookup tables LUT 1 and LUT 2 stores phase shift data pattern sequences corresponding to respective data areas M (1, 2, . . . , P) of a line. In step S53, lower bits of a table address generated by the table address generation circuit 38 are set in accordance with the number (=the value of the counter M) of a data area. Accordingly, a phase shift data pattern corresponding to a data area is output.

As can be understood from the above description, assuming that R=2, for example, when there are three consecutive lines having the correction signals e of an identical value, in the third line, a LUT used until then is switched for another LUT. Thus, when consecutive dot shifts of 0.5 mm–1 mm or more are conspicuous in terms of human visual characteristics (acuity), if the number of lines (R) for switching the lookup tables is set such that the consecutive length of the dots becomes shorter than the above value, it is possible to control occurrence of vertical lines and the like, corresponding to the pixel clocks subjected to phase shift or boundaries of the data areas, in an image.

A description will now be given of other exemplary embodiments of the image forming apparatus using the above-mentioned pixel clock generation apparatus of the present invention.

(Embodiment 5)

Figure 31:
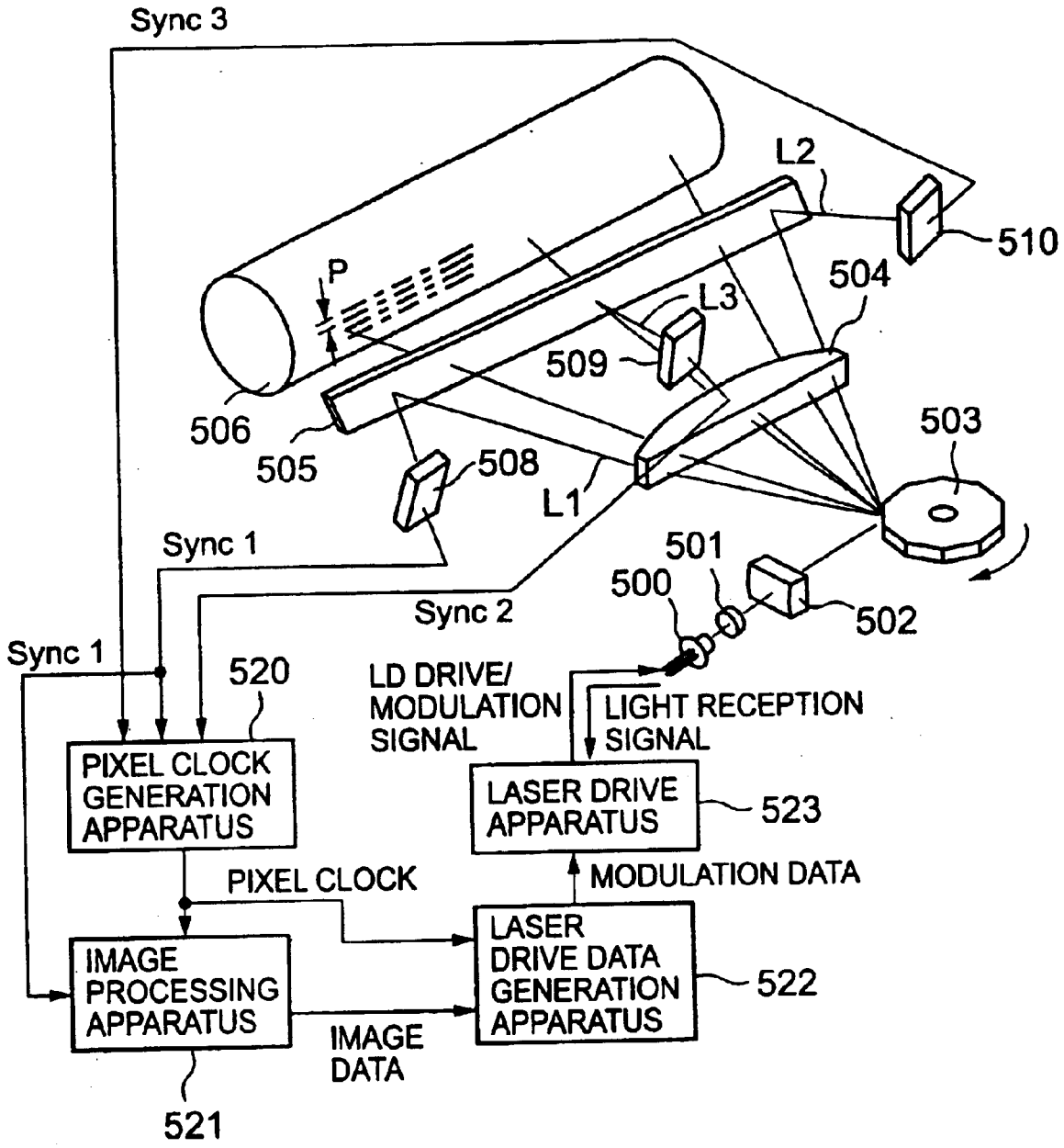
FIG. 31 is a schematic diagram of an image forming apparatus according to Embodiment 5 of the present invention.

FIG. 31 is a schematic diagram of an image forming apparatus according to Embodiment 5 of the present invention. In the image forming apparatus, a laser light beam output from a semiconductor laser 500 is incident on a polygon mirror 503 via a collimator lens 501 and a cylinder lens 502. The laser light beam deflected by the polygon mirror 503 passes through a fθ lens 504, is transmitted through (partially reflected by) a flat glass 505, and is incident on a photoconductor 506 that is a medium to be scanned. Thereby, the laser light beam forms a light beam spot on the surface (surface to be scanned) of the photoconductor 506, and forms an image (electrostatic latent image).

The laser light beam reflected by a first surface of the flat glass 505 is detected by photodetectors 508, 509 and 510 that are arranged on surfaces to be scanned, and thereby generating three horizontal synchronization signals sync 1, sync 2 and sync 3, respectively. That is, the horizontal synchronization detection means in this embodiment are configured such that a part of the laser light beam deflected by the polygon mirror 503 is separated by the flat glass 505, and the separated laser light beam is received by the three photodetectors 508, 509 and 510 that are arranged at the positions corresponding to three specific horizontal scan positions.

It should be noted that the positional relationships among the photodetectors 508, 509 and 510 are determined such that light path lengths L1, L3 and L2 of the laser light beams deflected by the polygon mirror 503, which are incident on the photodetectors 508, 509 and 510, respectively, become substantially identical.

The image forming apparatus further includes a pixel clock generation apparatus 520, an image processing apparatus 521, a laser drive data generation apparatus 522, and a laser drive apparatus 523. These apparatuses are the same as those corresponding apparatuses in Embodiment 3. The horizontal synchronization signals sync 1, sync 2 and sync 3 are input to the pixel clock generation apparatus 520. The horizontal synchronization signal sync 1 is also input to the image processing apparatus 521 as the line synchronization signal.

Further, the image forming apparatus according to this embodiment further includes means commonly used in image forming apparatuses of this kind. For example, charging means for charging the surface of the photoconductor 506, developing means for developing an electrostatic latent image to a toner image, transfer means for transferring the developed toner image onto a paper or an intermediate transfer medium, and cleaning means for eliminating and collecting residual toner on the photoconductor 506. However, illustration of these means is omitted.

(Embodiment 6)

Figure 32:
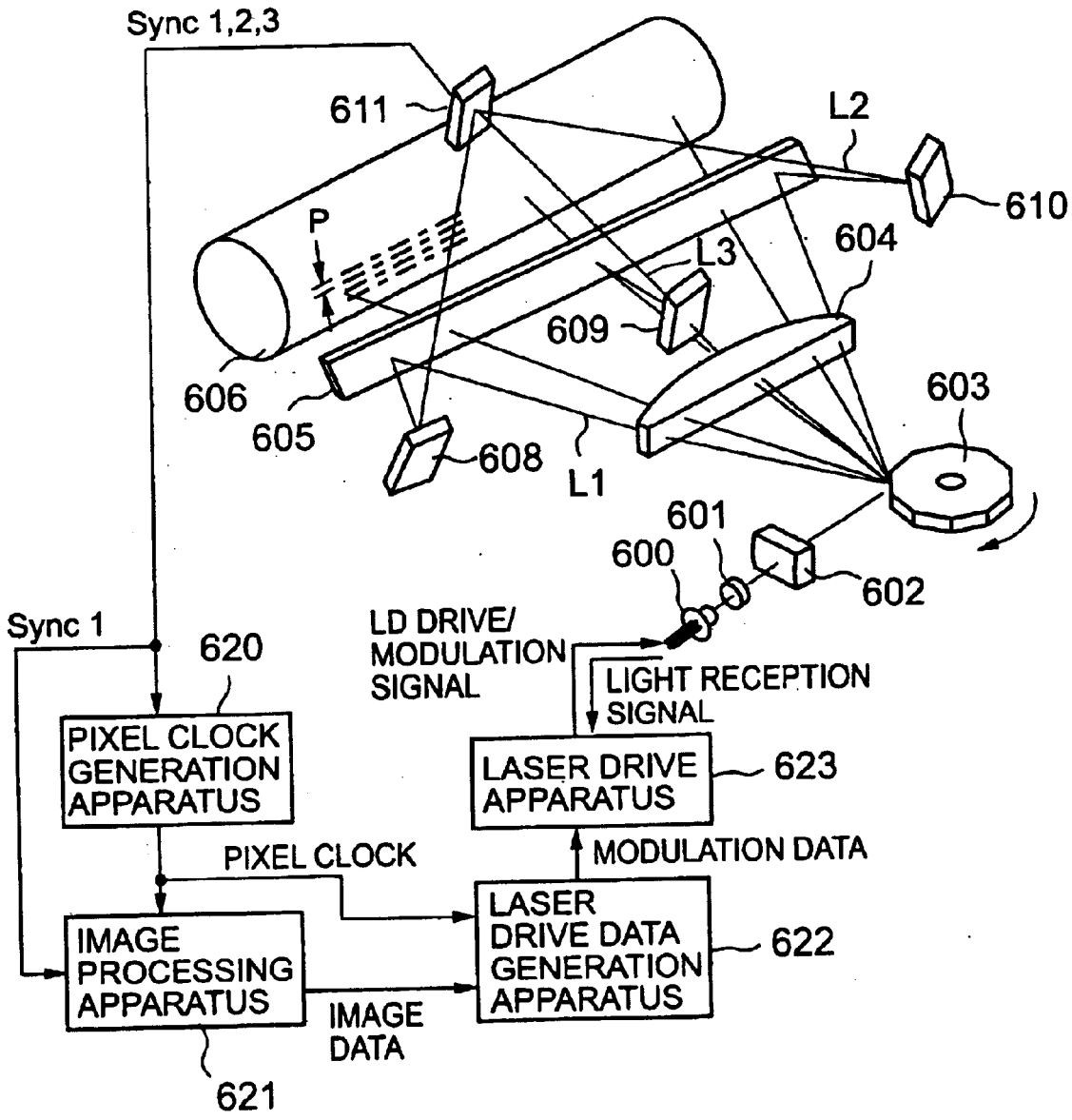
FIG. 32 is a schematic diagram of an image forming apparatus according to Embodiment 6 of the present invention.

FIG. 32 is a schematic diagram of an image forming apparatus according to Embodiment 6 of the present invention.

In the image forming apparatus, a laser light beam output from a semiconductor laser 600 is incident on a polygon mirror 603 via a collimator lens 601 and a cylinder lens 602. The laser light beam deflected by the polygon mirror 603 passes through a fθ lens 604, is transmitted through (partially reflected by) a flat glass 605, and is incident on a photoconductor 606 that is a medium to be scanned. Thereby, the laser light beam forms a light beam spot on the surface (surface to be scanned) of the photoconductor 606, and forms an image (electrostatic latent image).

The laser light beam reflected by a first surface of the flat glass 605 is further reflected by reflection members 608, 609 and 610 that are arranged in the scan direction, and then received by a photodetector 611. Thereby, three horizontal synchronization signals 1, 2 and 3 (sync 1, sync 2 and sync 3, respectively) are generated. The horizontal synchronization signals 1, 2 and 3 correspond to three positions: on the write start position side, the write end position side, and in the write region, respectively.

The positional relationships among the reflecting members 608, 609 and 610 are determined such that light path lengths L1, L2 and L3 of the laser light beams that are deflected by the polygon mirror 603 and are incident on the photodetector 611 via the reflection members 608, 609 and 610, respectively, become substantially identical. Accordingly, disagreement does not occur in the timings of the horizontal synchronization signals 1, 2 and 3 due to differences in the light path lengths L1, L2 and L3.

The image forming apparatus further includes a pixel clock generation apparatus 620, an image processing apparatus 621, a laser drive data generation apparatus 622, and a laser drive apparatus 623. These apparatuses are the same as those corresponding apparatuses in Embodiment 3. The horizontal synchronization signals sync 1, sync 2 and sync 3 are input to the pixel clock generation apparatus 620. The horizontal synchronization signal sync 1 is input also to the image processing apparatus 621 as the line synchronization signal.

The reflection members 608, 609 and 610 may be each formed by, for example, a mirror or a transparent member (made of glass, plastic, and the like) having a reflection film formed on a surface thereof. Since the cost of such a transparent member is lower than those of photodetectors, the configuration using the transparent member is more advantageous in terms of the cost than the configuration using three photodetectors. In a case where synchronization signals are detected at four or more positions, such advantage in costs becomes more significant.

The image forming apparatus according to this embodiment further includes means commonly used in image forming apparatuses of this kind. For example, charging means for charging the surface of the photoconductor 606, developing means for developing an electrostatic latent image to a toner image, transfer means for transferring the developed toner image onto a paper or an intermediate transfer medium, and cleaning means for eliminating and collecting residual toner on the photoconductor 606. However, illustration of these means is omitted.

(Embodiment 7)

Figure 33A:
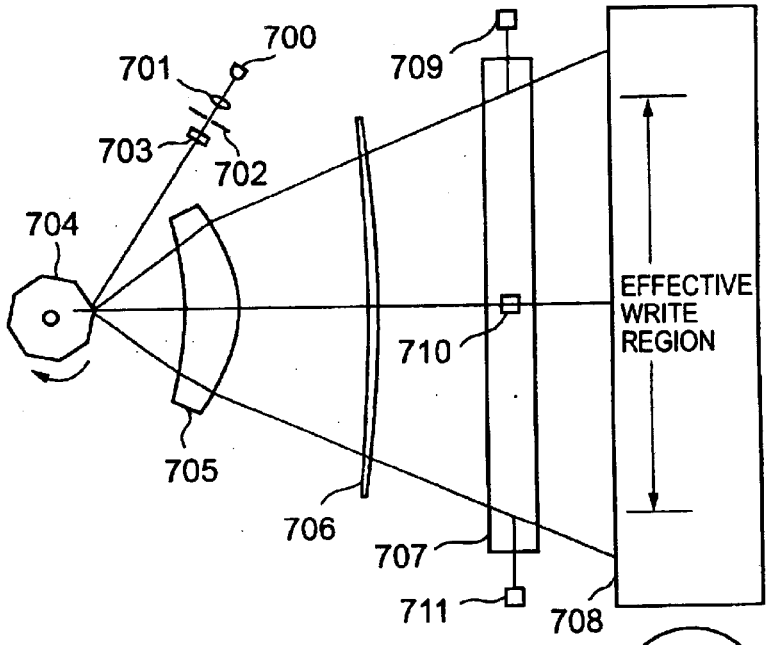
FIG. 33A is a schematic diagram showing an overhead view of an image forming apparatus according to Embodiment 7 of the present invention.
Figure 33B:
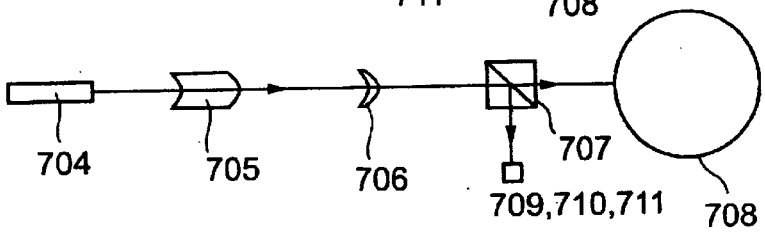
FIG. 33B is a schematic diagram showing a side view of the image forming apparatus according to Embodiment 7 of the present invention.

FIGS. 33A and 33B are schematic diagrams of an image forming apparatus according to Embodiment 7 of the present invention. FIG. 33A is a plan view of the image forming apparatus, and FIG. 33B is a side view thereof.

In the image forming apparatus, a laser light beam output from a semiconductor laser 700 is incident on a polygon mirror 704 via a collimator lens 701, a slit of an aperture 702, and a cylinder lens 703. The laser light beam deflected by the polygon mirror 704 is incident on a photoconductor 708 that is a medium to be scanned via scan lenses 705 and 706 and a beam splitter 707, forms a light beam spot on the surface (surface to be scanned) of the photoconductor 708, and forms an image (electrostatic latent image).

The beam splitter 707 is formed by joining a pair of prisms each having a right-angle triangle shape. The joint surface is a half mirror surface. The major part of the laser light beam that is incident on the beam splitter 707 is transmitted through the half mirror surface, is directed to the photoconductor 708, and contributes to image forming. A part of the incident laser light beam, however, is reflected by the half mirror surface. The reflected (separated) laser light beam is received by photodetectors 709, 710 and 711 that are arranged below the beam splitter 707. Thereby, the horizontal synchronization signals sync 1, sycn2 and sync 3 are generated.

Although not shown in FIGS. 33A and 33B, the image forming apparatus according to this embodiment also includes a pixel clock generation apparatus, an image processing apparatus, a laser drive data generation apparatus, and a laser drive apparatus that are similar to those apparatuses in Embodiment 6. In addition, the image forming apparatus according to this embodiment further includes means commonly used in image forming apparatuses of this kind. For example, charging means for charging the surface of the photoconductor 708, developing means for developing an electrostatic latent image to a toner image, transfer means for transferring the developed toner image onto a paper or an intermediate transfer medium, and cleaning means for eliminating and collecting residual toner on the photoconductor 708.

(Embodiment 8)

Figure 34A:
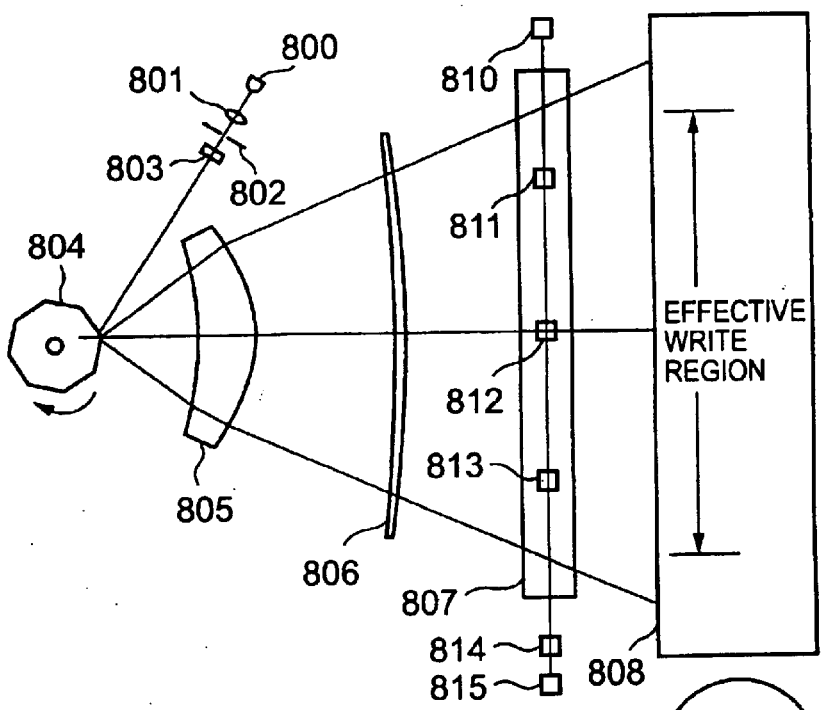
FIG. 34A is a schematic diagram showing a planar construction of an image forming apparatus according to Embodiment 8 of the present invention.
Figure 34B:
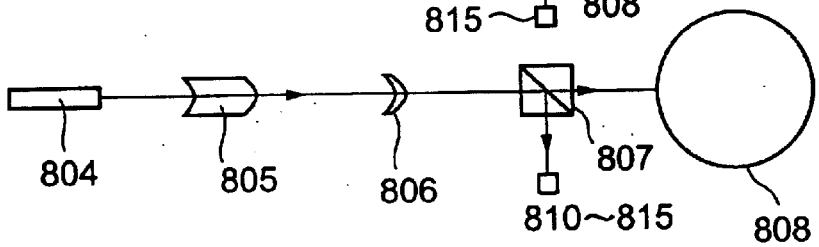
FIG. 34B is a schematic diagram showing a side view of the image forming apparatus according to Embodiment 8 of the present invention.

FIGS. 34A and 34B are schematic diagrams of an image forming apparatus according to Embodiment 8 of the present invention. FIG. 34A shows the planar construction of the image forming apparatus, and FIG. 34B shows the side construction thereof.

In the image forming apparatus, a laser light beam output from a semiconductor laser 800 is incident on a polygon mirror 804 via a collimator lens 801, a slit of an aperture 802, and a cylinder lens 803. The laser light beam deflected by the polygon mirror 804 is incident on a photoconductor 808 that is a medium to be scanned via scan lenses 805 and 806 and a beam splitter 807, forms a light beam spot on the surface (surface to be scanned) of the photoconductor 808, and forms an image (electrostatic latent image).

The beam splitter 807 is formed by joining a pair of prisms each having a right-angle triangle shape. The joint surface is a half mirror surface. The major part of the laser light beam that is incident on the beam splitter 807 is transmitted through the half mirror surface, is directed to the photoconductor 808, and contributes to image forming. A part of the incident laser light beam, however, is reflected by the half mirror surface. A reflecting member (or a reflecting/transmitting member) 810 and reflecting/transmitting members 811, 812, 813 and 814 are arranged below the beam splitter 807 as means for directing the reflected (separated) laser light beam to a photodetector 815. The laser light beam reflected by the half mirror surface is incident on the reflecting member (or the reflecting/transmitting member) 810 and the reflecting/transmitting members 811, 812, 813 and 814 when specific horizontal scan (main scan) positions, corresponding to the respective members, are scanned. The laser light beam reflected by the reflecting member (or the reflecting/transmitting member) 810 is received by the photodetector 815 by being sequentially transmitted through the reflecting/transmitting members 811, 812, 813 and 814. The laser light beam reflected by the reflecting/transmitting member 811 is received by the photodetector 815 by being sequentially transmitted through the reflecting/transmitting members 812, 813 and 814. The laser light beam reflected by the reflecting/transmitting member 812 is received by the photodetector 815 by being sequentially transmitted through the reflecting/transmitting members 813 and 814. The laser light beam reflected by the reflecting/transmitting member 813 is received by the photodetector 815 by being transmitted through the reflecting/transmitting members 814. Accordingly, it is possible to receive the laser light beam at scan timings of the five horizontal scan positions and to generate five horizontal synchronization signals.

It should be noted that the reflecting/transmitting members used in this embodiment possess both functions of reflecting and transmitting light flux. The reflecting/transmitting members are transparent members made of, for example, glass, plastic, or the like. Here, the shapes of the reflecting member (or the reflecting/transmitting member) 810 and the reflecting/transmitting members 811, 812, 813 and 814 are parallel plate shapes that allow easy control of the reflection/transmission direction of light flux. However, this is not a limitation. The costs of such reflecting member and reflecting/transmitting members are lower than those of photodetectors. Therefore, the configuration of using such reflecting member and reflecting/transmitting members (or the configuration of using the reflecting/transmitting members) is advantageous in terms of costs, compared to the configuration of using five photodetectors.

Although not shown in FIGS. 34A and 34B, the image forming apparatus according to this embodiment also includes a pixel clock generation apparatus, an image processing apparatus, a laser drive data generation apparatus, and a laser drive apparatus that are similar to those apparatuses in Embodiment 6. In addition, the image forming apparatus according to this embodiment further includes means commonly used in image forming apparatuses of this kind. For example, charging means for charging the surface of the photoconductor 808, developing means for developing an electrostatic latent image to a toner image, transfer means for transferring the developed toner image onto a paper sheet or an intermediate transfer medium, and cleaning means for eliminating and collecting residual toner on the photoconductor 808.

(Embodiment 9)

Figure 35:
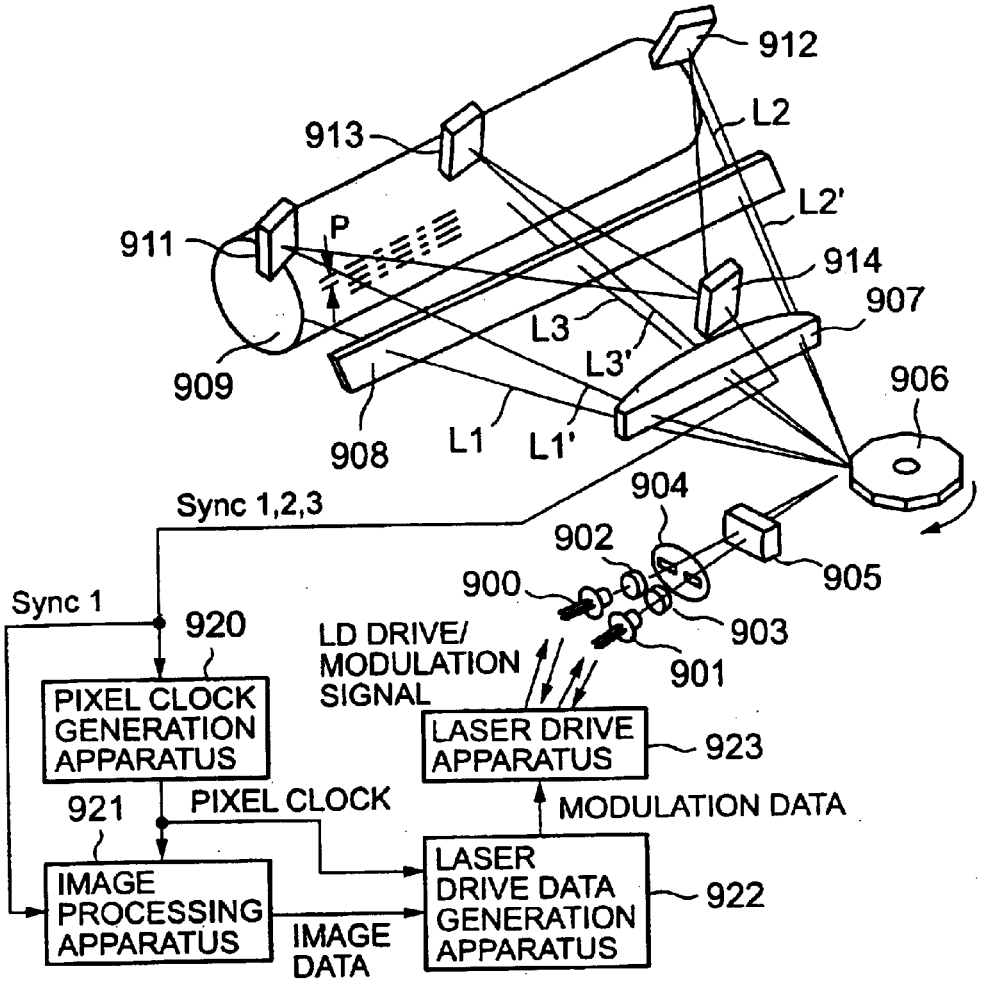
FIG. 35 is a schematic diagram of an image forming apparatus according to Embodiment 9 of the present invention.
Figure 36:
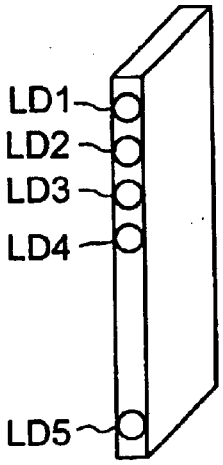
FIG. 36 is a schematic diagram showing an example of a semiconductor laser array.

FIG. 35 is a schematic diagram of an image forming apparatus according to Embodiment 9 of the present invention. The image forming apparatus includes a semiconductor laser 901 as a light beam source for reference, in addition to a semiconductor laser 900 for a light beam source for image writing.

A laser light beam output from the semiconductor laser 900 for image writing is incident on a polygon mirror 906 via a collimator lens 902, a slit of an aperture 904, and a cylinder lens 905. The laser light beam deflected by the polygon mirror 906 is incident on a photoconductor 909 via a fθ lens 907 and a transparent member 908, forms a light beam spot on the surface (surface to be scanned) of the photoconductor 909, and forms an image (electrostatic latent image).

The laser light beam output from the semiconductor laser 901 for reference is incident on the polygon mirror 906 via a collimator lens 903, a slit of an aperture 904, and the cylinder lens 905.

The laser light beam from the semiconductor laser 901 for reference and the laser light beam from the semiconductor laser 901 for image writing are incident on the same reflection surface of the polygon mirror 906. The laser light beam for reference and the laser light beam for image writing are incident on the same position with respect to the main scan direction. With respect to the sub-scan direction, however, the above-mentioned laser light beams are incident on positions spaced with an interval. As a result, the laser light beam for reference deflected by the polygon mirror 906 passes through the fθ lens 907 and the transparent member 908, but is not incident on the photoconductor 909. Accordingly, it is possible to make the semiconductor laser 901, serving as the light beam source for reference, to emit light irrespective of image data.

A surface to be detected, which is separated from the photoconductor 909 and is at the position equivalent to the surface to be scanned of the photoconductor 909 that is scanned by the laser light beam for image writing, is scanned by the laser light beam for reference. The horizontal synchronization signals 1, 2 and 3 (sync 1, sync 2, and sync 3) are obtained by receiving, by a photodetector 914, the laser light beam for reference reflected by the reflecting members 911, 912 and 913. The reflecting members 911, 912 and 913 are arranged on the surface to be detected and at positions corresponding to three specific horizontal scan positions.

The positional relationships among the reflecting members 911, 912 and 913 are determined such that light path lengths L1', L2' and L3' of the laser light beams that are output from the semiconductor laser 901 for reference and received by the photodetector 914 via the reflecting members 911, 912 and 913, respectively, become substantially identical.

Referring to FIG. 35, the image forming apparatus according to this embodiment further includes a pixel clock generation apparatus 920, an image processing apparatus 921, a laser drive data generation apparatus 922, and a laser drive apparatus 923. The laser drive apparatus 923 drives the semiconductor laser 900 for image writing based on image data and drives the semiconductor laser 901 for reference as well.

The pixel clock generation apparatus 920 can perform real-time control as follows so as to generate the three horizontal synchronization signals 1, 2 and 3 in each line during an image recording period. That is, the pixel clock generation apparatus 920 measures the time interval between the horizontal synchronization signals 1 and 2 and that between the horizontal synchronization signals 2 and 3 in each line during the image recording period, and reflects the differences between the time intervals and respective target values thereof to phase control of the pixel clock PCLK for the next line.

The image forming apparatus according to this embodiment further includes means commonly used in image forming apparatuses of this kind. For example, charging means for charging the surface of the photoconductor 909, developing means for developing an electrostatic latent image to a toner image, transfer means for transferring the developed toner image onto a paper or an intermediate transfer medium, and cleaning means for eliminating and collecting residual toner on the photoconductor 909. However, illustration of these means is omitted.

Instead of using the semiconductor lasers 900 and 901, it is also possible to use a semiconductor laser array formed by a plurality of semiconductor lasers LD 1, LD 2, LD 3 and LD 4 for image writing and a semiconductor laser LD 5 for reference arranged separately from the other semiconductor lasers. The present invention also includes an image forming apparatus having such a configuration. When such a semiconductor laser array is used as a light beam source, it is possible to write four lines simultaneously by using four laser light beams. Since it is easy to reduce the differences among the emission wavelengths of the semiconductor lasers LD 1 through LD 5, it is possible to decrease errors or variations in scan positions caused by differences among the wavelengths of the light beam sources.

(Embodiment 10)

Figure 37:
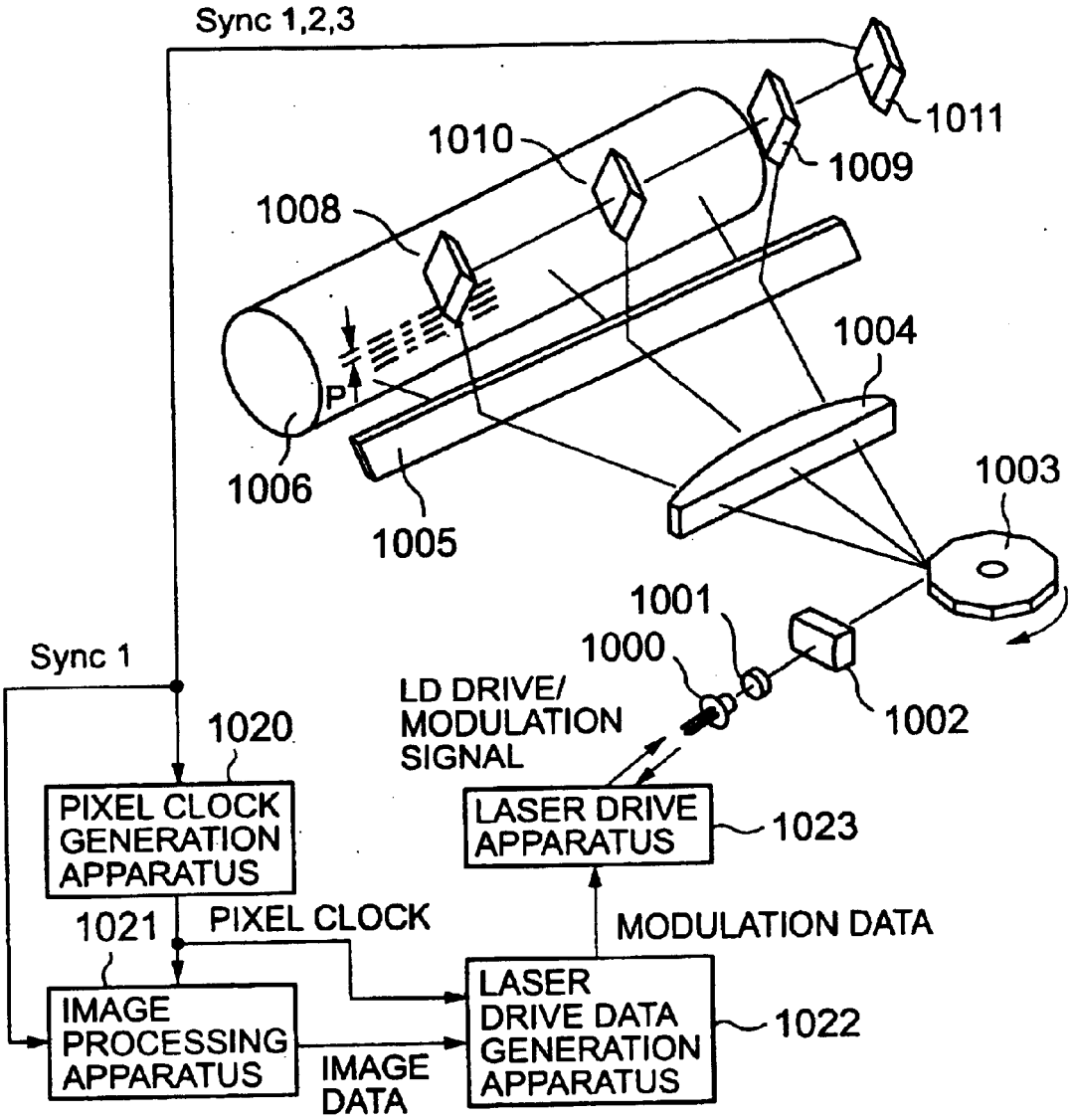
FIG. 37 is a schematic diagram of an image forming apparatus according to Embodiment 10 of the present invention.

FIG. 37 is a schematic diagram of an image forming apparatus according to Embodiment 10 of the present invention. A laser light beam output from a semiconductor laser 1000 is incident on a polygon mirror 1003 via a collimator lens 1001 and a cylinder lens 1002. The laser light beam deflected by the polygon mirror 1003 passes through a fθ lens 1004, is transmitted through (is partially reflected by) a flat glass 1005, and is incident on a photoconductor 1006. The incident laser light beam forms a light beam spot on the surface (surface to be scanned) of the photoconductor 1006, and forms an image (electrostatic latent image).

The laser light beam reflected (separated) by a first surface of the flat surface 1005 is incident on a reflecting member (or reflecting/transmitting member) 1008 and reflecting/transmitting members 1009 and 1010 that are arranged at positions corresponding to three specific horizontal scan positions. The laser light beam reflected by the reflecting member (or reflecting/transmitting member) 1008 is transmitted through the reflecting/transmitting members 1010 and 1009 and received by a photodetector 1011. The laser light beam reflected by the reflecting/transmitting member 1010 is transmitted through the reflecting/transmitting members 1009 and received by the photodetector 1011. The laser light beam reflected by the reflecting/transmitting member 1009 is directly received by the photodetector 1011. In this manner, by receiving the laser light beam reflected by the first surface of the flat glass 1005 by the photodetector 1011 via the above-mentioned members arranged at the three positions in the horizontal scan direction, the horizontal synchronization signals sync 1, sync 2 and sync 3 are generated. Such horizontal synchronization detection means are more advantageous in terms of costs than the configuration using three photodetectors, since the costs of the reflecting members are lower than those of photodetectors. When synchronization signals are detected at four or more positions, such advantage in terms of costs become more significant.

The image forming apparatus according to this embodiment also includes a pixel clock generation apparatus 1020, an image processing apparatus 1021, a laser drive data generation apparatus 1022, and a laser drive apparatus 1023.

In addition, the image forming apparatus according to this embodiment further includes means commonly used in image forming apparatuses of this kind. For example, charging means for charging the surface of the photoconductor 1006, developing means for developing an electrostatic latent image to a toner image, transfer means for transferring the developed toner image onto a paper or an intermediate transfer medium, and cleaning means for eliminating and collecting residual toner on the photoconductor 1006. However, illustration of these means is omitted.

(Embodiment 11)

Figure 38:
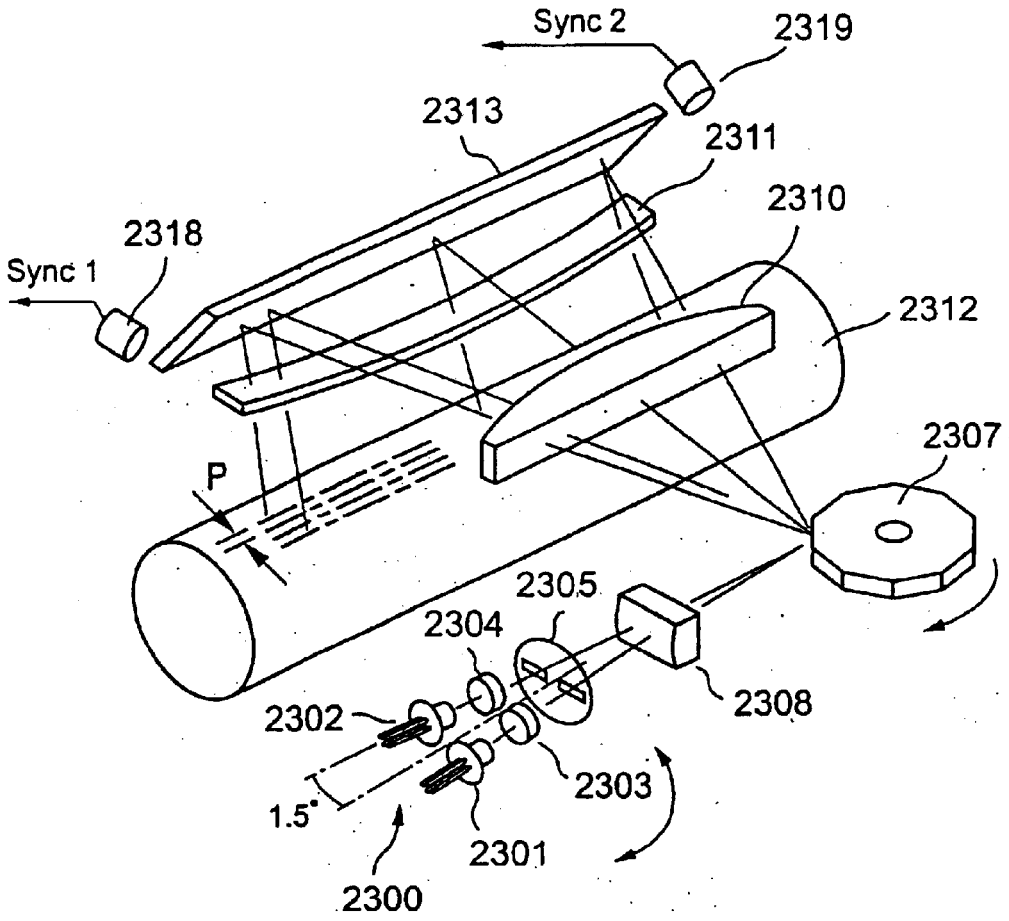
FIG. 38 is a schematic diagram of an image forming apparatus according to Embodiment 11 of the present invention.

FIG. 38 is a schematic diagram of a multi-beam scan type image forming apparatus according to Embodiment 11 of the present invention. It should be noted that illustration of the following apparatuses is omitted: a pixel clock generation apparatus, an image forming apparatus, a laser drive data generation apparatus, and a laser drive apparatus. In addition, illustration of means commonly used in image forming apparatuses of this kind is also omitted. For example, charging means for charging the surface of a photoconductor, developing means for developing an electrostatic latent image to a toner image, transfer means for transferring the developed toner image onto a paper or an intermediate transfer medium, and cleaning means for eliminating and collecting residual toner on the photoconductor.

The image forming apparatus according to this embodiment includes a light beam source unit 2300 that emits four laser light beams. The light beam source unit 2300 is formed by a group of a semiconductor laser array 2301 having two light emitting sources and a collimator lens 2303, a group of a semiconductor laser array 2302 having two light emitting sources and a collimator lens 2304, and an aperture 2305.

Figure 39:
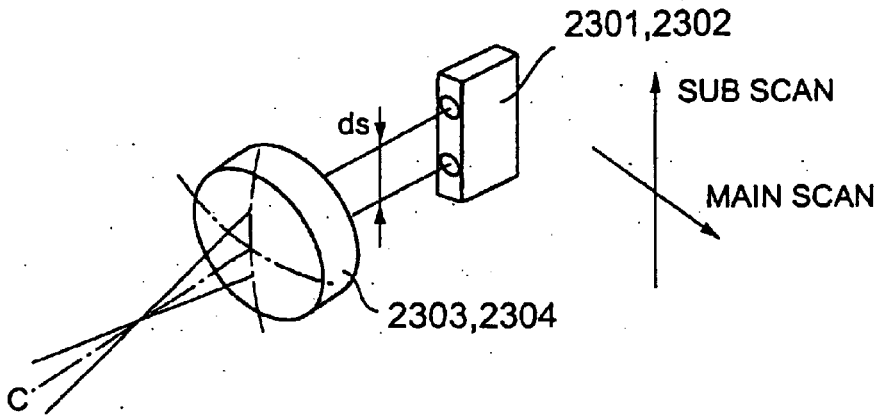
FIG. 39 is a schematic diagram for explaining the semiconductor laser array shown in FIG. 38.

As shown in FIG. 39, each of the semiconductor laser arrays 2301 and 2302 is monolithically formed such that the interval ds between the two light beam sources is ds=25 $\mu$m. In the semiconductor laser arrays 2301 and 2302, the two light beam sources are arranged symmetrically with respect to an optical axis C of the collimator-lenses 2303 and 2304, respectively, in the sub-scan direction.

Referring to FIG. 38, the semiconductor laser arrays 2301 and 2302 are laid out such that their optical axes match those of the collimator lenses 2303 and 2304, respectively, i.e., their angles of exit are symmetric with respect to the main scan direction, and their axes of emission cross at a reflection point on a polygon mirror 2307. A plurality of beams emitted from each of the semiconductor laser arrays 2301 and 2302 are deflected by the same reflection surface of the polygon mirror 2307 via a cylinder lens 2308. The reflected beams form beam spots on a photoconductor 2312 via a fθ lens 2310, a mirror 2313, and a toroidal lens 2311, thereby forming an electrostatic latent image on the photoconductor 2312. The four light beam sources in total of the semiconductor laser arrays 2301 and 2302 are each driven in accordance with image data for one line. Hence, the electrostatic latent image is written by four lines simultaneously.

Referring to FIG. 38, the image forming apparatus also includes photodetectors 2318 and 2319 for generating horizontal synchronization signals sync 1 and sync 2, respectively. Similar to each of the above-described embodiments, generated horizontal synchronization signals sync 1 and sync 2 are input to the pixel clock generation apparatus (not shown), and the horizontal synchronization signal sync 1 generated by the photodetector 2318 that is provided on the scan start side is also input to the image processing apparatus (not shown).

Figure 40:
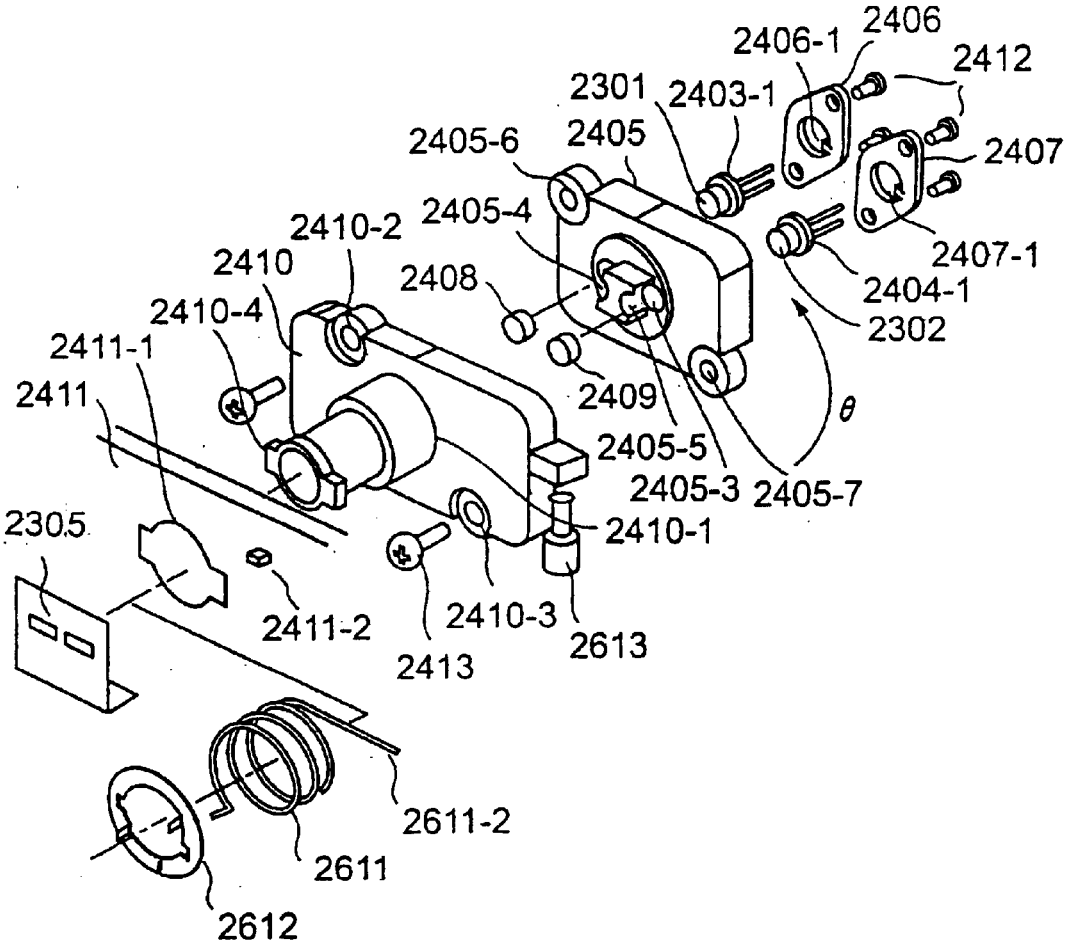
FIG. 40 is an exploded perspective view for explaining an exemplary embodiment of the specific structure of a light beam source unit shown in FIG. 38.

FIG. 40 is an exploded perspective view for explaining an exemplary embodiment of a specific structure of the light beam source unit 2300. Each of the semiconductor laser arrays 2301 and 2302 is formed as follows. Cylindrical heatsink parts 2403-1 and 2404-1 fit into respective fitting openings (not shown) formed on the backside of a base member 2405. The base member 2405 is inclined at a predetermined angle (in this embodiment, approximately 1.5°) in the main scan direction. Protrusions 2406-1 and 2407-1 of press members 2406 and 2407 are engaged with corresponding notches of the heatsink parts 2403-1 and 2404-1, respectively, so that the arranging directions of the light beam sources are aligned. The press members 2406 and 2407 are fixed by screws 2412 from the backside. The collimator lenses 2303 and 2304 are positioned and attached to the base member such that the peripheries of the collimator lenses 2303 and 2304 abut semicircular mounting guide surfaces 2405-4 and 2405-5, respectively, so that the directions of the optical axes are adjusted and diverging beams emitted from the light beam sources become parallel rays.

In this embodiment, as mentioned above, optical beams from the respective semiconductor laser arrays 2301 and 2302 are set to cross in a main scan surface (plane). For this reason, the fitting openings and the semicircular mounting guide surfaces 2405-4 and 2405-5 are formed with an inclination. The base member 2405 is fixed to a holder member 2410 such that a cylindrical engaging part 2405-3 is engaged with the holder member 2410, and screws 2413 are fit into and screwed into screw holes 2405-6 and 2405-7 via through-holes 2410-2 and 2410-3.

In the light beam source unit 2300, a cylindrical part 2410-1 of the holder member 2410 is fit into a reference hole 2411-1 of a mounting wall 2411 of an optical housing. A spring 2611 is inserted into the cylindrical part 2410-1 from the front side thereof, and a stopper member 2612 is engaged with protrusions 2410-4 of the cylindrical part 2410-1. Thereby, the holder member 2410 is pressed against to the backside of the mounting wall 2411. On this occasion, torque having the center line of the cylindrical part 2410-1 as the rotational axis is generated by hooking one end 2611-2 of the spring 2611 under a protrusion 2411-2. With an adjusting screw 2613 provided to work against (lock) the torque the turning force, the unit is rotated for θ degrees about the optical axis, and each of the beam spot lines are adjusted such that they are arranged alternately by shifting for one line. The aperture 2305 is provided with slits corresponding to the semiconductor laser arrays 2301 and 2302. The aperture 2305 is mounted to the optical housing and defines the diameter of emission of the optical beams.

(Embodiment 12)

Figure 41:
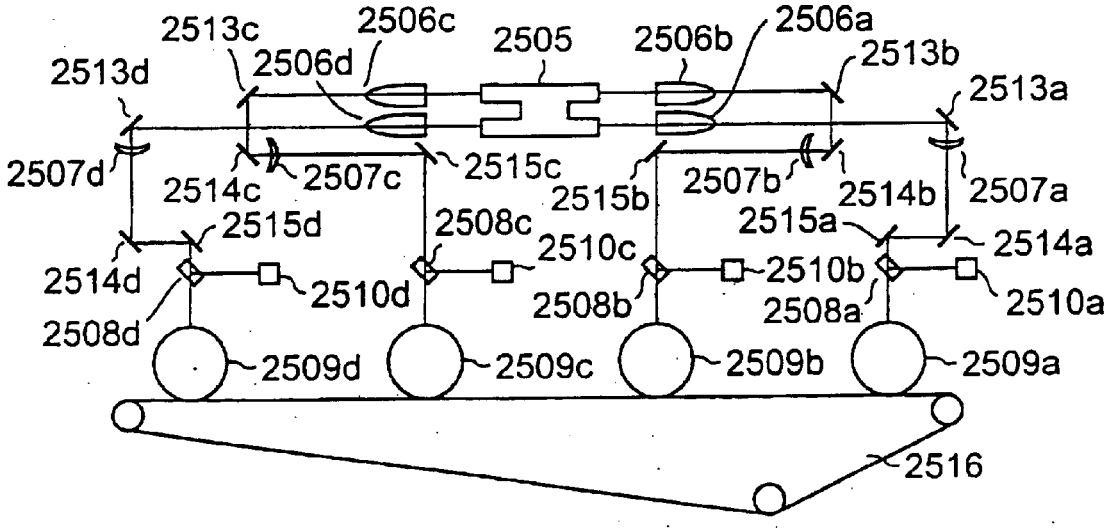
FIG. 41 is a schematic diagram of an image forming apparatus according to Embodiment 12 of the present invention.

FIG. 41 is a schematic diagram for explaining an image forming apparatus according to Embodiment 12 of the present invention.

The image forming apparatus according to this embodiment is a tandem-type image forming apparatus using different photoconductors 2509*a*, 2509*b*, 2509*c*, and 2509*d* for image forming of respective colors (cyan, magenta, yellow, black).

In such a tandem-type image forming apparatus, a photoconductor in each color station is scanned by a laser light beam having a different light path. Hence, main scan dot position shift occurring on a photoconductor possess a different characteristic from station to station. Accordingly, good image quality, especially, good color reproducibility, cannot be obtained unless main scan dot position shift is performed with precision in each color station. For example, when dot shifts of about several tens of micrometers occur among the color stations, by correcting the main scan dot position shifts by performing phase shift on pixel clocks having an amount of main scan dot position shift more than a ⅛ dot, it is possible to reduce the amount of the dot position shifts to approximately 2.6 μm (21.2 μM/8), which corresponds to a ⅛ dot in 1200 dpi.

In FIG. 41, 2505 indicates a polygon mirror. Laser light beams output from light beam sources of the respective color stations are simultaneously incident on different reflection surfaces of the polygon mirror 2505 via an optical system, such as a collimator lens and a cylinder lens.

A description will be given of the color station including the photoconductor 2509*a*. A laser light beam deflected by the polygon mirror 2505 scans the photoconductor 2509*a* via a first scan lens 2506*a*, a mirror 2513*a*, a second scan lens 2507*a*, mirrors 2514*a* and 2515*a*, and a beam splitter 2508*a*, thereby forming an electrostatic latent image. A part of the laser light beam reflected by a half mirror surface of the beam splitter 2508*a* is detected by a photodetector 2510*a* for horizontal synchronization detection. The other color stations of the other respective colors are structured similarly, as is obvious from FIG. 41. Thus, a description thereof is omitted.

In addition to the horizontal synchronization detection means as mentioned above, the image forming apparatus according to this embodiment also includes, in each color station, a pixel clock generation apparatus of the present invention and other means relating to driving of the laser light beam source. However, those means other than the horizontal synchronization detection means are not shown in FIG. 41. The laser light beam source of each of the color stations is driven in synchronization with a pixel clock that is generated by a corresponding pixel clock generation apparatus.

Around each of the photoconductors 2509*a*, 2509*b*, 2509*c* and 2509*d*, there are provided means for uniformly charging the surface of the photoconductor, means for developing an electrostatic latent image on the photoconductor to toner images of the corresponding colors, means for transferring the developed toner images onto a transfer medium 2516, means for eliminating and collecting residual toner on the photoconductor, means for superposing and transferring the toner images of the respective colors on the transfer medium 2516 onto a paper, means for fixing the toner image on the paper, and the like. However, illustration of these means is omitted.

With an image forming apparatus according to this embodiment, main scan dot position shift in each color station is corrected with a high degree of accuracy, and thus, out of color registration is effectively corrected. Hence, it is possible to form a color image of good color reproducibility and high quality.

According to the present invention, it is possible to achieve the following effects and the like.

According to one aspect of the present invention, it is possible to correct main scan dot position shift caused by, for example, environmental variation and characteristics of the scanning optical system of the image forming apparatus with a high degree of accuracy. Hence, it is possible to form an image of high quality. It is also easy to respond to a difference in characteristics of the scanning optical system of an image forming apparatus merely by changing the lookup table. Further, it is unnecessary to make the frequency of the high frequency clock for generating the pixel clock PCLK extremely high as compared to the frequency of the pixel clock PCLK. This is a great advantage in terms of technique and cost for realizing the pixel clock generation apparatus.

Also, according to another aspect of the present invention, it is possible to detect variation in scan time by dividing a scan line into two or more regions, and to perform phase control of the pixel clock PCLK in accordance with the scan time variation in each region. Therefore, it is possible to perform correction of the main scan dot position shift with a higher degree of accuracy, compared to a case where the phase control of the pixel clock PCLK is performed in accordance with variation in scan time of the entire scan line.

In addition, according to another aspect of the present invention, it is possible to reduce the size (amount of data) of the lookup table for storing the phase shift data of the pixel clock PCLK.

Additionally, according to another aspect of the present invention, even if there are great differences in characteristics of the main scan dot position shifts according to scan regions (data areas), it is possible to perform correction of the main scan dot position shift with a high degree of accuracy by selecting and using a lookup table suitable for each region.

Further, according to another aspect of the present invention, it is possible to prevent occurrence of visual image variation (nonuniformity) caused by correction of the positions of consecutive dots on a scan line.

In addition, according to another aspect of the present invention, occurrence of a periodic scan variation is less than that in a case where the positions of dots are corrected with a constant interval.

According to another aspect of the present invention, it is possible to perform correction of the main scan dot position shift with a high degree of accuracy from an image height having a great variation in the amount of the main scan dot position shift to an image height having a small variation in the amount of the main scan dot position shift.

Additionally, according to another aspect of the present invention, it is possible to perform dot position correction at a constant rate irrespective of the resolution.

In addition, according to another aspect of the present invention, it is possible to avoid occurrence of vertical line-like noise and the like that tend to be conspicuous when the dot position correction according to an identical phase shift data pattern is performed on consecutive scan lines. Also, according to the present invention, a plurality of lookup tables need be provided only for the effective scan region having direct influence on the quality of an image. Hence, it is possible to reduce the numbers and the size of the lookup tables.

Further, according to another aspect of the present invention, it is possible for only one photodetector for horizontal synchronization detection to be used. Thus, there is advantage in terms of cost especially when a great number of horizontal synchronization signals are needed.

Additionally, according to another aspect of the present invention, horizontal synchronization is detected by the light beam for reference that is not modulated by image data. Hence, it is possible to positively generate three or more horizontal synchronization signals even in a scan line on which an image is being formed. Accordingly, it is possible to perform "real-time" pixel clock phase control according to scan time variation in an interval between each adjacent two of three or more horizontal synchronization signals.

In addition, according to another aspect of the present invention, it is possible to correct horizontal dot position shift for each color with a high degree of accuracy. Accordingly, out of color registration can also be corrected effectively. Hence, it is possible to form a color image of good color reproduction and high quality.

The present invention is not limited to the specifically disclosed embodiments, and variations and modifications may be made without departing from the scope of the present invention.

The present application is based on Japanese priority applications No. 2002-277742 filed on Sep. 24, 2002 and No. 2003-286608 filed on Aug. 5, 2003, the entire contents of which are hereby incorporated by reference.

What is claimed is:

1. A pixel clock generation apparatus, comprising:

a detecting circuit a time interval between two horizontal synchronization signals;

a comparing part comparing the time interval detected by said detecting circuit and a target value, and outputting a difference therebetween;

a phase shift data generation part having a lookup table storing a pattern of phase shift data for controlling a phase shift amount of a pixel clock, and reading and outputting the phase shift data from the lookup table based on the difference that is output from said comparing part;

a high frequency clock generation part generating a high frequency clock; and a pixel clock generation part generating the pixel clock whose phase is controlled in accordance with the phase shift data that are output from said phase shift data generating part based on the high frequency clock that is generated by said high frequency clock generating part.

2. The pixel clock generation apparatus as claimed in claim 1, wherein phase control of the pixel clock is performed on each data area, where one data area is formed by a plurality of consecutive pixel clocks.

3. The pixel clock generation apparatus as claimed in claim 1, wherein the phase shift data generating part stores a plurality of the lookup tables, and the lookup tables from which the phase shift data are read are switched within one scan line period.

4. The pixel clock generation apparatus as claimed in claim 1, wherein the pixel clocks subjected to phase shift are spaced substantially equally.

5. The pixel clock generation apparatus as claimed in claim 4, wherein the phase shift data generation part includes a unit that sets an interval between the pixel clocks subjected to the phase shift to a value obtained by multiplying a reference value by a multiplying factor for correction corresponding to a resolution.

6. The pixel clock generation apparatus as claimed in claim 1, wherein the pixel clocks subjected to phase shift are spaced unequally.

7. The pixel clock generation apparatus as claimed in claim 1, wherein, in an image height region having a great variation of a main scan dot position shift, an interval between the pixel clocks subjected to phase shift is decreased compared to in an image height region having a small variation of the main scan dot position shift.

8. The pixel clock generation apparatus as claimed in claim 1, wherein the phase shift data generation part switches, for each scan line, a plurality of the lookup tables from which the phase shift data are read.

9. The pixel clock generation apparatus as claimed in claim 1, wherein, when there are consecutive scan lines to which the phase shift data of an identical pattern are output, the phase shift data generation part varies the pattern of the phase shift data.

10. The pixel clock generation apparatus as claimed in claim 1, wherein, when there are consecutive scan lines to which the phase shift data of an identical pattern are output, the phase shift data generation part varies the pattern of the phase shift data by switching a plurality of the lookup tables.

11. The pixel clock generation apparatus as claimed in claim 10, wherein a pattern of the phase shift data after the switching of the lookup tables is such that the pixel clock in a substantially middle position of the pixel clocks subjected to phase shift by a pattern of the phase shift data before the switching of the lookup tables is subjected to phase shift.

12. The pixel clock generation apparatus as claimed in claim 10, wherein a pattern of the phase shift data after the switching of the lookup tables is such that the pixel clock at a position that is shifted for a constant number of clocks from the pixel clock subjected to phase shift in a pattern of the phase shift data before the switching of the lookup tables is subjected to phase shift.

13. The pixel clock generation apparatus as claimed in claim 10, wherein, when there are N ($N \geqq 2$) consecutive scan lines to which the phase shift data of an identical pattern are output, the phase shift data generation part varies the pattern of the phase shift data by switching the lookup tables in the next scan line.

14. The pixel clock generation apparatus as claimed in claim 10, wherein the switching of the lookup tables in a case where there are the consecutive scan lines to which the phase shift data of an identical pattern is output is performed only in an effective scan region of the scan line where image forming is performed.

15. A pixel clock generation apparatus, comprising:

a detecting circuit detecting a time interval between each two adjacent horizontal synchronization signals among three or more of the horizontal synchronization signals;

a comparing part comparing each time interval detected by said detecting circuit with a target value and outputting each difference therebetween;

a phase shift data generation part having at least one lookup table storing a pattern of phase shift data for controlling a phase shift amount of a pixel clock, and reading and outputting the phase shift data from the lookup table based on each difference that is output from said comparing part;

a high frequency clock generation part generating a high frequency clock; and a pixel clock generation part generating a pixel clock whose phase is controlled in accordance with the phase shift data that are output from said phase shift data generating part based on the high frequency clock that is generated by said high frequency clock generating part.

16. The pixel clock generation apparatus as claimed in claim 15, wherein phase control of the pixel clock is performed on each data area, where one data area is formed by a plurality of consecutive pixel clocks.

17. The pixel clock generation apparatus as claimed in claim 15, wherein the phase shift data generating part stores a plurality of the lookup tables, and the lookup tables from which the phase shift data are read are switched within one scan line period.

18. The pixel clock generation apparatus as claimed in claim 15, wherein the pixel clocks subjected to phase shift are spaced substantially equally.

19. The pixel clock generation apparatus as claimed in claim 18, wherein the phase shift data generation part includes a unit that sets an interval between the pixel clocks subjected to the phase shift to a value obtained by multiplying a reference value by a multiplying factor for correction corresponding to a resolution.

20. The pixel clock generation apparatus as claimed in claim 15, wherein the pixel clocks subjected to phase shift are spaced unequally.

21. The pixel clock generation apparatus as claimed in claim 15, wherein, in an image height region having a great variation of a main scan dot position shift, an interval between the pixel clocks subjected to phase shift is decreased compared to in an image height region having a small variation of the main scan dot position shift.

22. The pixel clock generation apparatus as claimed in claim 15, wherein the phase shift data generation part switches, for each scan line, a plurality of the lookup tables from which the phase shift data are read.

23. The pixel clock generation apparatus as claimed in claim 15, wherein, when there are consecutive scan lines to which the phase shift data of an identical pattern are output, the phase shift data generation part varies the pattern of the phase shift data.

24. The pixel clock generation apparatus as claimed in claim 15, wherein, when there are consecutive scan lines to which the phase shift data of an identical pattern are output, the phase shift data generation part varies the pattern of the phase shift data by switching a plurality of the lookup tables.

25. The pixel clock generation apparatus as claimed in claim 24, wherein a pattern of the phase shift data after the switching of the lookup tables is such that the pixel clock in a substantially middle position of the pixel clocks subjected to phase shift by a pattern of the phase shift data before the switching of the lookup tables is subjected to phase shift.

26. The pixel clock generation apparatus as claimed in claim 24, wherein a pattern of the phase shift data after the switching of the lookup tables is such that a pixel clock at a position that is shifted for a constant number of clocks from a pixel clock subjected to phase shift in a pattern of the phase shift data before the switching of the lookup tables is subjected to the phase shift.

27. The pixel clock generation apparatus as claimed in claim 24, wherein, when there are N ($N \geqq 2$) consecutive scan lines to which the phase shift data of an identical pattern are output, the phase shift data generation part varies the pattern of the phase shift data by switching the lookup tables in the next scan line.

28. The pixel clock generation apparatus as claimed in claim 24, wherein the switching of the lookup tables in a case where there are the consecutive scan lines to which the phase shift data of an identical pattern is output is performed only in an effective scan region of the scan line where image forming is performed.

29. A pixel clock generation method, comprising the steps of:

detecting a time interval between two horizontal synchronization signals;

reading phase shift data from a lookup table based on a difference between the detected time interval and a target value; and controlling phase of a pixel clock in accordance with the phase shift data.

30. A pixel clock generation method, comprising the steps of:

detecting a time interval between each two adjacent horizontal synchronization signals among three or more of the horizontal synchronization signals;

reading phase shift data from a lookup table based on each difference between the detected time interval and a target value; and controlling phase of a pixel clock in accordance with the phase shift data.

31. An image forming apparatus, comprising:

a medium to be scanned;

a light beam source outputting a light beam;

a deflecting part deflecting the light beam output from said light beam source so that the deflected light beam scans said medium to be scanned and forms an image on said medium to be scanned;

a pixel clock generation apparatus generating a pixel clock; and a horizontal synchronization detector detecting scan timings at which the light beam scans two or more specific horizontal scan positions, so as to generate two or more horizontal synchronization signals supplied to said pixel clock generation apparatus, said pixel clock generation apparatus including:

a detecting circuit detecting a time interval between two of the horizontal synchronization signals;

a comparing part comparing the time interval detected by said detecting circuit and a target value, and outputting a difference therebetween;

a phase shift data generation part having a lookup table storing a pattern of phase shift data for controlling a phase shift amount of the pixel clock, and reading and outputting the phase shift data from the lookup table based on the difference that is output from said comparing part;

a high frequency clock generation part generating a high frequency clock; and a pixel clock generation part generating the pixel clock whose phase is controlled in accordance with the phase shift data that are output from said phase shift data generating part based on the high frequency clock that is generated by said high frequency clock generating part, wherein said light beam source is driven in synchronization with the pixel clock generated by said pixel clock generation apparatus.

32. The image forming apparatus as claimed in claim 31, wherein the horizontal synchronization detector consists of a unit separating a part of the light beam deflected by the deflecting part, and two or more photodetectors receiving the light beam separated by said unit and arranged at respective positions corresponding to the two or more specific horizontal scan positions.

33. The image forming apparatus as claimed in claim 31, wherein the horizontal synchronization detector consists of a unit separating a part of the light beam deflected by the deflecting part, two or more reflecting members arranged at respective positions corresponding to the specific horizontal scan positions, the light beam separated by said unit being incident on said reflecting members, and a photodetector receiving the light beam reflected by the reflecting members.

34. The image forming apparatus as claimed in claim 31, wherein the horizontal synchronization detector consists of a unit separating a part of the light beam deflected by the deflecting part, a reflecting member and one or more reflecting/transmitting members arranged at respective positions corresponding to the specific horizontal scan positions, the light beam separated by said unit being incident on said reflecting member and said one or more reflecting/transmitting members, and a photodetector receiving the light beam reflected by the reflecting member and said one or more reflecting/transmitting members.

35. The image forming apparatus as claimed in claim 31, wherein the horizontal synchronization detector consists of a unit separating a part of the light beam deflected by the deflecting part, two or more reflecting/transmitting members arranged at respective positions corresponding to the specific horizontal scan positions, the light beam separated by said unit being incident on said reflecting/transmitting members, and a photodetector receiving the light beam reflected by said reflecting/transmitting members.

36. The image forming apparatus as claimed in claim 31, further comprising:

a light beam source for reference, wherein a light beam for reference output from said light beam source for reference is incident on the deflecting part, and the light beam for reference deflected by the deflecting part scans outside of the medium to be scanned, and wherein the horizontal synchronization detector consists of two or more photodetectors receiving the light beam for reference deflected by the deflecting part, and are arranged at respective positions corresponding to the specific horizontal scan positions.

37. The image forming apparatus as claimed in claim 31, further comprising:

a light beam source for reference, wherein a light beam for reference output from said light beam source for reference is incident on the deflecting part, and the light beam for reference deflected by the deflecting part scans outside of the medium to be scanned, and wherein the horizontal synchronization detector consists of two or more reflecting members arranged at respective positions corresponding to the specific horizontal scan positions, the light beam for reference deflected by the deflecting part being incident on said reflecting members, and a photodetector receiving the light beam for reference reflected by said more reflecting members.

38. An image forming apparatus, comprising:

a medium to be scanned;

a light beam source outputting a light beam;

a deflecting part deflecting the light beam output from said light beam source so that the deflected light beam scans said medium to be scanned and forms an image on said medium to be scanned;

a pixel clock generation apparatus generating a pixel clock; and a horizontal synchronization detector detecting scan timings at which the light beam scans two or more specific horizontal scan positions, so as to generate two or more horizontal synchronization signals supplied to said pixel clock generation apparatus, said pixel clock generation apparatus including:

a detecting circuit detecting a time interval between each two adjacent horizontal synchronization signals among three or more of the horizontal synchronization signals;

a comparing part comparing each time interval detected by said detecting circuit with a target value and outputting each difference therebetween;

a phase shift data generation part having one or more lookup tables each storing a pattern of phase shift data for controlling a phase shift amount of a pixel clock, and reading and outputting the phase shift data from one of the lookups table based on each difference that is output from said comparing part;

a high frequency clock generation part generating a high frequency clock; and a pixel clock generation part generating a pixel clock whose phase is controlled in accordance with the phase shift data that are output from said phase shift data generating part based on the high frequency clock that is generated by said high frequency clock generating part, wherein said light beam source is driven in synchronization with the pixel clock generated by said pixel clock generation apparatus.

39. The image forming apparatus as claimed in claim 38, wherein the horizontal synchronization detector consists of a unit separating part of the light beam deflected by the deflecting part, and two or more photodetectors receiving the light beam separated by said unit and arranged at respective positions corresponding to the specific horizontal scan positions.

40. The image forming apparatus as claimed in claim 38, wherein the horizontal synchronization detector consists of a unit separating a part of the light beam deflected by the deflecting part, two or more reflecting members arranged at respective positions corresponding to the specific horizontal scan positions, the light beam separated by said unit being incident on said reflecting members, and a photodetector receiving the light beam reflected by the reflecting members.

41. The image forming apparatus as claimed in claim 38, wherein the horizontal synchronization detector consists of a unit separating a part of the light beam deflected by the deflecting part, a reflecting member and one or more reflecting/transmitting members arranged at respective positions corresponding to the specific horizontal scan positions, the light beam separated by said unit being incident on said reflecting member and said one or more reflecting/transmitting members, and a photodetector receiving the light beam reflected by the reflecting member and said one or more reflecting/transmitting members.

42. The image forming apparatus as claimed in claim 38, wherein the horizontal synchronization detector consists of a unit separating a part of the light beam deflected by the deflecting part, two or more reflecting/transmitting members arranged at respective positions corresponding to the specific horizontal scan positions, the light beam separated by said unit being incident on said reflecting/transmitting members, and a photodetector receiving the light beam reflected by said reflecting/transmitting members.

43. The image forming apparatus as claimed in claim 38, further comprising:

a light beam source for reference, wherein a light beam for reference output from said light beam source for reference is incident on the deflecting part, and the light beam for reference deflected by the deflecting part scans outside of the medium to be scanned, and wherein the horizontal synchronization detector consists of two or more photodetectors receiving the light beam for reference deflected by the deflecting part, and are arranged at respective positions corresponding to the specific horizontal scan positions.

44. The image forming apparatus as claimed in claim 38, further comprising:

a light beam source for reference, wherein a light beam for reference output from said light beam source for reference is incident on the deflecting part, and the light beam for reference deflected by the deflecting part scans outside of the medium to be scanned, and wherein the horizontal synchronization detector consists of two or more reflecting members arranged at respective positions corresponding to the specific horizontal scan positions, the light beam for reference deflected by the deflecting part being incident on said reflecting members, and a photodetector receiving the light beam for reference reflected by said reflecting members.

45. A tandem-type image forming apparatus, comprising:

a plurality of color stations corresponding to respective colors, each including a light beam source for image writing, a pixel clock generation apparatus, and a horizontal synchronization detector for generating two or more horizontal synchronization signals supplied to said pixel clock generation apparatus, said pixel clock generation apparatus including:

a detecting circuit detecting a time interval between two of the horizontal synchronization signals;

a comparing part comparing the time interval detected by said detecting circuit and a target value, and outputting a difference therebetween;

a phase shift data generation part having a lookup table storing a pattern of phase shift data for controlling a phase shift amount of a pixel clock, and reading and outputting the phase shift data from the lookup table based on the difference that is output from said comparing part;

a high frequency clock generation part generating a high frequency clock; and a pixel clock generation part generating the pixel clock whose phase is controlled in accordance with the phase shift data that are output from said phase shift data generating part based on the high frequency clock that is generated by said high frequency clock generating part, wherein, in each of the color stations, said light beam source for image writing is driven in synchronization with the pixel clock generated by the pixel clock generation apparatus corresponding to the color station.

46. A tandem-type image forming apparatus, comprising:

a plurality of color stations corresponding to respective colors, each including a light beam source for image writing, a pixel clock generation apparatus, and a horizontal synchronization detector for generating two or more horizontal synchronization signals supplied to said pixel clock generation apparatus, said pixel clock generation apparatus including:

a detecting circuit detecting a time interval between each two adjacent horizontal synchronization signals among three or more of the horizontal synchronization signals;

a comparing part comparing each time interval detected by said detecting circuit with a target value and outputting each difference therebetween;

a phase shift data generation part having one or more lookup tables each storing a pattern of phase shift data for controlling a phase shift amount of a pixel clock, and reading and outputting the phase shift data from one of the lookup tables based on each difference that is output from said comparing part;

a high frequency clock generation part generating a high frequency clock; and a pixel clock generation part generating a pixel clock whose phase is controlled in accordance with the phase shift data that are output from said phase shift data generating part based on the high frequency clock that is generated by said high frequency clock generating part, wherein, in each of the color stations, said light beam source for image writing is driven in synchronization with the pixel clock generated by the pixel clock generation apparatus corresponding to the color station.

* * * * *